US010689949B2

(12) United States Patent
Saponja et al.

(10) Patent No.: US 10,689,949 B2
(45) **Date of Patent: *Jun. 23, 2020**

(54) SYSTEMS AND APPARATUSES FOR SEPARATING WELLBORE FLUIDS AND SOLIDS DURING PRODUCTION

(71) Applicant: Heal Systems LP, Calgary (CA)

(72) Inventors: Jeffrey Charles Saponja, Calgary (CA); Robbie Singh Hari, Calgary (CA); Shawn Deugo, Calgary (CA)

(73) Assignee: Heal Systems LP, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,376

(22) Filed: Dec. 20, 2017

(65) Prior Publication Data

US 2018/0112509 A1 Apr. 26, 2018

Related U.S. Application Data

(63) Continuation of application No. 15/836,282, filed on Dec. 8, 2017, now Pat. No. 10,113,393, which is a (Continued)

(51) Int. Cl.

| | |
|---|---|
| ***E21B 43/12*** | (2006.01) |
| ***E21B 34/10*** | (2006.01) |
| ***E21B 43/38*** | (2006.01) |

(52) U.S. Cl.

CPC ..... *E21B 34/107* (2013.01); *E21B 43/12* (2013.01); *E21B 43/122* (2013.01); (Continued)

(58) Field of Classification Search

CPC ..... E21B 43/121; E21B 43/38; E21B 43/34; E21B 21/002

See application file for complete search history.

(56) References Cited

U.S. PATENT DOCUMENTS 1,665,540 A * 4/1928 Green ..... E21B 43/12 166/105.5
5,431,228 A * 7/1995 Weingarten ..... B01D 17/00 166/169

(Continued)

FOREIGN PATENT DOCUMENTS

| | | |
|---|---|---|
| CA | 2663725 | 10/2010 |
| CA | 2943408 | 10/2015 |

OTHER PUBLICATIONS

International Search Report and Written Opinion in PCT/CA2016/000319, dated Mar. 14, 2017.

(Continued)

*Primary Examiner* — Tara E Schimpf
(74) *Attorney, Agent, or Firm* — Fish & Richardson P.C.

(57) ABSTRACT

There is provided parts for assembly to produce a flow diverter configured for disposition within a wellbore. The parts include an insert-receiving part including a passageway, and a flow diverter-effecting insert configured for insertion within the passageway. The flow diverter-effecting insert is co-operatively configured with the insert-receiving part such that a flow diverter is defined while the flow diverter-effecting insert is disposed within the passageway. The flow diverter is configured for: receiving and conducting a reservoir fluid flow; discharging the received reservoir fluid flow into the wellbore such that gaseous material is separated from the discharged reservoir fluid flow within the wellbore, in response to at least buoyancy forces, such that a gas-depleted reservoir fluid flow is obtained; and receiving and conducting the obtained gas-depleted reservoir fluid flow.

10 Claims, 24 Drawing Sheets

Related U.S. Application Data continuation of application No. PCT/CA2016/000319, filed on Dec. 19, 2016.

(60) Provisional application No. 62/269,234, filed on Dec. 18, 2015.

(52) U.S. Cl.
CPC ..... *E21B 43/123* (2013.01); *E21B 43/129* (2013.01); *E21B 43/38* (2013.01)

(56) References Cited

U.S. PATENT DOCUMENTS

| | | | | |
|---|---|---|---|---|
| 2007/0277984 | A1 | 12/2007 | Farrara | |
| 2011/0162832 | A1 | 7/2011 | Reid | |
| 2015/0204181 | A1* | 7/2015 | Roth | E21B 43/20 166/250.01 |
| 2016/0061010 | A1* | 3/2016 | Sears | E21B 33/1275 166/373 |
| 2016/0222773 | A1* | 8/2016 | Sims | E21B 43/121 |
| 2016/0333681 | A1 | 11/2016 | Mazzanti | |

OTHER PUBLICATIONS

Office Action issued in U.S. Appl. No. 15/849,147 dated Mar. 16, 2018 (14 pages).
Office Action issued in U.S. Appl. No. 15/836,282 dated Feb. 26, 2018 (10 pages).
Office Action issued in CN Application No. 201680082622.0 dated Mar. 13, 2020 (9 pages).

* cited by examiner

SYSTEMS AND APPARATUSES FOR SEPARATING WELLBORE FLUIDS AND SOLIDS DURING PRODUCTION

CROSS-REFERENCE TO RELATED APPLICATIONS

This application is a continuation of and claims priority under 35 U.S.C. § 120 from U.S. application Ser. No. 15/836,282 filed on Dec. 8, 2017 which claims priority from PCT Application No. PCT/CA2016/000319 filed on Dec. 19, 2016, which claims priority from U.S. Application No. 62/269,234, filed on Dec. 18, 2015. The entire contents of each of these priority applications are incorporated herein by reference.

TECHNICAL FIELD

The present disclosure relates to artificial lift systems, and related apparatuses, for use in producing hydrocarbon-bearing reservoirs.

BACKGROUND

Gas interference is a problem encountered while producing wells, especially wells with horizontal sections. Gas interference results in downhole pumps becoming gas locked and/or low pump efficiencies. Gas interference reduces the operating life of the pump. Downhole packer-type gas anchors or separators are provided to remedy gas lock. However, existing packer-type gas anchors occupy relatively significant amounts of space within a wellbore, rendering efficient separations difficult or expensive. Existing downhole separators also perform poorly in slug flow conditions. Existing downhole separators often have tortuous flow paths which can generate foamy fluid conditions that reduce downhole pump performance.

Production of solids is a problem encountered while producing wells. Solids can damage downhole pumps and cause other production problems.

Artificial lift systems often have to be transitioned to different forms as production declines from a well. These transitions are often costly. During early stages of production, a well can naturally flow to surface. Eventually the adjacent reservoir to the wellbore becomes depleted to the point it can no longer sustain natural flow.

SUMMARY

In one aspect, there is provided parts for assembly to produce a flow diverter configured for disposition within a wellbore, comprising: an insert-receiving part including a passageway; and a flow diverter-effecting insert configured for insertion within the passageway, wherein the flow diverter-effecting insert is co-operatively configured with the insert-receiving part such that a flow diverter is defined while the flow diverter-effecting insert is disposed within the passageway, wherein the flow diverter is configured for: receiving and conducting a reservoir fluid flow; discharging the received reservoir fluid flow into the wellbore such that gaseous material is separated from the discharged reservoir fluid flow within the wellbore, in response to at least buoyancy forces, such that a gas-depleted reservoir fluid flow is obtained; and receiving and conducting the obtained gas-depleted reservoir fluid flow.

In another aspect, there is provided parts for assembly to produce a flow diverter configured for disposition within a wellbore, comprising: an insert-receiving part includes: a reservoir fluid receiver; a gas-depleted reservoir fluid discharge communicator; a passageway extending from the reservoir fluid receiver to the gas-depleted reservoir fluid receiver; a reservoir fluid discharge communicator disposed in fluid communication with the passageway; and a gas-depleted reservoir receiver disposed in fluid communication with the passageway; a flow diverter-effecting insert configured for insertion within the passageway; wherein the insert-receiving part and the flow diverter-effecting insert are co-operatively configured such that: reservoir fluid flow, that is received by the reservoir fluid receiver, is conducted to the reservoir fluid discharge communicator for discharging, via the reservoir fluid discharge communicator, into the wellbore, such that gaseous material is separated from the discharged reservoir fluid flow within the wellbore in response to at least buoyancy forces, such that a gas-depleted reservoir fluid flow is obtained, received by the gas-depleted reservoir fluid receiver, and conducted to the gas-depleted reservoir fluid discharge communicator, for discharging via the gas-depleted reservoir fluid discharge communicator, while the flow diverter-effecting insert is disposed within the passageway of the insert-receiving part.

In another aspect, there is provided parts for assembly to produce a flow diverter configured for disposition within a wellbore, comprising: an insert-receiving part includes: a reservoir fluid receiver; a gas-depleted reservoir fluid discharge communicator; a passageway extending from the reservoir fluid receiver to the gas-depleted reservoir fluid receiver; a reservoir fluid discharge communicator disposed in fluid communication with the passageway; and a gas-depleted reservoir receiver disposed in fluid communication with the passageway; a flow diverter-effecting insert configured for insertion within the passageway; wherein the insert-receiving part and the flow diverter-effecting insert are co-operatively configured such that: bypassing of the reservoir fluid discharge communicator, by the reservoir fluid flow being received by the reservoir fluid receiver, is at least impeded by the flow diverter-effecting insert that is disposed within the passageway, such that the received reservoir fluid flow is conducted to the reservoir fluid discharge communicator and discharged into the wellbore such that gaseous material is separated from the discharged reservoir fluid flow within the wellbore in response to at least buoyancy forces, such that a gas-depleted reservoir fluid flow is obtained and conducted to the gas-depleted reservoir fluid receiver such that a gas-depleted reservoir fluid flow is received by the gas-depleted reservoir fluid receiver; and bypassing of the gas-depleted reservoir fluid discharge communicator, by the gas-depleted reservoir fluid flow being received by the gas-depleted reservoir fluid receiver, is at least impeded by the flow diverter-effecting insert that is disposed within the passageway, such that gas-depleted reservoir fluid flow is conducted to the gas-depleted reservoir fluid discharge communicator for discharging of the gas-depleted reservoir fluid flow via the gas-depleted reservoir fluid communicator; while the flow diverter-effecting insert is disposed within the passageway of the insert-receiving part.

In another aspect, there is provided parts for assembly to produce a flow diverter configured for disposition within a wellbore, comprising: an insert-receiving part includes: a reservoir fluid receiver; a gas-depleted reservoir fluid discharge communicator; a passageway extending from the reservoir fluid receiver to the gas-depleted reservoir fluid receiver; a reservoir fluid discharge communicator disposed in fluid communication with the passageway; and a gas-depleted reservoir receiver disposed in fluid communication with the passageway; a flow diverter-effecting insert configured for insertion within the passageway; wherein the insert-receiving part and the flow diverter-effecting insert are co-operatively configured such that a passageway sealed interface is established while the flow diverter-effecting insert is disposed within the passageway of the insert-receiving part, with effect that: fluid communication between the passageway and the reservoir fluid discharge communicator is established via a passageway portion that is disposed downhole relative to the passageway sealed interface, such that fluid communication is established between the reservoir fluid receiver and the reservoir fluid discharge communicator; bypassing of the reservoir fluid discharge communicator, by reservoir fluid flow, that is received by the reservoir fluid receiver, is prevented, or substantially prevented, by the passageway sealed interface, such that the received reservoir fluid flow is conducted, via the passageway portion disposed downhole relative to the passageway sealed interface, to the reservoir fluid discharge communicator, such that the received reservoir fluid flow is discharged into the wellbore and gaseous material is separated from the received reservoir fluid flow within the wellbore in response to at least buoyancy forces, such that a gas-depleted reservoir fluid flow is obtained and conducted to the gas-depleted reservoir fluid receiver such that the gas-depleted reservoir fluid flow is received by the gas-depleted reservoir fluid receiver; the fluid communication between the passageway and the gas-depleted reservoir fluid receiver is established via a passageway portion that is disposed uphole relative to the passageway sealed interface, such that fluid communication is established between the gas-depleted reservoir fluid receiver and the gas-depleted reservoir fluid discharge communicator; and bypassing of the gas-depleted reservoir fluid discharge communicator, by the gas-depleted reservoir fluid flow, that is received by the gas-depleted reservoir fluid receiver, is prevented, or substantially prevented, by the passageway sealed interface, such that the received gas-depleted reservoir fluid flow is conducted, via the passageway portion disposed uphole relative to the passageway sealed interface, from the gas-depleted reservoir fluid receiver to the gas-depleted reservoir fluid discharge communicator such that the gas-depleted reservoir fluid flow is discharged from the gas-depleted reservoir fluid discharge communicator.

In another aspect, there is provided A reservoir fluid production assembly, disposed within a wellbore, comprising: a flow diverter configured for: receiving reservoir fluid flow from a downhole wellbore space of the wellbore and conducting the received reservoir fluid flow; discharging the received reservoir fluid flow into an uphole wellbore space of the well-bore such that gaseous material is separated from the discharged reservoir fluid flow within the uphole wellbore space in response to at least buoyancy forces, such that a gas-depleted reservoir fluid flow is obtained; and receiving and conducting the gas-depleted reservoir fluid flow; a pump coupled to the flow diverter for receiving the gas-depleted reservoir fluid flow being conducted by the flow diverter; a pressurized gas-depleted reservoir fluid conductor coupled to the pump for conducting gas-depleted reservoir fluid flow, that has been pressurized by the pump, to the surface; and a wellbore sealed interface disposed within the wellbore between: (a) the uphole wellbore space of the wellbore, and (b) the downhole wellbore space of the wellbore, for preventing, or substantially preventing, bypassing of the gas-depleted reservoir fluid receiver by the gas-depleted reservoir fluid flow; wherein: the flow diverter includes: an insert-receiving part including a passageway; and a flow diverter-effecting insert disposed within the passageway.

In another aspect, there is provided a reservoir fluid production assembly, disposed within a wellbore, comprising: a flow diverter including an insert-receiving part includes: a reservoir fluid receiver; a gas-depleted reservoir fluid discharge communicator; a passageway extending from the reservoir fluid receiver to the gas-depleted reservoir fluid receiver; a reservoir fluid discharge communicator disposed in fluid communication with the passageway; and a gas-depleted reservoir receiver disposed in fluid communication with the passageway; a flow diverter-effecting insert disposed within the passageway; wherein the insert-receiving part and the flow diverter-effecting insert are co-operatively configured such that reservoir fluid flow, that is received by the reservoir fluid receiver from a downhole wellbore space of the wellbore, is conducted to the reservoir fluid discharge communicator for discharging, via the reservoir fluid discharge communicator, into an uphole wellbore space of the wellbore, such that gaseous material is separated from the discharged reservoir fluid flow within the uphole wellbore space within the wellbore in response to at least buoyancy forces, such that a gas-depleted reservoir fluid flow is obtained, received by the gas-depleted reservoir fluid receiver, and conducted to the gas-depleted reservoir fluid discharge communicator, for discharging via the gas-depleted reservoir fluid discharge communicator; a pump coupled to the flow diverter for receiving the gas-depleted reservoir fluid flow discharged from the flow diverter; a pressurized gas-depleted reservoir fluid conductor coupled to the pump for conducting gas-depleted reservoir fluid flow, that has been pressurized by the pump, to the surface; and a wellbore sealed interface disposed within the wellbore between: (a) the uphole wellbore space of the wellbore, and (b) the downhole wellbore space of the wellbore, for preventing, or substantially preventing, bypassing of the gas-depleted reservoir fluid receiver by the gas-depleted reservoir fluid flow.

In another aspect, there is provided a reservoir fluid production assembly, disposed within a wellbore, comprising: a flow diverter including: an insert-receiving part, including: a reservoir fluid receiver; a gas-depleted reservoir fluid discharge communicator; a passageway extending from the reservoir fluid receiver to the gas-depleted reservoir fluid receiver; a reservoir fluid discharge communicator disposed in fluid communication with the passageway; and a gas-depleted reservoir receiver disposed in fluid communication with the passageway; a flow diverter-effecting insert disposed within the passageway; wherein the insert-receiving part and the flow diverter-effecting insert are co-operatively configured such that: bypassing of the reservoir fluid discharge communicator, by the reservoir fluid flow being received by the reservoir fluid receiver from a downhole wellbore space of the wellbore, is at least impeded by the flow diverter-effecting insert that is disposed within the passageway, such that the received reservoir fluid flow is conducted to the reservoir fluid discharge communicator and discharged into an uphole wellbore space of the wellbore such that gaseous material is separated from the discharged reservoir fluid flow within the uphole wellbore space of the wellbore in response to at least buoyancy forces, such that a gas-depleted reservoir fluid flow is obtained and conducted to the gas-depleted reservoir fluid receiver such that a gas-depleted reservoir fluid flow is received by the gas-depleted reservoir fluid receiver; and bypassing of the gas-depleted reservoir fluid discharge communicator, by the gas-depleted reservoir fluid flow being received by the gas-depleted reservoir fluid receiver, is at least impeded by the flow diverter-effecting insert that is disposed within the passageway, such that gas-depleted reservoir fluid flow is conducted to the gas-depleted reservoir fluid discharge communicator for discharging of the gas-depleted reservoir fluid flow via the gas-depleted reservoir fluid communicator; a pump coupled to the flow diverter for receiving the gas-depleted reservoir fluid flow discharged from the flow diverter; a pressurized gas-depleted reservoir fluid conductor coupled to the pump for conducting gas-depleted reservoir fluid flow, that has been pressurized by the pump, to the surface; and a wellbore sealed interface disposed within the wellbore between: (a) the uphole wellbore space of the wellbore, and (b) the downhole wellbore space of the wellbore, for preventing, or substantially preventing, bypassing of the gas-depleted reservoir fluid receiver by the gas-depleted reservoir fluid flow.

In another aspect, there is provided a reservoir fluid production assembly, disposed within a wellbore, comprising: a flow diverter including: an insert-receiving part includes: a reservoir fluid receiver; a gas-depleted reservoir fluid discharge communicator; a passageway extending from the reservoir fluid receiver to the gas-depleted reservoir fluid receiver; a reservoir fluid discharge communicator disposed in fluid communication with the passageway; and a gas-depleted reservoir receiver disposed in fluid communication with the passageway; a flow diverter-effecting insert disposed within the passageway; wherein the insert-receiving part and the flow diverter-effecting insert are co-operatively configured such that a passageway sealed interface is established by the disposition of the flow diverter-effecting insert is within the passageway of the insert-receiving part, with effect that: fluid communication between the passageway and the reservoir fluid discharge communicator is established via a passageway portion that is disposed downhole relative to the passageway sealed interface, such that fluid communication is established between the reservoir fluid receiver and the reservoir fluid discharge communicator; bypassing of the reservoir fluid discharge communicator, by reservoir fluid flow, that is received by the reservoir fluid receiver from a downhole wellbore space, is prevented, or substantially prevented, by the passageway sealed interface, such that the received reservoir fluid flow is conducted, via the passageway portion disposed downhole relative to the passageway sealed interface, to the reservoir fluid discharge communicator, such that the received reservoir fluid flow is discharged into an uphole wellbore space of the wellbore and gaseous material is separated from the received reservoir fluid flow within the uphole wellbore space of the wellbore in response to at least buoyancy forces, such that a gas-depleted reservoir fluid flow is obtained and conducted to the gas-depleted reservoir fluid receiver such that the gas-depleted reservoir fluid flow is received by the gas-depleted reservoir fluid receiver; fluid communication between the passageway and the gas-depleted reservoir fluid receiver is established via a passageway portion that is disposed uphole relative to the passageway sealed interface, such that fluid communication is established between the gas-depleted reservoir fluid receiver and the gas-depleted reservoir fluid discharge communicator; and bypassing of the gas-depleted reservoir fluid discharge communicator, by the gas-depleted reservoir fluid flow, that is received by the gas-depleted reservoir fluid receiver, is prevented, or substantially prevented, by the passageway sealed interface, such that the received gas-depleted reservoir fluid flow is conducted, via the passageway portion disposed uphole relative to the passageway sealed interface, from the gas-depleted reservoir fluid receiver to the gas-depleted reservoir fluid discharge communicator such that the gas-depleted reservoir fluid flow is discharged from the gas-depleted reservoir fluid discharge communicator; a pump coupled to the flow diverter for receiving the gas-depleted reservoir fluid flow discharged from the flow diverter; a pressurized gas-depleted reservoir fluid conductor coupled to the pump for conducting gas-depleted reservoir fluid flow, that has been pressurized by the pump, to the surface; and a wellbore sealed interface disposed within the wellbore between: (a) the uphole wellbore space of the wellbore, and (b) the downhole wellbore space of the wellbore, for preventing, or substantially preventing, bypassing of the gas-depleted reservoir fluid receiver by the gas-depleted reservoir fluid flow.

In another aspect, there is provided a process for producing reservoir fluids from a reservoir disposed within a subterranean formation, comprising: producing gas-depleted reservoir fluid from the reservoir via a production string disposed within a wellbore, wherein the producing includes: via a flow diverter, receiving reservoir fluid flow from a downhole wellbore space, conducting the received reservoir fluid flow uphole, discharging the received reservoir fluid flow into an uphole wellbore space such that, while the discharged reservoir fluid flow is disposed within the uphole wellbore space, gaseous material is separated from the discharged reservoir fluid flow in response to at least buoyancy forces, such that a gas-depleted reservoir fluid flow is obtained; receiving and conducting the gas-depleted reservoir fluid flow, and discharging the conducted gas-depleted reservoir fluid flow; wherein: the flow diverter includes an insert-receiving part and a flow diverter-effecting insert, the insert-receiving part includes a passageway; and the flow diverter-effecting insert is disposed within the passageway; and conducting the discharged gas-depleted reservoir fluid to the pump; pressurizing the gas-depleted reservoir fluid with the pump such that the gas-depleted reservoir fluid is conducted to the surface; and displacing the flow diverter-effecting insert, relative to the insert-receiving part, such that occlusion of the passageway of the insert-receiving part, by the flow diverter-effecting insert, is at least partially removed, and such that the insert-receiving part becomes disposed in a non-occluded condition.

In another aspect, there is provided a process for producing reservoir fluids from a reservoir disposed within a subterranean formation, comprising: over a first time interval, via a production string disposed within a wellbore, producing reservoir fluids from the reservoir with a pump disposed at a first position within the production string; and after the first time interval, suspending the producing, and while the production string remains disposed within the wellbore: redeploying the pump within the production string such that the pump becomes disposed at a second position that is disposed below the first position; and over a second time interval, and via the production string, producing reservoir fluids from the reservoir with the pump.

In another aspect, there is provided a method of creating a flow diverter comprising: providing an insert-receiving part including a passageway; inserting a flow diverter-effecting insert within the passageway such that the flow diverter is obtained, and the flow diverter is configured for receiving reservoir fluid flow from a downhole wellbore space, conducting the received reservoir fluid flow uphole, discharging the received reservoir fluid flow into an uphole wellbore space such that, while the discharged reservoir fluid flow is disposed within the uphole wellbore space, gaseous material is separated from the discharged reservoir fluid flow in response to at least buoyancy forces, such that a gas-depleted reservoir fluid flow is obtained; receiving and conducting the gas-depleted reservoir fluid flow, and discharging the conducted gas-depleted reservoir fluid flow In another aspect, there is provided a reservoir fluid production string, disposed within a wellbore, comprising: a reservoir-fluid conductor for receiving reservoir fluid flow from a downhole wellbore space; a flow diverter fluidly coupled to the reservoir fluid conductor for receiving reservoir fluid flow from the reservoir fluid conductor, and including: a reservoir fluid discharge communicator for discharging the received reservoir fluid flow into an uphole wellbore space of the wellbore such that gaseous material is separated from the discharged reservoir fluid flow within the uphole wellbore space in response to at least buoyancy forces, such that a gas-depleted reservoir fluid flow is obtained; and a gas-depleted reservoir fluid receiver for receiving the obtained gas-depleted reservoir fluid flow; and a gas-depleted reservoir fluid conductor for conducting the receiving gas-depleted reservoir fluid flow; a gas-depleted reservoir fluid discharge communicator for discharging the conducted gas-depleted reservoir fluid flow; a pump fluidly coupled to the flow diverter for receiving the gas-depleted reservoir fluid flow being conducted by the flow diverter and pressurizing the gas-depleted reservoir fluid flow; a pressurized gas-depleted reservoir fluid conductor coupled to the pump for conducting gas-depleted reservoir fluid, that has been pressurized by the pump, to the surface; a sealed interface disposed within the wellbore between: (a) the uphole wellbore space of the wellbore, and (b) the downhole wellbore space of the wellbore, for preventing, or substantially preventing, bypassing of the gas-depleted reservoir fluid receiver by the gas-depleted reservoir fluid; wherein a space, disposed between the gas-depleted reservoir fluid receiver and the sealed interface, defines a sump for collecting solid debris that has separated from the reservoir fluid within the uphole wellbore space; and a fluid barrier member that is displaceable between open and closed positions, wherein, in the open position, fluid communication is established through a port extending through the fluid conductor, between the sump and the fluid conductor. Relatedly, there is provided a process for removing the collected solid debris using this assembly.

In another aspect, there is provided a process for producing reservoir fluids from a reservoir disposed within a subterranean formation, comprising: producing reservoir fluid from the reservoir, wherein the producing includes: over a first time interval, producing reservoir fluid from the reservoir via a production string; wherein: the production string including: an insert-receiving part, wherein the insert-receiving part includes a reservoir fluid receiver; a gas-depleted reservoir fluid discharge communicator; a passageway extending from the reservoir fluid receiver to the gas-depleted reservoir fluid discharge communicator; a reservoir fluid conductor extending from a first passageway portion, of the passageway, to the reservoir fluid discharge communicator; a gas-depleted reservoir fluid conductor extending from a second passageway portion, of the passageway, to the gas-depleted reservoir fluid discharge communicator; a flow through-effecting insert disposed within the passageway such that: (i) a passageway sealed interface is established for preventing, or substantially preventing, independently, each one of: (a) fluid communication, via the gas-depleted reservoir fluid-conducting conductor, between the passageway and the gas-depleted reservoir fluid receiver; and (b) fluid communication, via the reservoir fluid conductor, between the passageway and the reservoir fluid discharge communicator; and (ii) the passageway is sufficiently unobstructed such that conduction of reservoir fluid, from the reservoir fluid receiver to the gas-depleted reservoir fluid discharge communicator, via the passageway, is effectible; and the producing includes receiving reservoir fluid from a downhole wellbore space and conducting the received reservoir fluid, via the flow through-effecting insert, to the surface in response to a pressure differential between the reservoir and the surface; suspending the producing; after the suspending of the producing, displacing the flow through-effecting insert relative to the insert-receiving part such that the sealed interface is defeated, and such that: (i) the first passageway portion becomes disposed in fluid communication with the reservoir fluid discharge communicator via the reservoir fluid conductor, and (ii) the second passageway portion becomes disposed in fluid communication with the gas-depleted reservoir fluid discharge communicator via the gas-depleted reservoir fluid conductor; after the displacing of the flow through-effecting insert, deploying the flow diverter-effecting insert such that the flow diverter-effecting insert becomes disposed within the passageway of the insert-receiving part, such that a flow diverter is obtained, wherein the flow diverter is configured for receiving reservoir fluid flow from a downhole wellbore space, conducting the received reservoir fluid flow uphole, discharging the received reservoir fluid flow into an uphole wellbore space such that, while the discharged reservoir fluid flow is disposed within the uphole wellbore space, gaseous material is separated from the discharged reservoir fluid flow in response to at least buoyancy forces, such that a gas-depleted reservoir fluid flow is obtained, receiving and conducting the gas-depleted reservoir fluid flow, and discharging the conducted gas-depleted reservoir fluid flow; deploying the pump within the production string to a position that is uphole relative to the flow diverter; and over a second time interval, producing reservoir fluid from the reservoir via the pump.

In another aspect, there is provided a process for producing reservoir fluids from a reservoir disposed within a subterranean formation, comprising: producing gas-depleted reservoir fluid from the reservoir via a production string disposed within a producing wellbore, wherein the producing includes: via a flow diverter, receiving reservoir fluid flow from a downhole wellbore space, conducting the received reservoir fluid flow uphole, discharging the received reservoir fluid flow into an uphole wellbore space such that, while the discharged reservoir fluid flow is disposed within the uphole wellbore space, gaseous material is separated from the discharged reservoir fluid flow in response to at least buoyancy forces, such that a gas-depleted reservoir fluid flow is obtained; receiving and conducting the gas-depleted reservoir fluid flow, and discharging the conducted gas-depleted reservoir fluid flow; wherein: the flow diverter includes an insert-receiving part and a flow diverter-effecting insert, the insert-receiving part includes a passageway; and the flow diverter-effecting insert is disposed within the passageway and releasably coupled to the insert-receiving part via a coupler disposed within the production string; and conducting the discharged gas-depleted reservoir fluid to the pump; pressurizing the gas-depleted reservoir fluid with the pump such that the gas-depleted reservoir fluid is conducted to the surface; and uncoupling the flow diverter-effecting insert from the coupler; displacing the flow-diverter-effecting insert, relative to the insert-receiving part, such that the coupler becomes disposed for coupling to a plug; and after the displacing, deploying a plug downhole, and coupling the plug to the coupler such that a sealed interface is established for preventing, or substantially preventing, flow of material uphole of the plug.

DESCRIPTION OF DRAWINGS

The process of the preferred embodiments of the invention will now be described with the following accompanying drawing.

DETAILED DESCRIPTION

As used herein, the terms "up", "upward", "upper", or "uphole", mean, relativistically, in closer proximity to the surface 106 and further away from the bottom of the wellbore, when measured along the longitudinal axis of the wellbore 102. The terms "down", "downward", "lower", or "downhole" mean, relativistically, further away from the surface 106 and in closer proximity to the bottom of the wellbore 102, when measured along the longitudinal axis of the wellbore 102.

Figure 1:
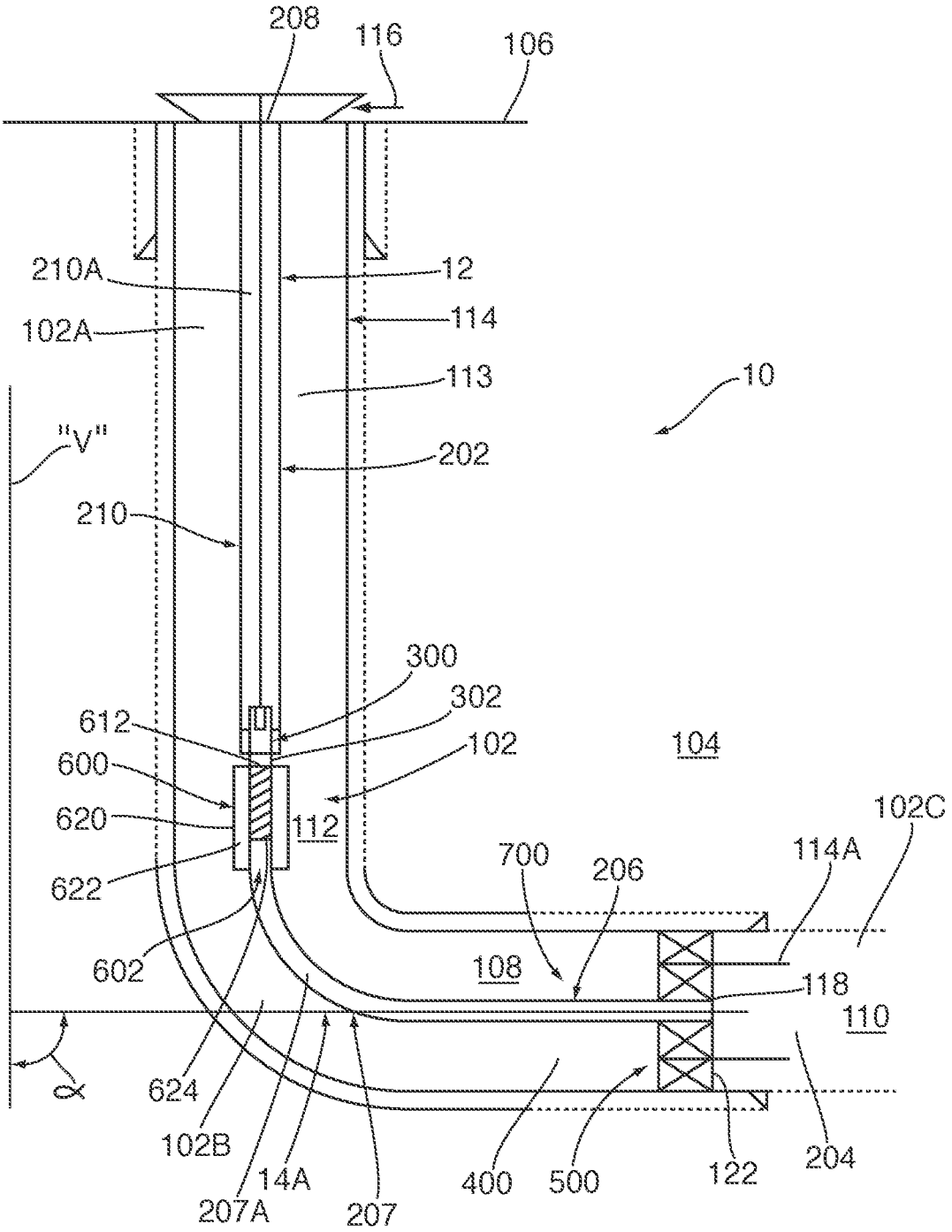
FIG. 1 is a schematic illustration of an embodiment of a system of the present disclosure.

Referring to FIG. 1, there are provided systems 10, with associated apparatuses, for producing hydrocarbons from a reservoir, such as an oil reservoir, within a subterranean formation 100, when reservoir pressure within the oil reservoir is insufficient to conduct reservoir fluid to the surface 106 through a wellbore 102.

The wellbore 102 can be straight, curved, or branched. The wellbore 102 can have various wellbore portions. A wellbore portion is an axial length of a wellbore 102. A wellbore portion can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore portion as understood in the art, such as, for example, a wellbore section having a central longitudinal axis that is between 70 and 110 degrees from vertical. The term "vertical", when used to describe a wellbore section refers to a vertical or substantially vertical section, such as, for example, a wellbore section having a central longitudinal axis that is between "0" (zero) and 20 degrees from the vertical. In some embodiments, for example, the wellbore 102 includes a "transition" section 102B disposed between (and, in some embodiments, for example, joining) the vertical 102A and horizontal sections 102C.

"Reservoir fluid" is fluid that is contained within a hydrocarbon reservoir. Reservoir fluid may be liquid material, gaseous material, or a mixture of liquid material and gaseous material. In some embodiments, for example, the reservoir fluid includes water and hydrocarbon material, such as oil, natural gas condensates, or any combination thereof.

Fluids may be injected into the oil reservoir through the wellbore to effect stimulation of the reservoir fluid. For example, such fluid injection is effected during hydraulic fracturing, water flooding, water disposal, gas floods, gas disposal (including carbon dioxide sequestration), steam-assisted gravity drainage ("SAGD") or cyclic steam stimulation ("CSS"). In some embodiments, for example, the same wellbore is utilized for both stimulation and production operations, such as for hydraulically fractured formations or for formations subjected to CSS. In some embodiments, for example, different wellbores are used, such as for formations subjected to SAGD, or formations subjected to waterflooding.

A wellbore string 114 is employed within the wellbore 102 for stabilizing the subterranean formation 100. In some embodiments, for example, the wellbore string 114 also contributes to effecting fluidic isolation of one zone within the subterranean formation from another zone within the subterranean formation. In some embodiments, for example, the wellbore string 114 includes casing.

The fluid productive portion of the wellbore 102 may be completed either as a cased-hole completion or an open-hole completion.

A cased-hole completion involves running wellbore casing down into the wellbore through the production zone. In this respect, in the cased-hole completion, the wellbore string 114 includes wellbore casing.

The annular region between the deployed casing and the reservoir may be filled with cement for effecting zonal isolation (see below). The cement is disposed between the wellbore casing and the oil reservoir for the purpose of effecting isolation, or substantial isolation, of one or more zones of the oil reservoir from fluids disposed in another zone of the oil reservoir. Such fluids include reservoir fluid being produced from another zone of the oil reservoir (in some embodiments, for example, such reservoir fluid being flowed through a production tubing string disposed within and extending through the wellbore casing to the surface), or injected fluids such as water, gas (including carbon dioxide), or stimulations fluids such as fracturing fluid or acid. In this respect, in some embodiments, for example, the cement is provided for effecting sealing, or substantial sealing, of fluid communication between one or more zones of the oil reservoir and one or more others zones of the oil reservoir (for example, such as a zone that is being produced). By effecting the sealing, or substantial sealing, of such fluid communication, isolation, or substantial isolation, of one or more zones of the oil reservoir, from another subterranean zone (such as a producing formation), is achieved. Such isolation or substantial isolation is desirable, for example, for mitigating contamination of a water table within the oil reservoir by the reservoir fluid (e.g. oil, gas, salt water, or combinations thereof) being produced, or the above-described injected fluids.

In some embodiments, for example, the cement is disposed as a sheath within an annular region between the wellbore casing and the oil reservoir. In some embodiments, for example, the cement is bonded to both of the production casing and the oil reservoir.

In some embodiments, for example, the cement also provides one or more of the following functions: (a) strengthens and reinforces the structural integrity of the wellbore, (b) prevents, or substantially prevents, produced reservoir fluid of one zone from being diluted by water from other zones. (c) mitigates corrosion of the wellbore casing, (d) at least contributes to the support of the wellbore casing, and e) allows for segmentation for stimulation and fluid inflow control purposes.

The cement is introduced to an annular region between the wellbore casing and the oil reservoir after the subject wellbore casing has been run into the wellbore. This operation is known as "cementing".

In some embodiments, for example, the wellbore casing includes one or more casing strings, each of which is positioned within the well bore, having one end extending from the well head. In some embodiments, for example, each casing string is defined by jointed segments of pipe. The jointed segments of pipe typically have threaded connections.

Typically, a wellbore contains multiple intervals of concentric casing strings, successively deployed within the previously run casing. With the exception of a liner string, casing strings typically run back up to the surface 106.

For wells that are used for producing reservoir fluid, few of these actually produce through wellbore casing. This is because producing fluids can corrode steel or form undesirable deposits (for example, scales, asphaltenes or paraffin waxes) and the larger diameter can make flow unstable. In this respect, a production string is usually installed inside the last casing string. The production string is provided to conduct reservoir fluid, received within the wellbore, to the wellhead 116. In some embodiments, for example. the annular region between the last casing string and the production tubing string may be sealed at the bottom by a packer.

To facilitate fluid communication between the reservoir and the wellbore, the wellbore casing may be perforated, or otherwise include per-existing ports (which may be selectively openable, such as, for example, by shifting a sleeve), to provide a fluid passage for enabling flow of reservoir fluid from the reservoir to the wellbore.

In some embodiments, for example, the wellbore casing is set short of total depth. Hanging off from the bottom of the wellbore casing, with a liner hanger or packer, is a liner string. The liner string can be made from the same material as the casing string, but, unlike the casing string, the liner string does not extend back to the wellhead 116. Cement may be provided within the annular region between the liner string and the oil reservoir for effecting zonal isolation (see below), but is not in all cases. In some embodiments, for example, this liner is perforated to effect fluid communication between the reservoir and the wellbore. In this respect, in some embodiments, for example, the liner string can also be a screen or is slotted. In some embodiments, for example, the production tubing string may be engaged or stung into the liner string, thereby providing a fluid passage for conducting the produced reservoir fluid to the wellhead 116. In some embodiments, for example, no cemented liner is installed, and this is called an open hole completion or uncemented casing completion.

An open-hole completion is effected by drilling down to the top of the producing formation, and then casing the wellbore (with a wellbore string 114). The wellbore is then drilled through the producing formation, and the bottom of the wellbore is left open (i.e. uncased), to effect fluid communication between the reservoir and the wellbore. Open-hole completion techniques include bare foot completions, pre-drilled and pre-slotted liners, and open-hole sand control techniques such as stand-alone screens, open hole gravel packs and open hole expandable screens. Packers and casing can segment the open hole into separate intervals and ported subs can be used to effect fluid communication between the reservoir and the wellbore.

Referring to FIG. 1, the system 10 includes a reservoir fluid production assembly 12 for effecting production of reservoir fluid from the reservoir 104. The assembly 12 is disposed within the wellbore 102. The assembly 12 includes a production string 202 that is disposed within the wellbore 102. The production string 202 includes a pump 300 and a flow diverter 600.

The flow diverter 600 is provided for, amongst other things, mitigating gas lock within the pump 300.

The flow diverter 600 is configured for:

(i) receiving and conducting reservoir fluid flow;

(ii) discharging the received reservoir fluid flow into the wellbore such that gaseous material is separated from the discharged reservoir fluid flow within the wellbore in response to at least buoyancy forces, such that a gas-depleted reservoir fluid flow is obtained; and (iii) receiving and conducting the gas-depleted reservoir fluid flow for supplying to a pump.

In some embodiments, for example, the flow diverter 600 is disposed in the vertical section of the wellbore 102.

The pump 300 is provided to, through mechanical action, pressurize and effect conduction of the reservoir fluid from the reservoir 104, through the wellbore 102, and to the surface 106, and thereby effect production of the reservoir fluid. It is understood that the reservoir fluid being conducted uphole through the wellbore 102, via the production string 202, may be additionally energized by supplemental means, including by gas-lift. In some embodiments, for example, the pump 300 is a sucker rod pump. Other suitable pumps 300 include progressive cavity screw pumps, electrical submersible pumps, and jet pumps.

As discussed above, the wellbore 102 is disposed in fluid communication (such as through perforations provided within the installed casing or liner, or by virtue of the open hole configuration of the completion), or is selectively disposable into fluid communication (such as by perforating the installed casing, or by actuating a valve to effect opening of a port), with the reservoir 104. When disposed in fluid communication with the reservoir 104, the wellbore 102 is disposed for receiving reservoir fluid flow from the reservoir 104.

The production string 202 includes a production string inlet 204 for receiving, from a downhole wellbore space 110 of the wellbore 102, the reservoir fluid flow from the reservoir. In this respect, the reservoir fluid flow enters the wellbore 102, as described above, and is then conducted to the production string inlet 204. The production string 202 includes a downhole portion 206, disposed downhole relative to the pump, for conducting the reservoir fluid flow, that is being received by the production string inlet, such that the reservoir fluid flow, that is received by the inlet 204, is conducted to the flow diverter 600 via the downhole portion 206.

The production string 202 also includes a production string outlet 208 for discharging a gas-depleted reservoir fluid flow, that has been pressurized by the pump 300, to the surface 106. In this respect, the production string 202 includes an uphole portion 210, disposed uphole relative to the pump 300, for conducting fluid flow, that is being discharged from the pump discharge 304, to the production string outlet 208. The uphole production string portion 210 extends to the surface 106 via the wellhead 116, to thereby effect transport of the gas-depleted fluid to the surface 106 such that it is discharged above the surface 106. The uphole production string portion 210 is hung from the wellhead 116.

It is preferable to remove at least a fraction of the gaseous material from the reservoir fluid flow being conducted within the production string 202, prior to the pump suction 302, in order to mitigate gas interference or gas lock conditions during pump operation. The flow diverter 600, is provided to, amongst other things, perform this function. In this respect, the flow diverter 600 is disposed downhole relative to the pump 300 and is connected to the pump suction 302. Suitable exemplary flow diverters are described in International Application No. PCT/CA2015/000178, published on Oct. 1, 2015.

In some embodiments, for example, the flow diverter 600 is configured such that the depletion of gaseous material from the reservoir fluid material, that is effected while the assembly 12 is disposed within the wellbore 102, is effected externally of the flow diverter 600 within the wellbore 102, such as, for example, within the space between the flow diverter 600 and the wellbore string 114, such as, for example, within an annular space between the flow diverter 600 and the wellbore string 114.

Figure 2A:
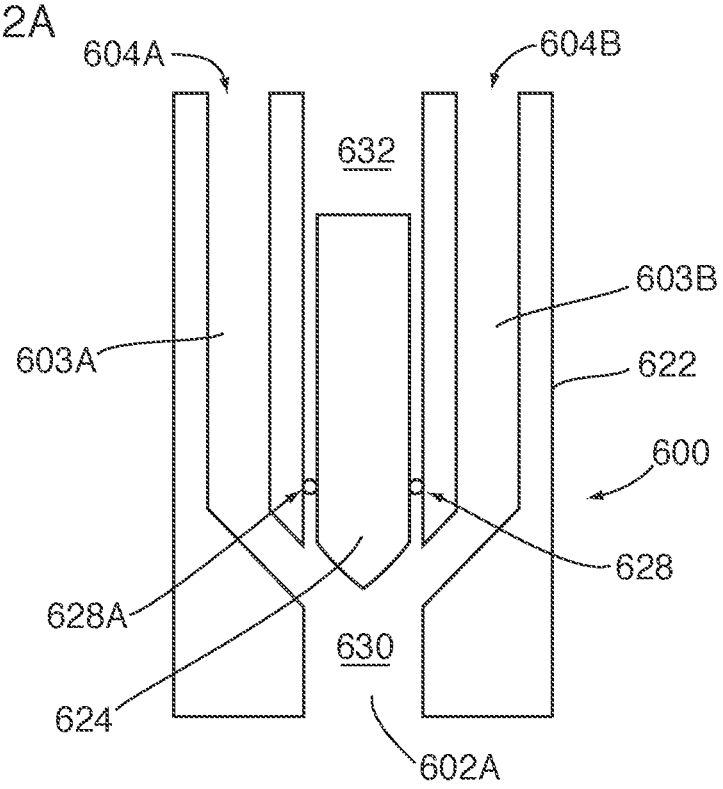
FIG. 2A is a schematic illustration of the flow diverter of the present disclosure.
Figure 2B:
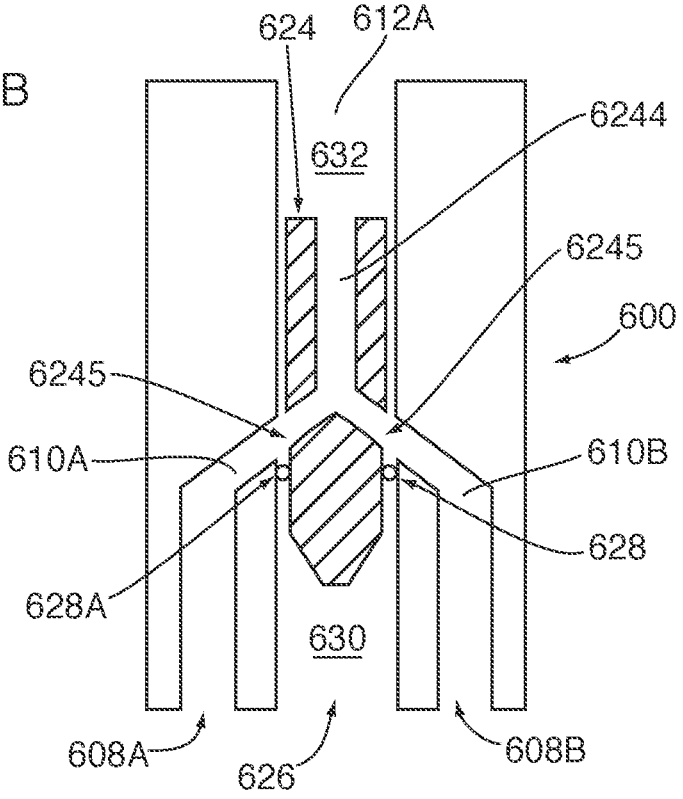
FIG. 2B is a schematic illustration of the flow diverter of the present disclosure.
Figure 3:
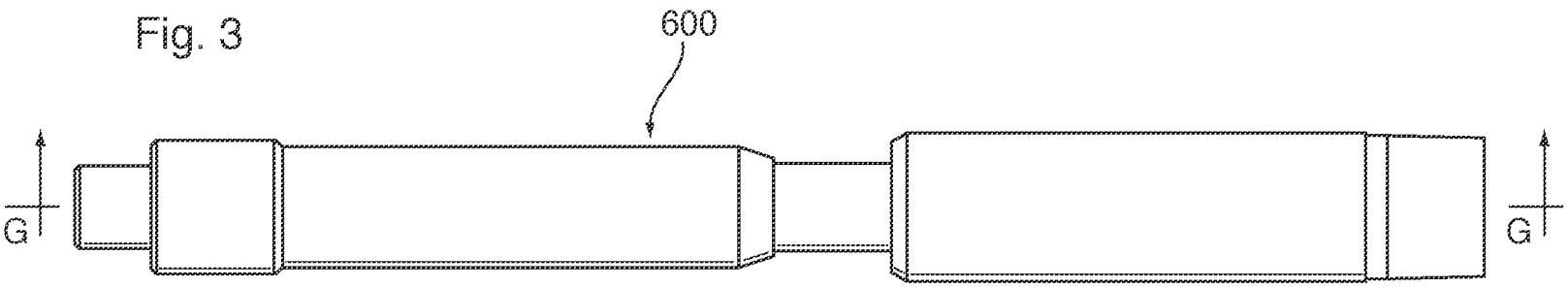
FIG. 3 is a side elevation view of the exterior of flow diverter.

Referring to FIGS. 2A and 2B, the flow diverter 600 includes a reservoir fluid receiver 602 (such as, for example, in the form of one or more ports) for receiving the reservoir fluid (such as, for example, in the form of a reservoir fluid flow) that is being conducted (e.g. flowed), via the downhole portion 206 of the production string 202, from the production string inlet 204. In some embodiments, for example, the downhole portion 206 is connected to the reservoir fluid receiver 602.

The flow diverter 600 also includes a reservoir fluid discharge communicator 604 (such as, for example, in the form of one or more ports) that is fluidly coupled to the reservoir fluid receiver 602 via a reservoir fluid-conductor 603. In some embodiments, for example, the reservoir fluid conductor 603 includes one or more reservoir fluid conductor passages 603A (including, for example, a network of passages) effecting fluid communication between the reservoir fluid receiver 602 and the reservoir fluid discharge communicator 604. The reservoir fluid discharge communicator 604 is configured for discharging reservoir fluid (such as, for example, in the form of a flow), that is received by the reservoir fluid receiver 602 and conducted to the reservoir fluid discharge communicator 604 via the reservoir fluid conductor 603, into the wellbore 102 (such as, for example, an uphole wellbore space 108 of the wellbore 102). In some embodiments, for example, the reservoir fluid discharge communicator 604 is disposed at an opposite end of the flow diverter 600 relative to the reservoir fluid receiver 602. In those embodiments where the reservoir fluid discharge communicator 604 includes a plurality of ports, each one of the ports, independently, is fluid coupled to the reservoir fluid receiver 602 via a respective one of a plurality of reservoir fluid conductor branches.

Referring to FIGS. 3, 4, 5, 6, 6A, 6B, 6C, 6D and 6E, in some embodiments, for example, the reservoir fluid receiver 602 includes a reservoir fluid inlet port 602A and the reservoir fluid discharge communicator 604 includes a plurality of reservoir fluid outlet ports (six (6) reservoir fluid outlet ports 604(*a*)-(*f*) are shown in the illustrated embodiment). Each one of the reservoir fluid outlet ports 604(*a*)-(*f*), independently, is disposed in fluid communication with the reservoir fluid inlet port 602A. In this respect, the reservoir fluid conductor 603 includes a reservoir fluid passage network extending between the reservoir fluid inlet port 602A and the reservoir fluid outlet ports 604(*a*)-(*f*) for effecting fluid coupling of the reservoir fluid inlet port 602 to the reservoir fluid outlet ports 604(*a*)-(*f*). The reservoir fluid passage network includes a plurality of reservoir fluid conductor branches 603(*a*)-(*f*). Each one of the reservoir fluid conductor branches 603(*a*)-(*f*), independently, extends from a respective reservoir fluid outlet port 604(*a*)-(*f*) and is disposed in fluid communication with the reservoir fluid inlet port 602 such that the plurality of reservoir fluid outlet ports 604(*a*)-(*f*) are fluidly coupled, by the reservoir fluid passage branches 603(*a*)-(*f*), to the reservoir fluid inlet port 602A.

In some embodiments, for example, for at least one of the reservoir fluid passage branches (in the illustrated embodiment, this is all of the reservoir fluid conductor branches 603(*a*)-(*f*)), the reservoir fluid conductor branch includes one or more operative reservoir fluid conductor branch portions, and each one of the one or more operative reservoir fluid conductor branch portions independently, includes a fluid passage that has a central longitudinal axis that is disposed at an angle of less than 30 degrees relative to the central longitudinal axis of the reservoir fluid inlet port 602. In some embodiments, for example, the one or more operative reservoir fluid conductor branch portions define at least an operative reservoir fluid conductor branch fraction, and the axial length of the operative reservoir fluid conductor branch fraction defines at least 25% (such as, for example, at least 50%) of the total axial length of the reservoir fluid conductor branch.

The flow diverter 600 also includes a gas-depleted reservoir fluid receiver 608 (such as, for example, in the form of one or more ports) for receiving a gas-depleted reservoir fluid (such as, for example, in the form of a flow), after gaseous material has been separated from the reservoir fluid (for example, a reservoir fluid flow), that has been discharged from the reservoir fluid discharge communicator 604 into the wellbore (such as, for example, the uphole wellbore space 108), in response to at least buoyancy forces. In this respect, the gas-depleted reservoir fluid receiver 608 and the reservoir fluid discharge communicator 604 are co-operatively configured such that the gas-depleted reservoir fluid receiver 608 is disposed for receiving a gas-depleted reservoir fluid flow, after gaseous material has been separated from the received reservoir fluid flow that has been discharged from the reservoir fluid discharge communicator 604 into the wellbore 102, in response to at least buoyancy forces. In some embodiments, for example, the reservoir fluid discharge communicator 604 is disposed at an opposite end of the flow diverter 600 relative to the gas-depleted reservoir fluid receiver 608.

The flow diverter 600 also includes a gas-depleted reservoir fluid conductor 610 that includes one or more gas-depleted reservoir fluid-conducting passages 610A (including, for example, a network of passages) configured for conducting the gas-depleted reservoir fluid (for example, a gas-depleted reservoir fluid flow) received by the receiver 608. The gas-depleted reservoir fluid-conductor 610 is configured for fluid coupling to the pump 300. The fluid coupling is for supplying the pump 300 with the gas-depleted reservoir fluid received by the receiver 610.

In some embodiments, for example, the flow diverter 600 includes a gas-depleted reservoir fluid discharge communicator 612. The reservoir fluid discharge communicator 612 is configured for discharging reservoir fluid (such as, for example, in the form of a flow), that is received by the gas-depleted reservoir fluid receiver 608 and conducted to the gas-depleted reservoir fluid discharge communicator 612 via the reservoir fluid conductor 610. In some embodiments, for example, the gas-depleted reservoir fluid discharge communicator 612 is disposed at an opposite end of the flow diverter 600 relative to the gas-depleted reservoir fluid receiver 608. The discharging of the gas-depleted reservoir fluid, from the gas-depleted reservoir fluid discharge communicator 612, is for supplying to the suction 302 of the pump 300.

In some embodiments, for example, the gas-depleted reservoir fluid receiver 608 includes a plurality of gas-depleted reservoir fluid inlet ports (six (6) gas-depleted reservoir fluid inlet ports are provided in correspondence with the six (6) branches 610(*a*)-(*f*), described below), and the gas-depleted reservoir fluid discharge communicator 612 includes a gas-depleted reservoir fluid outlet port 612A. Each one of the gas-depleted reservoir fluid inlet ports 608, independently, is disposed in fluid communication with the gas-depleted reservoir fluid outlet port 612A.

In this respect, the gas-depleted reservoir fluid conductor 610 includes a gas-depleted reservoir fluid passage network extending between the gas-depleted reservoir fluid inlet ports 608(*a*)-(*f*) and the gas-depleted reservoir fluid outlet port 612A for effecting fluid coupling of the gas-depleted reservoir fluid outlet port 612 to the gas-depleted reservoir fluid inlet ports 608(*a*)-(*f*). The gas-depleted reservoir fluid passage network includes a plurality of reservoir fluid conductor branches 610(*a*)-(*f*). Each one of the gas-depleted reservoir fluid conductor branches 610(*a*)-(*f*), independently, extends from a respective gas-depleted reservoir fluid inlet port 608(*a*)-(*f*) and is disposed in fluid communication with the gas-depleted reservoir fluid outlet port 612 via ports 6245 (such as, for example, in the form of elongated slots), a fluid passage 6244, and a port 6243 of a flow diverter-effecting insert 624 (see below), such that the plurality of gas-depleted reservoir fluid inlet ports 608 are fluidly coupled, via the gas-depleted reservoir fluid passage branches 610(*a*)-(*f*), the ports 6245, the fluid passage 6244, and the port 6243 to the gas-depleted reservoir fluid outlet port 612A.

In some embodiments, for example, for at least one of the gas-depleted reservoir fluid passage branches 610(*a*)-(*f*) (in the illustrated embodiment, this is all of the gas-depleted reservoir fluid passage branches), the gas-depleted reservoir fluid passage branch includes one or more operative gas-depleted reservoir fluid passage branch portions, and each one of the one or more operative gas-depleted reservoir fluid passage branch portions, independently, has a central longitudinal axis that is disposed at an angle of less than 30 degrees relative to the central longitudinal axis of the gas-depleted reservoir fluid outlet port 612. In some embodiments, for example, the one or more operative gas-depleted reservoir fluid passage branch portions define at least an operative gas-depleted reservoir fluid passage branch fraction, and the axial length of the operative gas-depleted reservoir fluid passage branch fraction defines at least 25% (such as, for example, at least 50%) of the total axial length of the gas-depleted reservoir fluid conductor branch.

In some embodiments, for example, the central longitudinal axis of the reservoir fluid inlet port 602 is disposed in alignment, or substantial alignment, with the central longitudinal axis of the gas-depleted reservoir fluid outlet port 612. Such orientation may, amongst other things, allow for configuration of a flow diverter 600 having a narrower geometry such that, while disposed within a wellbore, relatively more space (for example, in the form of the intermediate fluid passage) is available within the wellbore, between the flow diverter 600 and the wellbore fluid conductor 114, such that downward velocity of the liquid phase component of the reservoir fluid is correspondingly reduced, thereby effecting an increase in separation efficiency of gaseous material from the reservoir fluid (see below).

In some embodiments, for example, the flow diverter 600 includes a first end 614; and the reservoir fluid outlet ports 604(*a*)-(*f*) and the gas-depleted reservoir fluid outlet port 612 are disposed at the first end 614. Each one of the reservoir fluid outlet ports 604(*a*)-(*f*) is disposed peripherally relative to the gas-depleted reservoir fluid outlet port 612A. In some embodiments, for example, the separator 600 includes a second end 616, and the gas-depleted reservoir fluid inlet ports 608 and the first separator inlet port 602A are disposed at the second end 616. Each one of the gas-depleted reservoir fluid inlet ports 608 is disposed peripherally relative to the reservoir fluid inlet port 602A. In some embodiments, for example, the first end 614 is disposed at an opposite end of the separator 600 relative to the second end 616. Such orientation may, amongst other things, allow for configuration of a flow diverter 600 having a narrower geometry such that, when disposed within a wellbore, relatively more space (for example, in the form of the intermediate fluid passage 112) is available within the wellbore, between the flow diverter 600 and the wellbore fluid conductor 114, such that downward velocity of the liquid phase component of the reservoir fluid is correspondingly reduced, thereby effecting an increase in separation efficiency of gaseous material from the reservoir fluid (see below).

In some embodiments, for example, the flow diverter 600 is configured such that at least one of the reservoir fluid outlet ports 604(*a*)-(*f*) (such as, for example, each one of the reservoir fluid outlet ports, independently) is radially tangential to the axial plane of the flow diverter 600 so as to effect a cyclonic flow condition in the reservoir fluid being discharged through one or more of the reservoir fluid outlet ports 604(*a*)-(*f*). The disposed radially tangential angle of the at least one outlet ports 604(*a*)-(*f*) is less than 15 degrees as measured axially along the flow diverter 600. In some embodiments, for example, the angle is at least five (5) degrees as measured axially along the flow diverter 600.

In some embodiments, for example, the reservoir fluid receiver 602, the reservoir fluid conductor 603, the reservoir fluid discharge communicator 604, the gas-depleted reservoir fluid receiver 608, the gas-depleted reservoir fluid conductor 610, and the gas-depleted reservoir fluid discharge communicator 612 are co-operatively configured such that reservoir fluid flow, that is received by the reservoir fluid receiver 602, is conducted to the reservoir fluid discharge communicator 604, via the reservoir fluid conductor 603, for discharging, via the reservoir fluid discharge communicator 604, into a wellbore 102, such that gaseous material is separated from the discharged reservoir fluid flow within the wellbore 102 in response to at least buoyancy forces, such that a gas-depleted reservoir fluid flow is obtained, received by the gas-depleted reservoir fluid receiver 608, and conducted to the gas-depleted reservoir fluid discharge communicator 612, via the gas-depleted reservoir fluid conductor 610, for supplying, via the gas-depleted reservoir fluid discharge communicator 612, to the pump 300.

The assembly 12 also includes a wellbore sealed interface effector 400 configured for interacting with a wellbore feature for defining a wellbore sealed interface 500 within the wellbore 102, between: (a) the uphole wellbore space 108 of the wellbore 102, and (b) the downhole wellbore space 110 of the wellbore 102, while the assembly 12 is disposed within the wellbore 102. The sealed interface 500 prevents, or substantially prevents reservoir fluid, that is being discharged from the reservoir fluid discharge communicator 604, from being conducted from the uphole wellbore space 108 to the downhole wellbore space 110, thereby preventing, or substantially preventing, bypassing of the gas-depleted reservoir fluid receiver 608 by the gas-depleted reservoir fluid that has been separated from the reservoir fluid within the uphole wellbore space 108. In this respect, the system 12 includes the sealed interface 500 that is defined by the interacting of the wellbore sealed interface effector 400 with a wellbore feature.

In this respect, in some embodiments, for example, the reservoir fluid receiver 602, the reservoir fluid conductor 603, the reservoir fluid discharge communicator 604, the gas-depleted reservoir fluid receiver 608, the gas-depleted reservoir fluid conductor 610, and the gas-depleted reservoir fluid discharge communicator 612 are co-operatively configured such that:

reservoir fluid flow, that is received by the reservoir fluid receiver 602, is conducted to the reservoir fluid discharge communicator 604, via the reservoir fluid conductor 603, for discharging, via the reservoir fluid discharge communicator 604, into a wellbore 102, such that gaseous material is separated from the discharged reservoir fluid within the wellbore 102 in response to at least buoyancy forces, such that a gas-depleted reservoir fluid flow is obtained, received by the gas-depleted reservoir fluid receiver 608, and conducted to the gas-depleted reservoir fluid discharge communicator 612, via the gas-depleted reservoir fluid conductor 610, for supplying, via the gas-depleted reservoir fluid discharge communicator 612, to the pump 300;

while: (i) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (ii) displacement of the reservoir fluid from the subterranean formation is being effected by the pump 300 such that the reservoir fluid flow is being received by the inlet 204 from the downhole wellbore space 110 and conducted to the reservoir fluid receiver 602.

The disposition of the sealed interface 500 is such that fluid flow, across the sealed interface 500, is prevented, or substantially prevented. In some embodiments, for example, the disposition of the sealed interface 500 is such that fluid flow, across the sealed interface 500, in a downhole direction, from the uphole wellbore space 108 to the downhole wellbore space 110, is prevented, or substantially prevented. In some embodiments, for example, the disposition of the sealed interface 500 is such that fluid, that is being conducted in a downhole direction within the intermediate fluid passage 112, is directed to the gas-depleted reservoir fluid receiver 608. In this respect, the gas-depleted reservoir fluid, produced after the separation of gaseous material from the received reservoir fluid within the uphole wellbore space 108, is directed to the gas-depleted reservoir fluid receiver 608, and conducted to the pump suction 302.

In some embodiments, for example, a polished portion receptacle 118 is disposed within the wellbore 102, and is landed within the bore of a packer that is sealingly engaged to the wellbore string 114 (such as, for example, a casing or a liner that is hung from the casing). The polished portion receptacle 118 is disposed in fluid communication with the reservoir for receiving the reservoir fluids. In such embodiments, for example, the disposition of the sealed interface 500 is effected by the combination of at least: (i) a sealed, or substantially sealed, disposition of the polished portion receptacle 118 relative to the wellbore string 114 (such as that effected by a packer 120 disposed between the polished portion receptacle 118 and the casing 114 or liner 114A), and (ii) a sealed, or substantially sealed, disposition of the downhole production string portion 206 relative to the polished portion receptacle 118 such that reservoir fluid flow, that is received by the polished portion receptacle 118, is prevented, or substantially prevented, from bypassing the reservoir fluid receiver 602, and, as a corollary, is directed to the reservoir fluid receiver 602 for receiving by the reservoir fluid receiver 602.

In some embodiments, for example, the sealed, or substantially sealed, disposition of the downhole production string portion 206 relative to the polished portion receptacle 118 is effected by an interference fit between the downhole production string portion 206 and the polished portion receptacle 118. In some of these embodiments, for example, the downhole production string portion 206 is landed or engaged or "stung" within the polished portion receptacle 118.

In some embodiments, for example, the sealed, or substantially sealed, disposition of the downhole production string portion 206 relative to the polished portion receptacle 118 is effected by one or more o-rings or seal-type Chevron rings. In this respect, the sealing interface effector 400 includes the o-rings, or includes the seal-type Chevron rings.

In some embodiments, for example, the downhole production string portion 206 is connected to the polished portion receptacle 118 by a latch seal assembly. A suitable latch seal assembly is a Weatherford™ Thread-Latch Anchor Seal Assembly™.

The above-described disposition of the wellbore sealed interface 500 provide for conditions which minimize solid debris accumulation in the joint between the flow diverter 600 and the polished portion receptacle or in the joint between the assembly 12 and the wellbore string 114. By providing for conditions which minimize solid debris accumulation within the joint, interference to movement of the separator relative to the wellbore string 114, which could be effected by accumulated solid debris, is mitigated.

In some embodiments, for example, the space, between: (a) the gas-depleted reservoir fluid receiver 608 of the flow diverter 600, and (b) the sealed interface 500, defines a sump 700 for collection of solid particulate that is entrained within fluid being discharged from the reservoir fluid discharge communicator 604 of the flow diverter 600, and the sump 700 has a volume of at least 0.1 $m^3$. In some embodiments, for example, the volume is at least 0.5 $m^3$. In some embodiments, for example, the volume is at least 1.0 $m^3$. In some embodiments, for example, the volume is at least 3.0 $m^3$.

By providing for the sump 700 having the above-described volumetric space characteristic, and/or the above-described minimum separation distance characteristic, a suitable space is provided for collecting relative large volumes of solid debris, such that interference by the accumulated solid debris with the production of oil through the system is mitigated. This increases the run-time of the system before any maintenance is required. As well, because the solid debris is deposited over a larger area, the propensity for the collected solid debris to interfere with movement of the flow diverter 600 within the wellbore 102, such as during maintenance (for example, a workover) is reduced.

Referring to FIG. 1, in some embodiments, for example, the sealed interface 500 is disposed within a section of the wellbore 102 whose axis 14A is disposed at an angle "a" of at least 60 degrees relative to the vertical "V". In some of these embodiments, for example, the sealed interface 500 is disposed within a section of the wellbore whose axis is disposed at an angle "a" of at least 85 degrees relative to the vertical "V". In this respect, disposing the sealed interface 500 within a wellbore section having such wellbore inclinations minimizes solid debris accumulation at the sealed interface 500.

In some embodiments, for example, the wellbore string 114 is a wellbore fluid conductor 114, and the flow diverter 600 and the wellbore fluid conductor 114 are co-operatively configured such that, while the assembly 12 is disposed within the wellbore 102 and oriented such that the production string inlet 204 is disposed downhole relative to the production string outlet 208 for receiving reservoir fluid flow from the downhole wellbore space 110, an intermediate fluid passage 112 is defined within the wellbore 102, between the flow diverter 600 and the wellbore fluid conductor 114 for effecting the fluid communication between the reservoir fluid discharge communicator 604 and the gas-depleted reservoir fluid receiver 608. In some embodiments, for example, the intermediate fluid passage 112 includes an annular space disposed between the flow diverter 600 and the wellbore fluid conductor 114. In some embodiments, for example, the intermediate fluid passage 112 defines a zone within which gaseous material is separated from the reservoir fluid in response to at least buoyancy forces such that the gas-depleted reservoir fluid obtained. In some embodiments, for example, the intermediate fluid passage 112 extends into a gaseous material conducting-passage 113, disposed between the production string 202 and the wellbore fluid conductor 114 and extending to the surface 106, for conducting the gaseous material, which has been separated from the reservoir fluid, to the surface 106.

The reservoir fluid produced from the subterranean formation 100, via the wellbore 102, including the gas-depleted reservoir fluid, the gaseous material, or both, may be discharged through the wellhead 116 to a collection facility, such as a storage tank within a battery.

In some embodiments, for example, the flow diverter 600 is orientable within the wellbore 102 such that the gas-depleted reservoir fluid receiver 608 is disposed below the reservoir fluid discharge communicator 604. In this respect, in some embodiments, for example, the reservoir fluid receiver 602, the reservoir fluid conductor 603, the reservoir fluid discharge communicator 604, the gas-depleted reservoir fluid receiver 608, the gas-depleted reservoir fluid conductor 610, and the gas-depleted reservoir fluid discharge communicator 612 are co-operatively configured such that reservoir fluid flow, that is received by the reservoir fluid receiver 602, is conducted to the reservoir fluid discharge communicator 604, via the reservoir fluid conductor 603, for discharging, via the reservoir fluid discharge communicator 604, into the uphole wellbore space 108 of the wellbore 102, such that gaseous material is separated from the discharged reservoir fluid flow within the uphole wellbore space of the wellbore 102 in response to at least buoyancy forces, such that a gas-depleted reservoir fluid flow is obtained, conducted downhole, received by the gas-depleted reservoir fluid receiver 608, and conducted to the gas-depleted reservoir fluid discharge communicator 612, via the gas-depleted reservoir fluid conductor 610, for supplying, via the gas-depleted reservoir fluid discharge communicator 612, to the pump 300.

In some embodiments, for example, the reservoir fluid receiver 602, the reservoir fluid conductor 603, the reservoir fluid discharge communicator 604, the gas-depleted reservoir fluid receiver 608, the gas-depleted reservoir fluid conductor 610, and the gas-depleted reservoir fluid discharge communicator 612 are co-operatively configured such that:

reservoir fluid flow, that is received by the reservoir fluid receiver 602, is conducted to the reservoir fluid discharge communicator 604, via the reservoir fluid conductor 603, for discharging, via the reservoir fluid discharge communicator 604, into the uphole wellbore space 108 of the wellbore 102, such that gaseous material is separated from the discharged reservoir fluid flow within the uphole wellbore space of the wellbore 102 in response to at least buoyancy forces, such that a gas-depleted reservoir fluid flow is obtained, conducted downhole, received by the gas-depleted reservoir fluid receiver 608, and conducted to the gas-depleted reservoir fluid discharge communicator 612, via the gas-depleted reservoir fluid conductor 610, for supplying, via the gas-depleted reservoir fluid discharge communicator 612, to the pump 300;

while: (i) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (ii) displacement of the reservoir fluid from the subterranean formation is effectible by the pump 300 such that the reservoir fluid flow is received by the inlet 204 from the downhole wellbore space 110 and conducted to the reservoir fluid receiver 602.

In some embodiments, for example, the flow diverter 600 further includes a shroud 620 co-operatively disposed relative to the gas-depleted reservoir fluid receiver 608 such that the shroud 620 projects below the gas-depleted reservoir fluid receiver 608 and interferes with conduction of the gas-depleted reservoir fluid from the intermediate fluid passage 112 to the gas-depleted reservoir fluid receiver 608 while: (a) the assembly 12 is disposed within the wellbore 102 and oriented such that the production string inlet 204 is disposed below the production string outlet 208 for receiving reservoir fluid flow from the downhole wellbore space 110, (b) the flow diverter 600 is oriented such that the gas-depleted reservoir fluid receiver 608 is disposed below the reservoir fluid discharge communicator 604, (c) the wellbore sealed interface 500 is defined by interaction between the wellbore sealed interface effector 400 and a wellbore feature, and (d) displacement of the reservoir fluid from the subterranean formation is being effected by the pump 300 such that the reservoir fluid is being received by the inlet 204 (such as, for example, as a reservoir fluid flow) from the downhole wellbore space 110 and conducted to the reservoir fluid discharge communicator 604. The shroud 620 provides increased residence time for separation of gaseous material within the intermediate fluid passage 112.

In some embodiments, for example. the shroud 620 projects below the gas-depleted reservoir fluid receiver 608 by a sufficient distance such that the minimum distance, through the intermediate fluid passage 112, from the reservoir fluid outlet port to below the shroud, is at least 1.8 metres.

In some embodiments, for example, the shroud 620 is co-operatively disposed relative to the gas-depleted reservoir fluid receiver 608 such that, while: (a) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, (b) the flow diverter 600 is oriented such that the gas-depleted reservoir fluid receiver 608 is disposed below the reservoir fluid discharge communicator 604, (c) the wellbore sealed interface 500 is defined by interaction between the wellbore sealed interface effector 400 and a wellbore feature, and (d) displacement of the reservoir fluid from the subterranean formation is being effected by the pump 300 such that the reservoir fluid is being received by the inlet 204 (such as, for example, as a reservoir fluid flow) from the downhole wellbore space 110 and conducted to the reservoir fluid discharge communicator 604, the gas-depleted reservoir fluid being conducted downhole to the gas-depleted reservoir fluid receiver 608 is directed below the gas-depleted reservoir fluid receiver 608 by the shroud 620.

In some embodiments, for example, the distance by which the shroud 620 projects below the gas-depleted reservoir fluid receiver 608 is selected based on at least: (i) optimization of separation efficiency of gaseous material from reservoir fluid (including density-reduced reservoir fluid), prior to receiving of the reservoir fluid by the gas-depleted reservoir fluid inlet ports, and (ii) optimization of separation efficiency of solid material from reservoir fluid (including density-reduced reservoir fluid), prior to receiving of reservoir fluid by the gas-depleted reservoir fluid inlet ports. In some embodiments, for example, in order to effect the desired separation of solids from the reservoir fluid, so as to mitigate interference of pump operation by solids entrained within reservoir fluid, the upward velocity of the reservoir fluid is less than the solids setting velocity.

In some embodiments, for example, the downhole production string portion 206 includes a velocity string 207, and, in some embodiments, for example, the entirety, or the substantial entirety of the downhole production string portion 206 is a velocity string 207. In some embodiments, for example, the velocity string 207 extends from the production string inlet 204. In some embodiments, for example, at least 50%, such as, for example, at least 80%, such as, for example, at least 90%, of the downhole production string portion 206 is a velocity string 207. In some embodiments, for example, the entirety, or the substantial entirety, of the downhole production string portion 206 is a velocity string 207. In some embodiments, for example, the length of the velocity string 207, measured along the central longitudinal axis of the velocity string, is at least. 100 metres, such as, for example, at least 200 m, such as, for example, at least 250 m. In some embodiments, for example, the velocity string 207 includes a fluid passage 207A, and the cross-sectional area of the entirety of the fluid passage 207A is less than the cross-sectional area of the entirety of the fluid passage 210A of the uphole portion 210. In this respect, in some embodiments, for example, the maximum cross-sectional area of the fluid passage 207A is less than the minimum cross-sectional area of the fluid passage 210A. In some embodiments, for example, the maximum cross-sectional area of the fluid passage 207A is less than about 75%, such as for example, less than 50%, such as, for example, less than 25%, of the cross-sectional area of the fluid passage 210A. In some embodiments, for example, the cross-sectional area of the fluid passage 207A is less than five (5) square inches, such as, for example, less than 3.1 square inches, such as, for example, less than 1.3 square inches, such as, for example, less than 1.0 square inches. In some embodiments, for example, the cross-sectional area of the fluid passage 207A is as small as 0.2 square inches.

In some embodiments, for example, the flow diverter 600 is disposed uphole of the horizontal section 102C of the wellbore 102, such as, in some embodiments, for example, within the vertical section 102A, or, in some embodiments, for example, within the transition section 102B. In some of these embodiments, for example, the downhole production string portion 206A extends from the flow diverter 600, in a downhole direction, into the horizontal section 102C, such that the inlet 204 is disposed within the horizontal section 102C.

Figure 4:
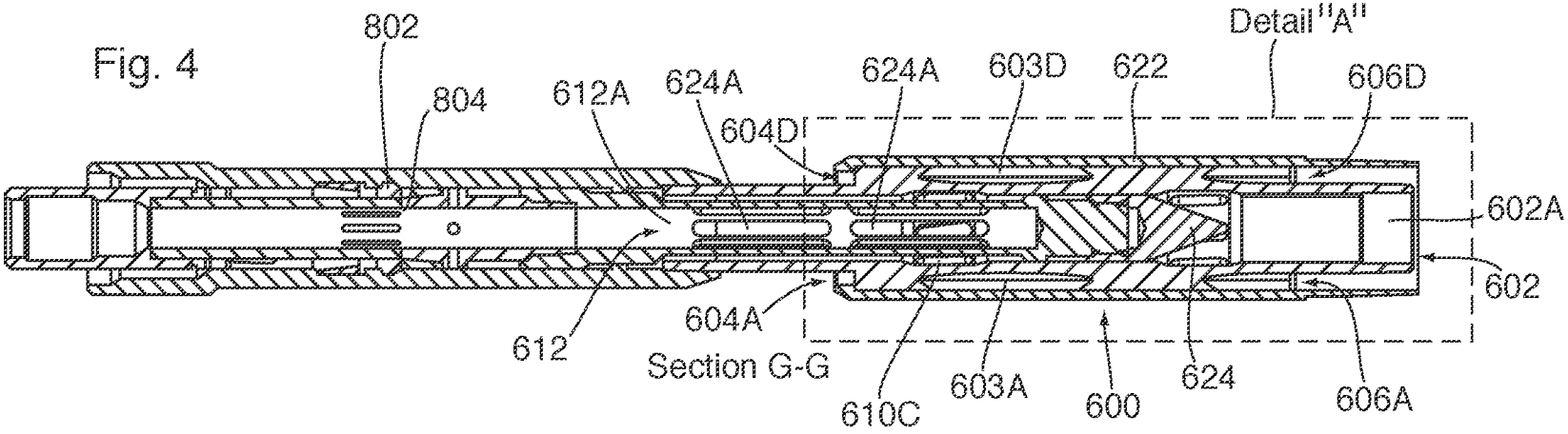
FIG. 4 is a sectional elevation view of the flow diverter in FIG. 3 taken along lines G-G, showing the flow diverter established by the disposition of a flow diverter-effecting insert within the passageway of the insert-receiving part, and with the flow diverter-effecting insert releasably coupled by a lock mandrel to the insert-receiving part.
Figure 5:
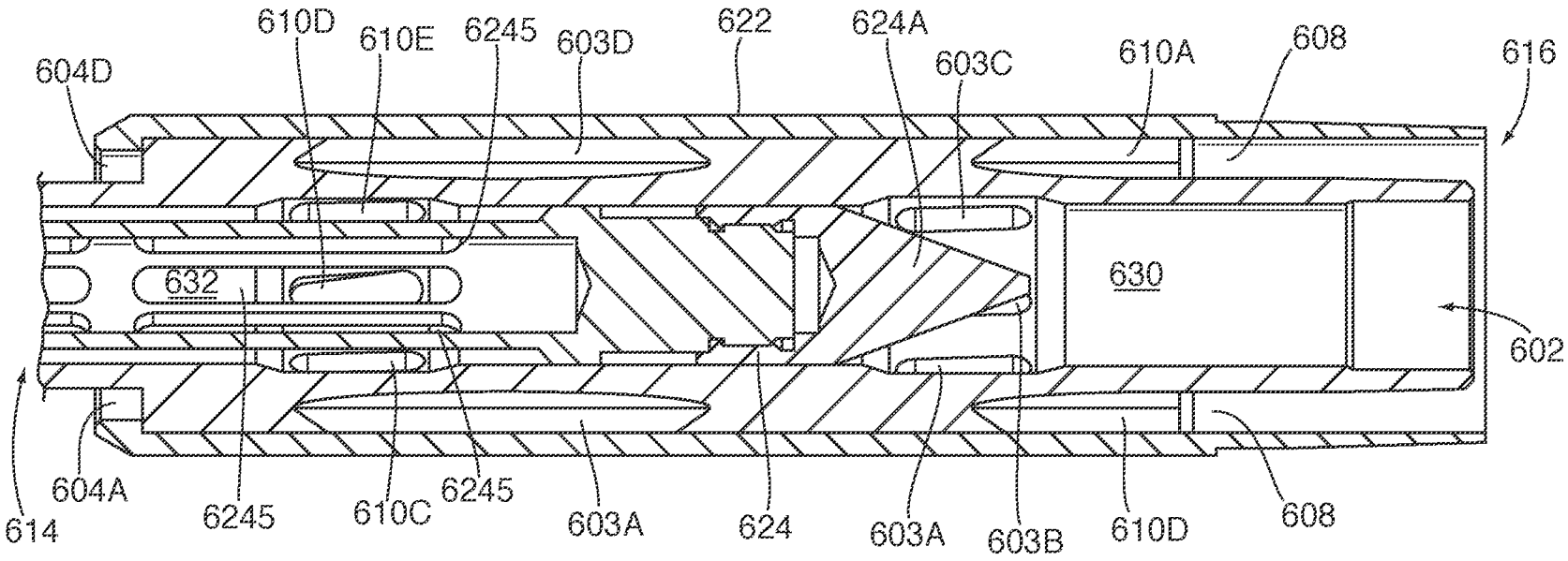
FIG. 5 is an enlarged view of Detail "A" in FIG. 4.
Figure 6A:
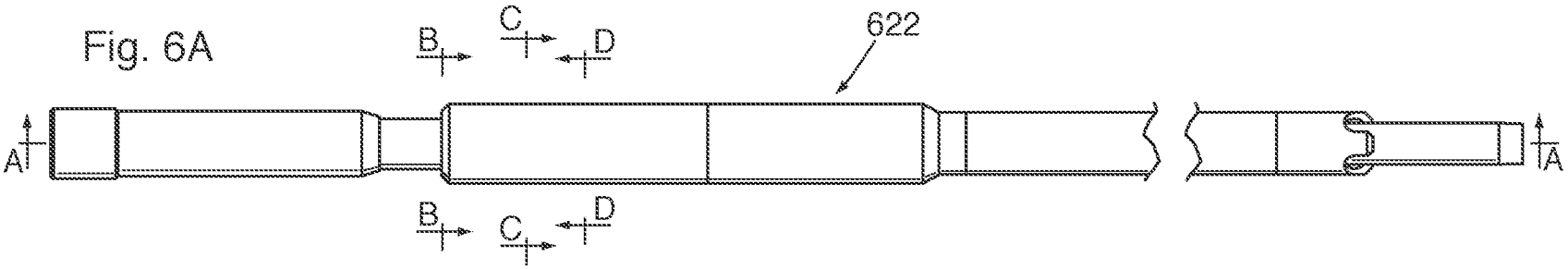
FIG. 6A is a side elevation view of the insert-receiving part of a flow diverter.
Figure 6B:
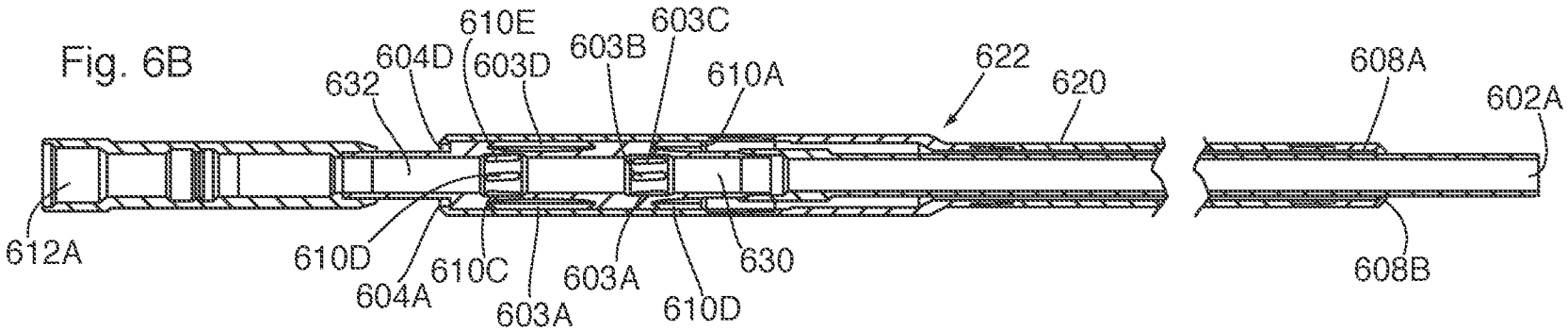
FIG. 6B is a sectional elevation view of the insert-receiving part illustrated in FIG. 6A, taken along lines A-A.
Figure 6E:
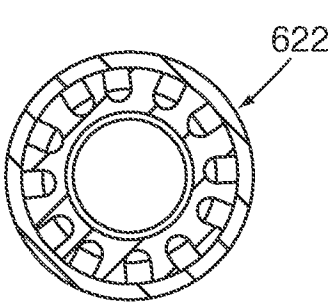
FIG. 6E is an axial view taken along lines D-D in FIG. 6A.
Figure 6D:
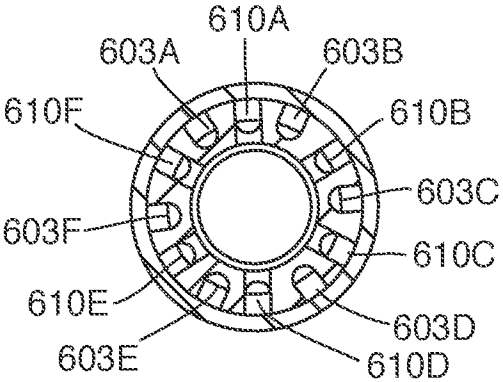
FIG. 6D is an axial view taken along lines C-C in FIG. 6A.
Figure 6C:
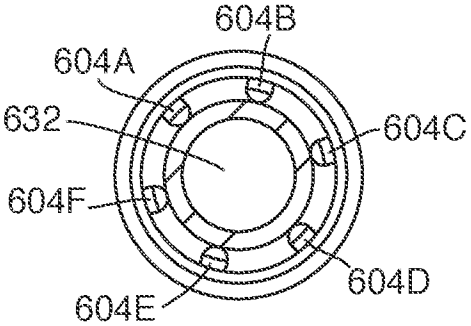
FIG. 6C is an axial view taken along lines B-B in FIG. 6A.

Referring to FIGS. 4 and 5, in some embodiments, for example, the flow diverter 600 is assembled from a kit of parts. In some embodiments, for example, the kit includes instructions for the assembly.

The kit includes an insert-receiving part 622 (see FIGS. 6, 6A, 6B, and 6C). The insert-receiving part 622 includes a reservoir fluid receiver 602, a gas-depleted reservoir fluid discharge communicator 612, and a passageway 626 extending from the reservoir fluid receiver 602 to the gas-depleted reservoir fluid receiver 612. The insert-receiving part 622 is configured for integration into the production string 202, such as, for example, by threaded coupling, such that the assembly 12 includes the insert-receiving part 622.

The kit also includes a flow diverter-effecting insert 624 (see FIGS. 7 and 8) configured for insertion within the passageway 626. The flow diverter-effecting insert 624 is co-operatively configured with the insert-receiving part 622 such that the flow diverter 600 is defined while the flow diverter-effecting insert 624 is disposed within the passageway 626. The flow diverter-effecting insert 624 is disposed in a flow diverter-defining position when the flow diverter-effecting insert 624, while disposed within the passageway 626 of the insert-receiving part 622, is disposed such that the flow diverter 600 is defined and functions as above-described.

The insert-receiving part 622 further defines both of the reservoir fluid discharge communicator 604 and the gas-depleted reservoir receiver 608. The reservoir fluid discharge communicator 604 is disposed in fluid communication with the passageway 626, and the gas-depleted reservoir receiver 608 is also disposed in fluid communication with the passageway 626.

In some embodiments, for example, the insert-receiving part 622 and the flow diverter-effecting insert 624 are co-operatively configured such that reservoir fluid flow, that is received by the reservoir fluid receiver 602, is conducted to the reservoir fluid discharge communicator 604 for discharging, via the reservoir fluid discharge communicator 604, into the wellbore 102, such that gaseous material is separated from the discharged reservoir fluid flow within the wellbore 102 in response to at least buoyancy forces, such that a gas-depleted reservoir fluid flow is obtained, received by the gas-depleted reservoir fluid receiver 608, and conducted to the gas-depleted reservoir fluid discharge communicator 612, for supplying, via the gas-depleted reservoir fluid discharge communicator 612, to the pump 300;

while the flow diverter-effecting insert 624 is disposed within the passageway 626 of the insert-receiving part 622, and, optionally, in some embodiments, for example, while the gas-depleted reservoir fluid receiver 608 is disposed below the reservoir fluid discharge communicator 604 (in which case, the receiving of the obtained gas-depleted reservoir fluid flow by the gas-depleted reservoir fluid receiver 608 is effected by conduction of the obtained gas-depleted reservoir fluid flow to the gas-depleted reservoir fluid receiver 608 in a downhole direction).

In some embodiments, for example, the insert-receiving part 622 and the flow diverter-effecting insert 624 are co-operatively configured such that reservoir fluid flow, that is received by the reservoir fluid receiver 602, is conducted to the reservoir fluid discharge communicator 604 for discharging, via the reservoir fluid discharge communicator 604, into the uphole wellbore space 108 of the wellbore 102, such that gaseous material is separated from the discharged reservoir fluid flow within the uphole wellbore space 108 of the wellbore 102 in response to at least buoyancy forces, such that a gas-depleted reservoir fluid flow is obtained, received by the gas-depleted reservoir fluid receiver 608, and conducted to the gas-depleted reservoir fluid discharge communicator 612, for supplying, via the gas-depleted reservoir fluid discharge communicator 612, to the pump 300;

while: (i) the flow diverter-effecting insert 624 is disposed within the passageway 626 of the insert-receiving part 622 and, optionally, in some embodiments, for example, while the gas-depleted reservoir fluid receiver 608 is disposed below the reservoir fluid discharge communicator 604 (in which case, the receiving of the obtained gas-depleted reservoir fluid flow by the gas-depleted reservoir fluid receiver 608 is effected by conduction of the obtained gas-depleted reservoir fluid flow to the gas-depleted reservoir fluid receiver 608 in a downhole direction); (ii) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (iii) displacement of the reservoir fluid from the subterranean formation is effectible by the pump 300 such that the reservoir fluid flow is received by the inlet 204 from the downhole wellbore space 110 and conducted to the reservoir fluid receiver 602.

In some embodiments, for example, the insert-receiving part 622 and the flow diverter-effecting insert 624 are further co-operatively configured such that:

bypassing of the reservoir fluid discharge communicator 604, by the reservoir fluid flow being received by the reservoir fluid receiver 602, is at least impeded (such as, for example, prevented or substantially prevented) by the flow diverter-effecting insert 624 that is disposed within the passageway 626, such that the received reservoir fluid flow is conducted to the reservoir fluid discharge communicator 604 and discharged into the wellbore 102 such that gaseous material is separated from the discharged reservoir fluid flow within the wellbore 102 in response to at least buoyancy forces, such that a gas-depleted reservoir fluid flow is obtained and conducted to the gas-depleted reservoir fluid receiver 608 such that a gas-depleted reservoir fluid flow is received by the gas-depleted reservoir fluid receiver 608; and bypassing of the gas-depleted reservoir fluid discharge communicator 612, by the gas-depleted reservoir fluid flow being received by the gas-depleted reservoir fluid receiver 608, is at least impeded (such as, for example, prevented or substantially prevented) by the flow diverter-effecting insert 624 that is disposed within the passageway 626, such that gas-depleted reservoir fluid flow is conducted to the gas-depleted reservoir fluid discharge communicator 612 for discharging of the gas-depleted reservoir fluid flow via the gas-depleted reservoir fluid communicator 612;

while the flow diverter-effecting insert 624 is disposed within the passageway 626 of the insert-receiving part 622, and, optionally, in some embodiments, for example, while the gas-depleted reservoir fluid receiver 608 is disposed below the reservoir fluid discharge communicator 604 (in which case, the receiving of the obtained gas-depleted reservoir fluid flow by the gas-depleted reservoir fluid receiver 608 is effected by conduction of the obtained gas-depleted reservoir fluid flow to the gas-depleted reservoir fluid receiver 608 in a downhole direction).

In some embodiments, for example, the insert-receiving part 622 and the flow diverter-effecting insert 624 are further co-operatively configured such that:

bypassing of the reservoir fluid discharge communicator 604, by the reservoir fluid flow being received by the reservoir fluid receiver 602, is at least impeded (such as, for example, prevented or substantially prevented) by the flow diverter-effecting insert 624 that is disposed within the passageway 626, such that the received reservoir fluid flow is conducted to the reservoir fluid discharge communicator 604 and discharged into the uphole wellbore space 108 of the wellbore 102 such that gaseous material is separated from the discharged reservoir fluid flow within the uphole wellbore space 108 in response to at least buoyancy forces, such that a gas-depleted reservoir fluid flow is obtained and conducted to the gas-depleted reservoir fluid receiver 608 such that a gas-depleted reservoir fluid flow is received by the gas-depleted reservoir fluid receiver 608; and bypassing of the gas-depleted reservoir fluid discharge communicator 612, by the gas-depleted reservoir fluid flow being received by the gas-depleted reservoir fluid receiver 608, is at least impeded (such as, for example, prevented or substantially prevented) by the flow diverter-effecting insert 624 that is disposed within the passageway 626, such that gas-depleted reservoir fluid flow is conducted to the gas-depleted reservoir fluid discharge communicator 612 for discharging of the gas-depleted reservoir fluid flow via the gas-depleted reservoir fluid communicator 612;

while: (i) the flow diverter-effecting insert 624 is disposed within the passageway 626 of the insert-receiving part 622 and, optionally, in some embodiments, for example, while the gas-depleted reservoir fluid receiver 608 is disposed below the reservoir fluid discharge communicator 604 (in which case, the receiving of the obtained gas-depleted reservoir fluid flow by the gas-depleted reservoir fluid receiver 608 is effected by conduction of the obtained gas-depleted reservoir fluid flow to the gas-depleted reservoir fluid receiver 608 in a downhole direction); (ii) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (iii) displacement of the reservoir fluid from the subterranean formation is effectible by the pump 300 such that the reservoir fluid flow is received by the inlet 204 from the downhole wellbore space 110 and conducted to the reservoir fluid receiver 602.

In some of these embodiments, for example, the flow diverter-effecting insert 624 is further configured for disposition relative to the passageway 626 such that a passageway sealed interface 628 is established. In this respect, the insert-receiving part 622 and the flow diverter-effecting insert 624 are further co-operatively configured such that:

a passageway sealed interface 628 is established while the flow diverter-effecting insert 624 is disposed within the passageway 626 of the insert-receiving part 622 (and, optionally, in some embodiments, for example, while the gas-depleted reservoir fluid receiver 608 is disposed below the reservoir fluid discharge communicator 604, in which case, the receiving of the obtained gas-depleted reservoir fluid flow by the gas-depleted reservoir fluid receiver 608 is effected by conduction of the obtained gas-depleted reservoir fluid flow to the gas-depleted reservoir fluid receiver 608 in a downhole direction), with effect that:

fluid communication between the passageway 626 and the reservoir fluid discharge communicator 604 is established via a passageway portion 630 that is disposed downhole relative to the passageway sealed interface 628, such that fluid communication is established between the reservoir fluid receiver 602 and the reservoir fluid discharge communicator 604;

bypassing of the reservoir fluid discharge communicator 604, by reservoir fluid flow, that is received by the reservoir fluid receiver 602, is prevented, or substantially prevented, by the passageway sealed interface 628, such that the received reservoir fluid flow is conducted, via the passageway portion 630 disposed downhole relative to the passageway sealed interface 628, to the reservoir fluid discharge communicator 604, such that the received reservoir fluid flow is discharged into the wellbore 102 and gaseous material is separated from the discharged reservoir fluid flow within the wellbore 102 in response to at least buoyancy forces, such that a gas-depleted reservoir fluid flow is obtained and conducted to the gas-depleted reservoir fluid receiver 608 such that the gas-depleted reservoir fluid flow is received by the gas-depleted reservoir fluid receiver 608;

the fluid communication between the passageway 626 and the gas-depleted reservoir fluid receiver 608 is established via a passageway portion 632 that is disposed uphole relative to the passageway sealed interface 628, such that fluid communication is established between the gas-depleted reservoir fluid receiver 608 and the gas-depleted reservoir fluid discharge communicator 612;

and bypassing of the gas-depleted reservoir fluid discharge communicator 612, by the gas-depleted reservoir fluid flow, that is received by the gas-depleted reservoir fluid receiver 608, is prevented, or substantially prevented, by the passageway sealed interface 628, such that the received gas-depleted reservoir fluid flow is conducted, via the passageway portion 632 disposed uphole relative to the passageway sealed interface 628, from the gas-depleted reservoir fluid receiver 608 to the gas-depleted reservoir fluid discharge communicator 612 such that the gas-depleted reservoir fluid flow is discharged from the gas-depleted reservoir fluid discharge communicator 612.

In some embodiments, for example, the flow diverter-effecting insert 624 is further configured for disposition relative to the passageway 626 such that a passageway sealed interface 628 is established. In this respect, the insert-receiving part 622 and the flow diverter-effecting insert 624 are further co-operatively configured such that:

a passageway sealed interface 628 is established while the flow diverter-effecting insert 624 is disposed within the passageway 626 of the insert-receiving part 622 (and, optionally, in some embodiments, for example, while the gas-depleted reservoir fluid receiver 608 is disposed below the reservoir fluid discharge communicator 604, in which case, the receiving of the obtained gas-depleted reservoir fluid flow by the gas-depleted reservoir fluid receiver 608 is effected by conduction of the obtained gas-depleted reservoir fluid flow to the gas-depleted reservoir fluid receiver 608 in a downhole direction), with effect that:

fluid communication between the passageway 626 and the reservoir fluid discharge communicator 604 is established via a passageway portion 630 that is disposed downhole relative to the passageway sealed interface 628, such that fluid communication is established between the reservoir fluid receiver 602 and the reservoir fluid discharge communicator 604;

bypassing of the reservoir fluid discharge communicator 604, by reservoir fluid flow, that is received by the reservoir fluid receiver 602, is prevented, or substantially prevented, by the passageway sealed interface 628, such that the received reservoir fluid flow is conducted, via the passageway portion 630 disposed downhole relative to the passageway sealed interface 628, to the reservoir fluid discharge communicator 604, such that the received reservoir fluid flow is discharged into the uphole wellbore space 108 of the wellbore 102 and gaseous material is separated from the discharged reservoir fluid flow within the uphole wellbore space 108 of the wellbore 102 in response to at least buoyancy forces, such that a gas-depleted reservoir fluid flow is obtained and conducted to the gas-depleted reservoir fluid receiver 608 such that the gas-depleted reservoir fluid flow is received by the gas-depleted reservoir fluid receiver 608;

the fluid communication between the passageway 626 and the gas-depleted reservoir fluid receiver 608 is established via a passageway portion 632 that is disposed uphole relative to the passageway sealed interface 628, such that fluid communication is established between the gas-depleted reservoir fluid receiver 608 and the gas-depleted reservoir fluid discharge communicator 612;

and bypassing of the gas-depleted reservoir fluid discharge communicator 612, by the gas-depleted reservoir fluid flow, that is received by the gas-depleted reservoir fluid receiver 608, is prevented, or substantially prevented, by the passageway sealed interface 628, such that the received gas-depleted reservoir fluid flow is conducted, via the passageway portion 632 disposed uphole relative to the passageway sealed interface 628, from the gas-depleted reservoir fluid receiver 608 to the gas-depleted reservoir fluid discharge communicator 612 such that the gas-depleted reservoir fluid flow is discharged via the gas-depleted reservoir fluid discharge communicator 612;

while: (i) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (iii) displacement of the reservoir fluid from the subterranean formation is effectible by the pump 300 such that the reservoir fluid flow is received by the inlet 204 from the downhole wellbore space 110 and conducted to the reservoir fluid receiver 602.

In some embodiments, for example, the passageway sealed interface 628 is effected by sealing engagement, or substantially sealing engagement, of the flow diverter-effecting insert 624 with the insert-receiving part 622. In some embodiments, for example, the sealing engagement, or substantially sealing engagement, of the flow diverter-effecting insert 624 with the passageway 626 is effected by a sealing member 628A that is coupled to the flow diverter-effecting insert 624. In some embodiments, a sealing member 629 is also coupled to the flow diverter effecting insert 624 for protecting the sealing area (defined between sealing members 628A and 629) from erosion and corrosion.

Figure 7:
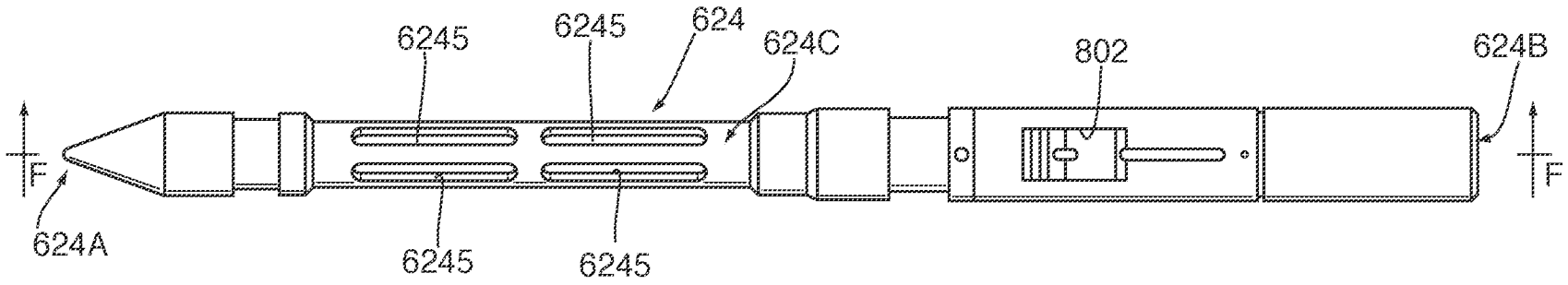
FIG. 7 is an elevation view of one side of the flow diverter-effecting insert.
Figure 8:
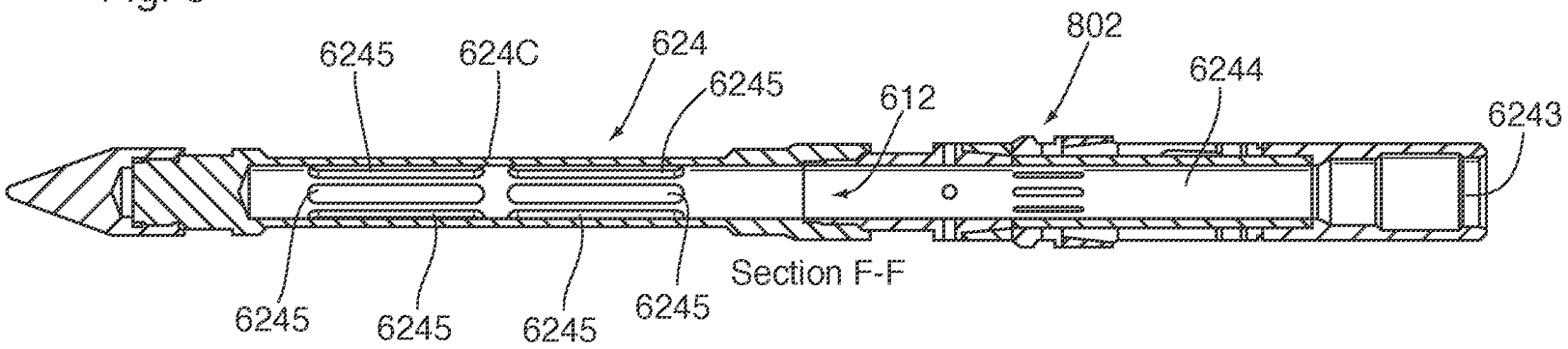
FIG. 8 is a sectional elevation view of the flow diverter-effecting insert, taken along lines F-F in FIG. 7.
Figure 9:
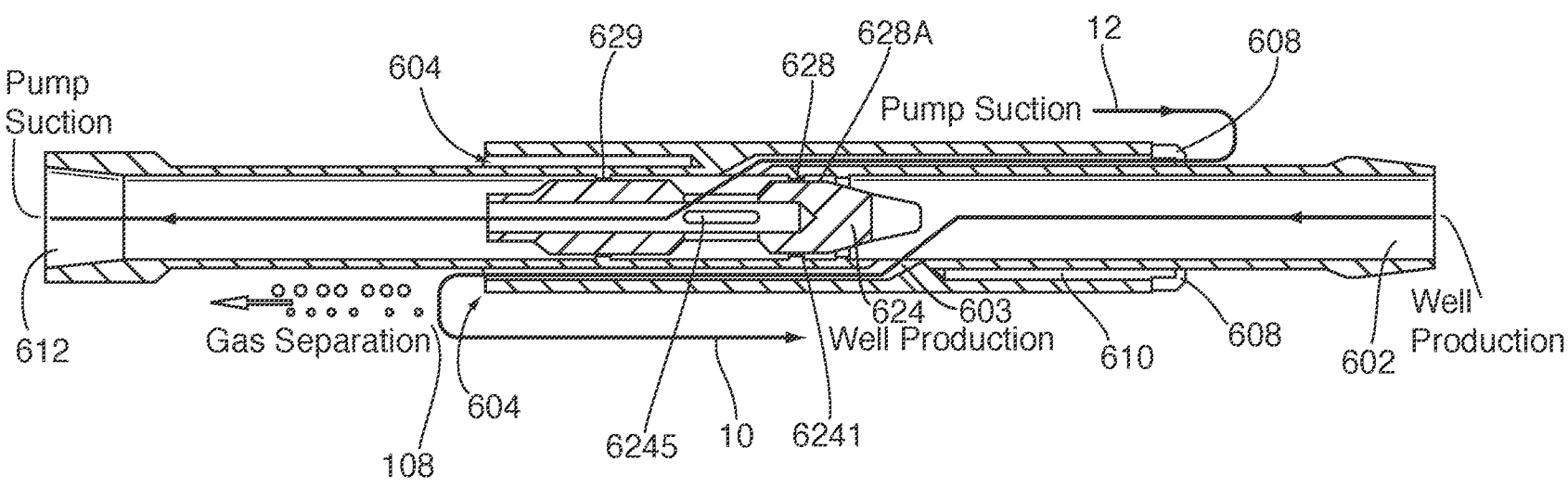
FIG. 9 is a schematic illustration of the flowpaths within the flow diverter illustrated in FIGS. 4 and 5.

Referring to FIGS. 7, 8 and 9, in some embodiments, for example, the flow diverter-effecting insert 624 is elongated and includes a first end 624A and a second end 624B. The sealing member 628A extends about an external surface 624C of the flow diverter-effecting insert 624. The first end 624A is shaped (such as, for example, cone-shaped) to urge the flow of reservoir fluid, received by the reservoir fluid receiver 602, towards the reservoir fluid conductor branches 603. The ports 6245 (such as, for example, in the form of slots formed through the external surface 624C of the part 624) are relatively closer to the first end 624A, and the port 6243 is disposed at the second end 624B. A fluid passage 6244 extends along, or substantially along, the central longitudinal axis of the part 624, from the ports 6245 to the port 6243 for conducting fluid received by the ports 6245 to the port 6243. The flow diverter-effecting insert 624 and the insert-receiving part 622 are further co-operatively configured such that:

the ports 6245 are disposed for receiving the gas-depleted reservoir fluid flow from corresponding gas-depleted reservoir fluid conductor branches 610(*a*)-(*f*) that extend from the gas-depleted reservoir fluid receiver 608;

the gas-depleted reservoir fluid flow, that is received by the ports 6245, is conducted, via the fluid passage 6244 to the port 6243, for discharging, via the port 6243, into the passageway portion 632 disposed uphole relative to the passageway sealed interface 628, for discharging via the gas-depleted reservoir fluid discharge communicator 612;

the sealing member 628A:

(i) prevents, or substantially prevents, bypassing of the ports 6245 by the gas-depleted reservoir fluid flow being conducted by the gas-depleted reservoir fluid conductor branches 610(*a*)-(*f*); and (ii) prevents, or substantially prevents, bypassing of the reservoir fluid conductor branches 603(*a*)-(*f*) by reservoir fluid flow that is received by the reservoir fluid receiver 602, such that the received reservoir fluid flow is conducted, via: (a) the passageway portion 630 disposed downhole relative to the passageway sealed interface 628, and (b) the branches 603(*a*)-(*f*), to the reservoir fluid discharge communicator 604, while the flow diverter-effecting insert 624 is disposed within the passageway 626 of the insert-receiving part 622, such as while the flow diverter-effecting insert 624 is disposed in the flow diverter-defining position.

In some embodiments, for example, and referring to FIG. 9, the reservoir fluid flow, from the downhole wellbore space 610, is received by the reservoir fluid receiver 602 (in this embodiment, the inlet port 602A), and conducted through the downhole passageway portion 630 to the reservoir fluid discharge communicator 604 (in the form of reservoir fluid outlet ports 604(*a*)-(*f*), and the conduction from the downhole passageway portion 630 to the ports 604(*a*)-(*f*) is effected via a plurality of reservoir fluid conductor branches 603(*a*)-(*f*) extending between the downhole passageway portion 630 and the ports 604(*a*)-(*f*)), as is represented by flowpath 10. The passageway sealed interface 628 prevents, or substantially prevents, the received reservoir fluid flow within the passageway portion 630 from bypassing the reservoir fluid discharge communicator 604 such that a reservoir fluid flow is discharged through the reservoir fluid discharge communicator 604. Upon discharging from the reservoir fluid discharge communicator 604, the reservoir fluid flow becomes disposed within the uphole wellbore space 108 and, while the discharged reservoir fluid is disposed within the uphole wellbore space 108, gaseous material is separated from the discharged reservoir fluid, in response to at least buoyancy forces, such that a gas-depleted reservoir fluid flow is obtained. Because the wellbore sealed interface 500 is preventing, or substantially preventing, the bypassing of the gas-depleted reservoir fluid receiver 608 by the obtained gas-depleted reservoir fluid flow, the obtained gas-depleted reservoir fluid flow is conducted to the gas-depleted reservoir fluid receiver 608. The gas-depleted reservoir fluid flow, received by the gas-depleted reservoir fluid receiver 608 (in the form of inlet ports 608(*a*)-(*f*)), is conducted to the uphole passageway portion 632, via: (i) a plurality of gas-depleted reservoir fluid conductor branches 610(*a*)-(*f*) extending between the gas-depleted reservoir fluid receiver 608 and the uphole passageway portion 632), (ii) the ports 6245, (iii) the fluid passage 6244 of the flow diverter-effecting insert 624, and (iv) the port 6243, as is represented by flowpath 12. The passageway sealed interface 628 prevents, or substantially prevents, the gas-depleted reservoir fluid flow from bypassing the ports 6245 such that the gas-depleted reservoir fluid flow is discharged through the gas-depleted reservoir fluid discharge communicator 612.

In some embodiments, for example, the flow diverter-effecting insert 624 is disposed for becoming releasably coupled to the insert-receiving part 622 via a coupler 804 incorporated in the production string 202. The releasable coupling is such that the flow diverter-effecting insert 624 is retained relative to the insert-receiving part 622 while the flow diverter-effecting insert is disposed within the passageway in the flow diverter-defining position. In some embodiments, for example, the releasable coupling is effected with a lock mandrel 802 that has been integrated within the production string 202. In this respect, while disposed in the flow diverter-defining position, the flow diverter-effecting insert 624 is releasably coupled to the insert-receiving part 622 via a lock mandrel 802 that has been integrated within the production string 202 uphole of the insert-receiving part 622, such that while the flow diverter-effecting insert is disposed in the flow diverter-defining position, the flow diverter-effecting insert 624 is retained relative to the insert-receiving part 622. In some embodiments, for example, the flow diverter-effecting insert 624 is run downhole with the lock mandrel 802 with a running tool and set within the production string 202 by coupling the lock mandrel 802 to a corresponding nipple 804 within the production string 202. Exemplary lock mandrels 802 include the Otis XN™ lock mandrel that is available from Halliburton Company. The corresponding nipple for the Otis XN™ lock mandrel is the Otis XN™ nipple.

In some embodiments, for example, while disposed within the passageway 626 in the flow diverter-defining position (such that the flow diverter 600 is defined), the flow diverter-effecting insert 624 is displaceable, relative to the insert-receiving part 622 (such as, for example, in an uphole direction through the production string 202 such that the flow diverter-effecting insert 624 is removed from the production string 202) such that occlusion of the passageway of the insert-receiving part, by the flow diverter-effecting insert 624, is at least partially removed (such as, for example, fully removed), and such that the insert-receiving part 622 becomes disposed in a non-occluded condition.

In those embodiments where the flow diverter-effecting insert 624 is disposed for becoming releasably coupled to the insert-receiving part 622 such that the flow diverter-effecting insert 624 is retained, relative to the insert-receiving part 622, while the flow diverter-effecting insert 624 is disposed within the passageway 626 (such as, for example in the flow diverter-defining position), the displacement of the flow diverter-effecting insert 624 is effectible while the flow diverter-effecting insert is uncoupled relative to the insert-receiving part 622. In this respect, while the flow diverter-effecting insert 624 is disposed in the flow diverter-defining position and is releasably coupled to the insert-receiving part 622 such that the flow diverter-effecting insert 624 is retained in the flow diverter-defining position, upon uncoupling of the flow diverter-effecting insert 624 from the insert-receiving part 622, the flow diverter-effecting insert 624 becomes displaceable, relative to the insert-receiving part 622 (such as, for example, in an uphole direction through the production string 202 such that the flow diverter-effecting insert 624 is removed from the production string) such that occlusion of the passageway 626 of the insert-receiving part, by the flow diverter-effecting insert 624, is defeated, or at least partially defeated (such as, for example, removed or at least partially removed), and such that the insert-receiving part 622 becomes disposed in a non-occluded condition.

By effecting the at least partial removal of the occlusion, wellbore materials, such as tools, may be conducted into or through the passageway 626 of the insert-receiving part 622. In some of these embodiments, by enabling conduction of the wellbore material through the passageway, wellbore operations may be facilitated, such as removing the collected solid debris, clearing out the horizontal portion of the casing string, or re-stimulation.

In this respect, there is also provided a process for producing reservoir fluids from a reservoir disposed within a subterranean formation, and the process includes:

via the production string 202 disposed within the wellbore 102, producing gas-depleted reservoir fluid from the reservoir, wherein the producing includes:

separating gaseous material from reservoir fluid in response to at least buoyancy forces such that the gas-depleted reservoir fluid is obtained via the flow diverter 600 (defined at least by the combination of the insert-receiving part 622 and the flow diverter-effecting insert 624, as above-described); and pressurizing the gas-depleted reservoir fluid with the pump 300, disposed within the production string 202, such that the gas-depleted reservoir fluid is conducted to the surface 106;

and displacing the flow diverter-effecting insert 624, relative to the insert-receiving part 622, such that occlusion of the passageway 626 of the insert-receiving part 622, by the flow diverter-effecting insert 624, is at least partially removed, and such that the insert-receiving part 622 becomes disposed in a non-occluded condition.

In some embodiments, for example, the displacing of the flow diverter-effecting insert 624 is effected via slickline.

In some embodiments, for example, suspending of the producing is effected prior to the displacing of the flow diverter-effecting insert 624.

In some embodiments, for example, and as described above, the flow diverter-effecting insert 624 is releasably coupled to the insert-receiving part 622, and prior to the displacing of the flow diverter-effecting insert, the process further includes uncoupling the flow diverter-effecting insert relative to the insert-receiving part 622.

Figure 11:
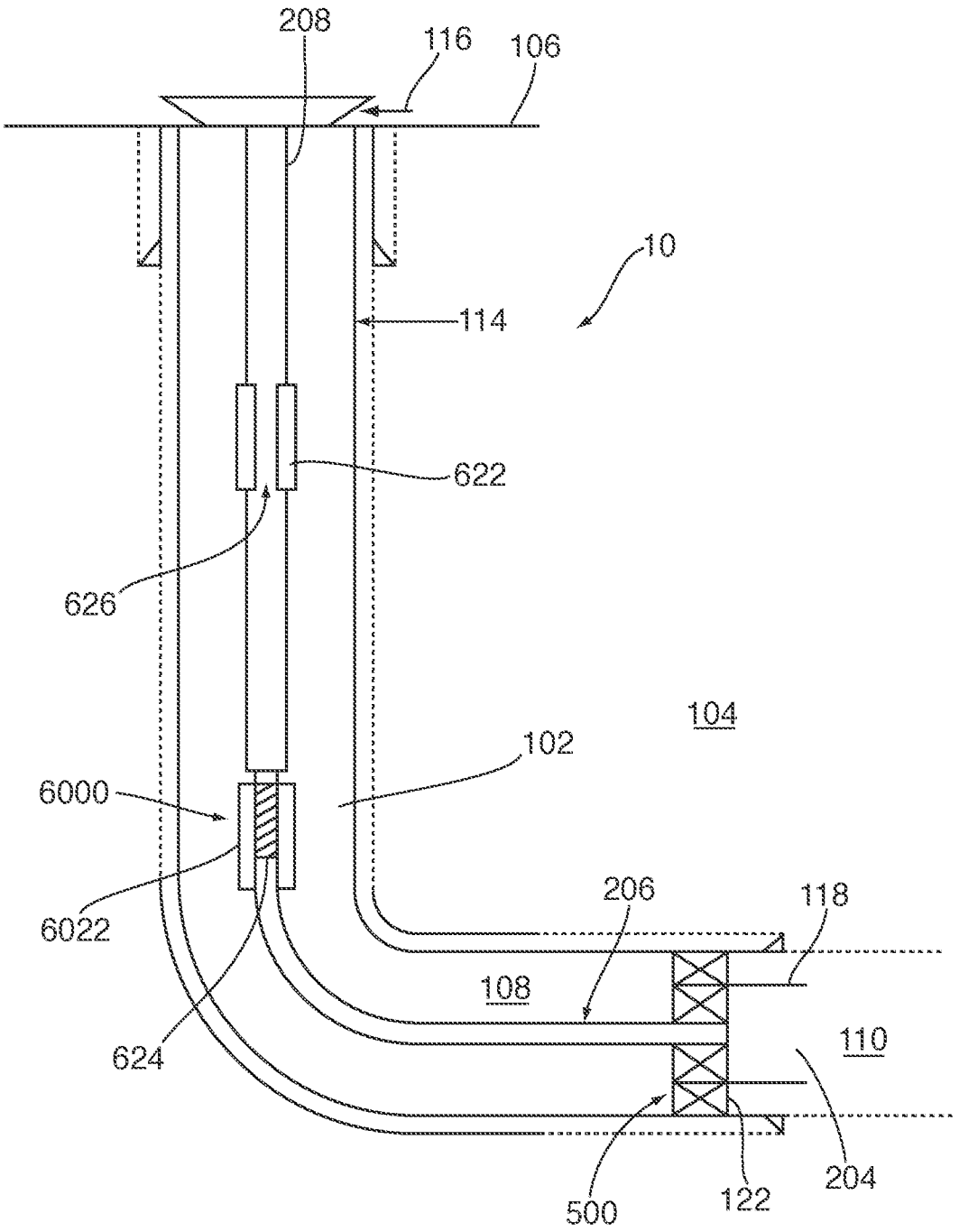
FIG. 11 is a schematic illustration of the embodiment of the system of FIG. 10, with the pump having been removed from the wellbore, and with the flow diverter-effecting insert having been re-deployed and inserted within the downhole insert-receiving part to define a second diverter.
Figure 12:
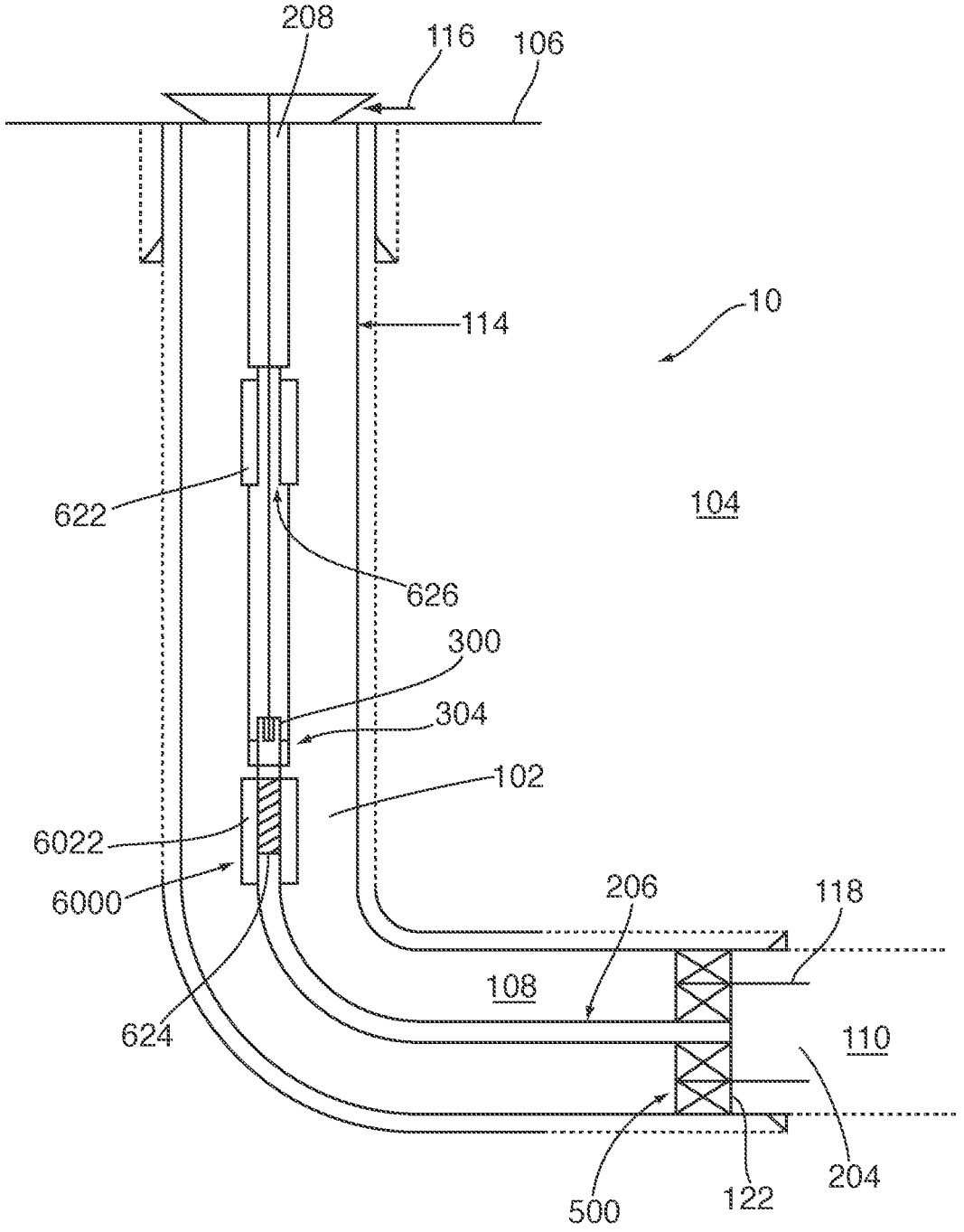
FIG. 12 is a schematic illustration of the embodiment of the system of FIGS. 11 and 12, with the pump having been re-deployed and landed above the second flow diverter after the second flow diverter having become established as illustrated in FIG. 11.
Figure 13A:
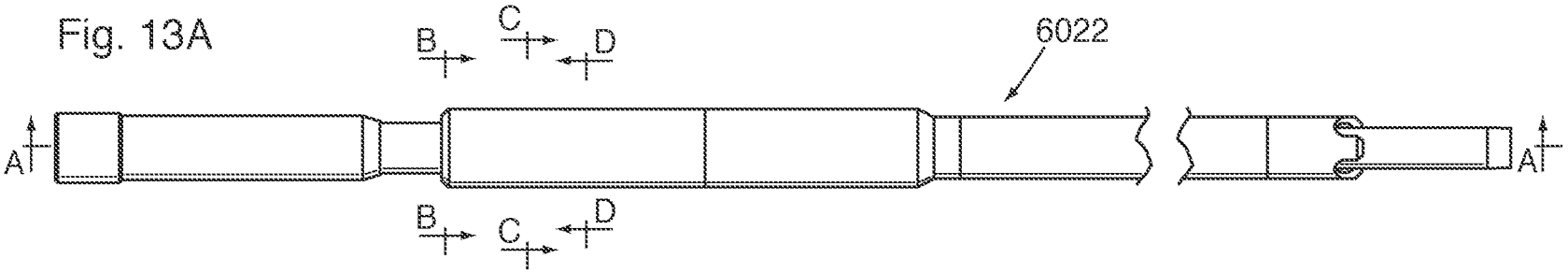
FIG. 13A is a side elevation view of the insert-receiving part of a second flow diverter.
Figure 13B:
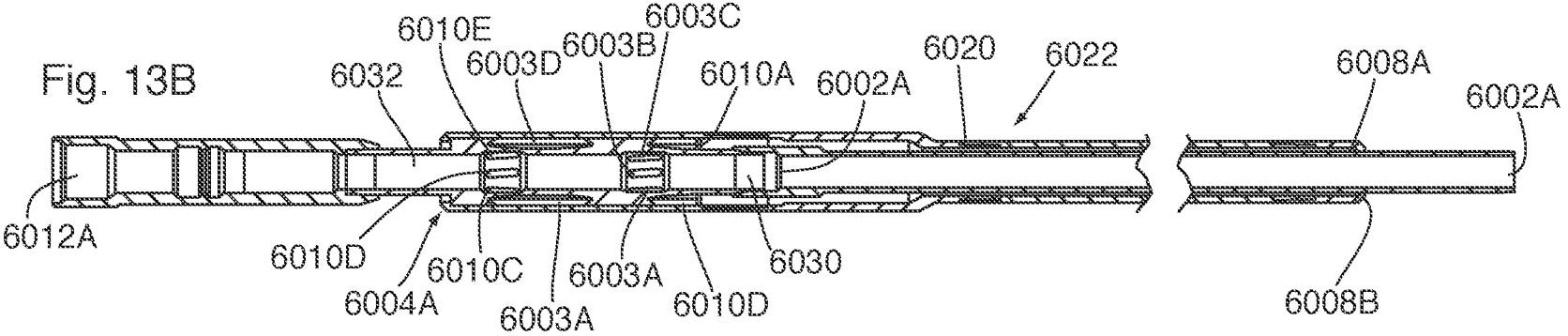
FIG. 13B is a sectional elevation view of the insert-receiving part illustrated in FIG. 13A, taken along lines A-A.
Figure 13E:
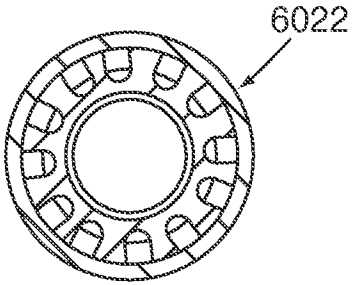
FIG. 13E is an axial view taken along lines D-D in FIG. 13A.
Figure 13D:
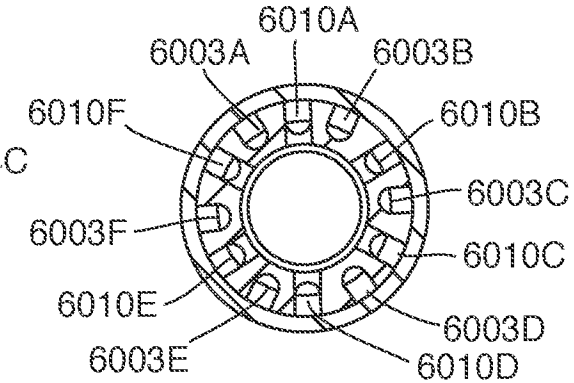
FIG. 13D is an axial view taken along lines C-C in FIG. 13A.
Figure 13C:
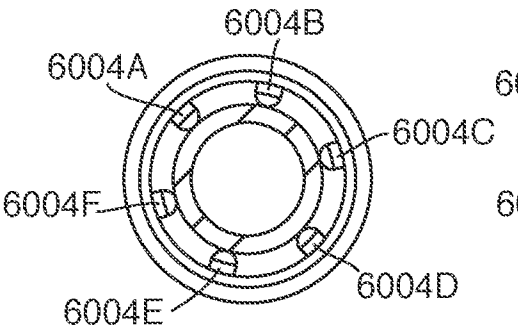
FIG. 13C is an axial view taken along lines B-B in FIG. 13A.

In some embodiments, for example, the pump 300, disposed at a first position, is removable from the production string via a service rig and while the flow diverter-effecting insert 624 is disposed within the passageway 626 in the flow diverter-defining position such that the flow diverter 600 is defined, the flow diverter-effecting insert 624 is configured such that, while disposed within the passageway 626 in the flow diverter-defining position (such that the flow diverter 600 is defined by at least the combination of the flow diverter-effecting insert 624 and the insert-receiving part 622), the flow diverter-effecting insert 624 is displaceable, relative to the insert-receiving part 622 (such as, for example, in an uphole direction through the production string such that the flow diverter-effecting insert 624 is removed from the production string) such that occlusion of the passageway of the insert-receiving part, by the flow diverter-effecting insert, is defeated or at least partially defeated removed (such as, for example, removed or at least partially removed), and such that the insert-receiving part 622 becomes disposed in a non-occluded condition, as described above, and the disposal in the non-occluded condition is such that the passageway 626 is disposed for receiving re-deployment of the pump 300 (or another pump) therethrough to a position downhole relative to the insert-receiving part 622. In such embodiments, it is possible to co-ordinate the redeployment of the pump 300 within the production string 202 to a second position disposed downhole (e.g. vertically below) relative to the position of the insert-receiving part 622. In this respect, and referring to FIGS. 10, 11 and 12, the pump 300 is re-deployable from a first position to a second position, for effecting production of reservoir fluid from the reservoir, where the second position is disposed downhole (e.g. below) the first position, without having to remove the production string 202 from the wellbore 102.

By providing for the re-deployment of the pump 300 to a position (i.e. the second position) that is disposed downhole (e.g. below) relative to the first position, the pump 300 may initially be deployed to effect production from the reservoir at a first position. After having produced at least a fraction of the reservoir fluid from the subterranean formation over a first time interval such that partial depletion of the reservoir has been effected, the pump 300 may be re-deployed to the second position, as described above, so as to effect production of at least a fraction of the remaining reservoir fluid of the subterranean formation over a second time interval. In some of these embodiments, for example, as the reservoir pressure is depleted, the bottomhole pressure is reduced, and it is preferable to operate a pump that is positioned vertically closer to the reservoir, so as to maximize drawdown. Unfortunately, as a pump is positioned further downhole, the load on the pump increases, reducing its capacity. In the case of a rod pump, the increased loading is attributable to, amongst other things, an increase in the weight of the rod, due to the increased rod length. By being able to redeploy the pump 300 within the production string, the pump 300 can be operated closer to the reservoir during later stages of production so as to maximize drawdown, while, during earlier stages of production, operated further uphole and realize higher production rates.

In this respect, in some embodiments, there is provided a process for producing reservoir fluid from a reservoir disposed within a subterranean formation, and the process includes:

over a first time interval, via the production string 202 disposed within a wellbore 102, producing reservoir fluids from the reservoir with a pump 300 disposed at a first position within the production string 202;

after the first time interval, suspending the producing, and while the production string 202 remains disposed within the wellbore 102:

redeploying the pump 300 within the production string 202 such that the pump 300 becomes disposed at a second position that is disposed below the first position; and over a second time interval, and via the production string 202, producing reservoir fluids from the reservoir with the pump 300.

In some embodiments, for example, the second position is disposed below the first position by a vertical distance of at least 500 metres, such as, for example, at least 1000 metres.

In some embodiments, for example, the pump 300 is configured for being releasably secured within the production string 202 at the first position by a first pump seating nipple 303, and the pump 300 is configured for being releasably secured within the production string 202 at the second position by a second pump seating nipple 304. The second pump seating nipple is disposed below the first pump seating nipple by a vertical distance of at least 500 metres, such as, for example, at least 1000 metres.

In some embodiments, for example, the redeployment is effected after the fluid level within the wellbore 102 becomes disposed at the first pump seating nipple 303.

In some embodiments, for example, during the first time interval, the pump 300 is disposed within the production string at a first position, and the production string 202 includes the flow diverter 600, which is defined by at least the combination of the insert-receiving part 622 and the flow diverter-effecting insert 624 (as described above), and is disposed downhole relative to the pump 300, and the process further includes, while the production string remains disposed within the wellbore 102, removing the pump 300 from the wellbore 102, and after the removal of the pump 300, and prior to the re-deployment of the pump 300, displacing the flow diverter-effecting insert 624 relative to the insert-receiving part 622 (such as, for example, by removing the flow diverter-effecting insert 624 from the production string 202, or by re-deploying the flow diverter-effecting insert 624, as described below) such that occlusion of the passageway of the insert-receiving part 622, by the flow diverter-effecting insert 624, is at least partially removed (such as, for example, fully removed), and such that the insert-receiving part 622 becomes disposed in a non-occluded condition. After the insert-receiving part 622 becomes disposed in the non-occluded condition, the pump is re-deployable to the second position, through the passageway 626.

Figure 14A:
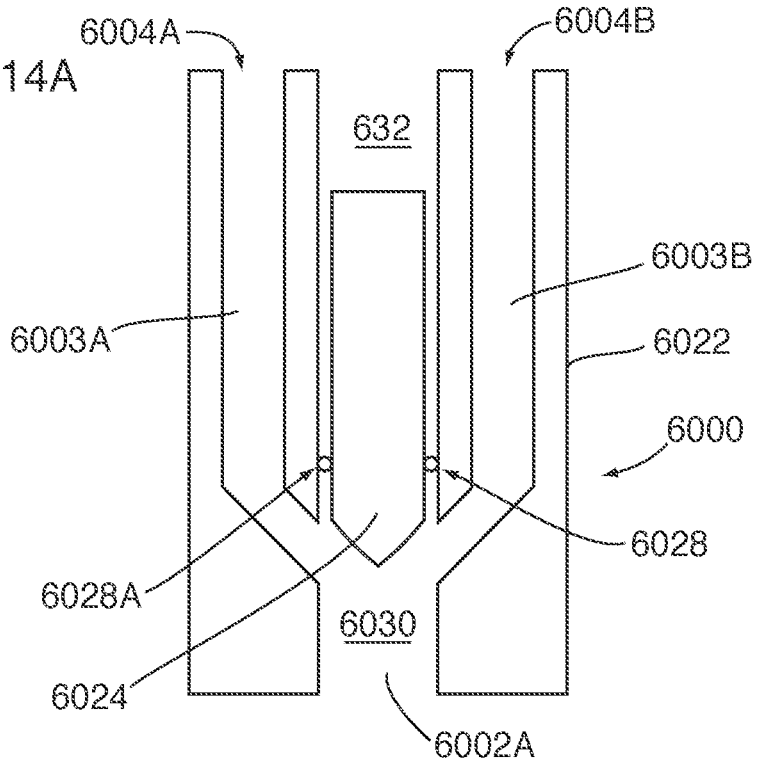
FIG. 14A is a schematic illustration of a second flow diverter of the present disclosure.
Figure 14B:
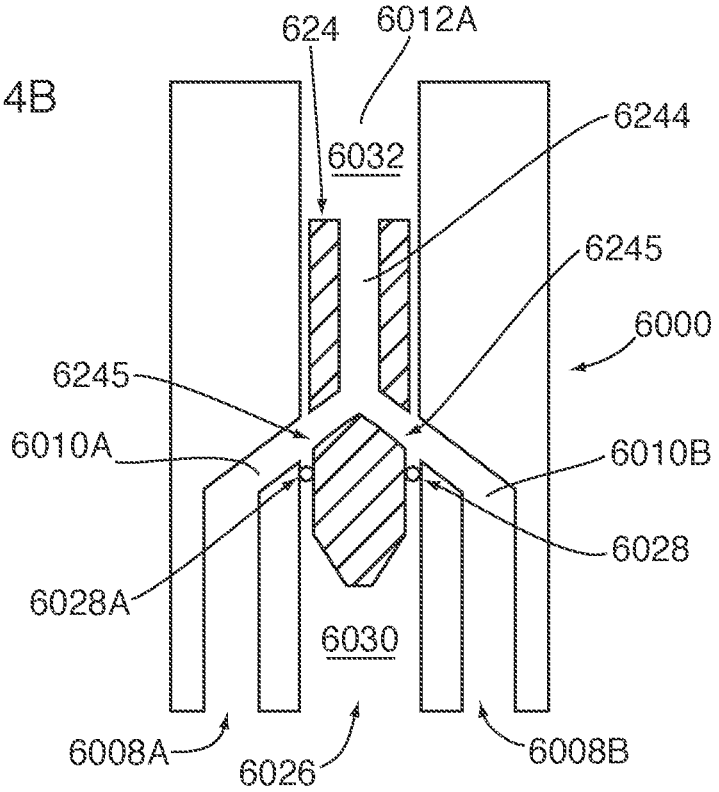
FIG. 14B is a schematic illustration of the second flow diverter of the present disclosure.

In some embodiments, for example, the at least partial removal of the occlusion by the displacement of the flow diverter-effecting insert 624 relative to the insert-receiving part 622 includes re-deploying the flow diverter-effecting insert 624 within the second passageway 6026 of a second insert-receiving part 6022 (see FIGS. 13A to E) for defining a second flow diverter 6000 (see FIGS. 14A and 14B), wherein the second insert-receiving part 6022 is disposed within the production string 202 at a position that is downhole (e.g. below) relative to the insert-receiving part 622, and is co-operatively disposed relative to the sealed interface 500, as described below, such that gas-depleted reservoir fluid, being obtained from reservoir fluid being received, conducted and discharged from the flow diverter 6000, is prevented, or substantially prevented, from bypassing a gas-depleted reservoir fluid receiver 6008 of the second flow diverter.

Figure 10:
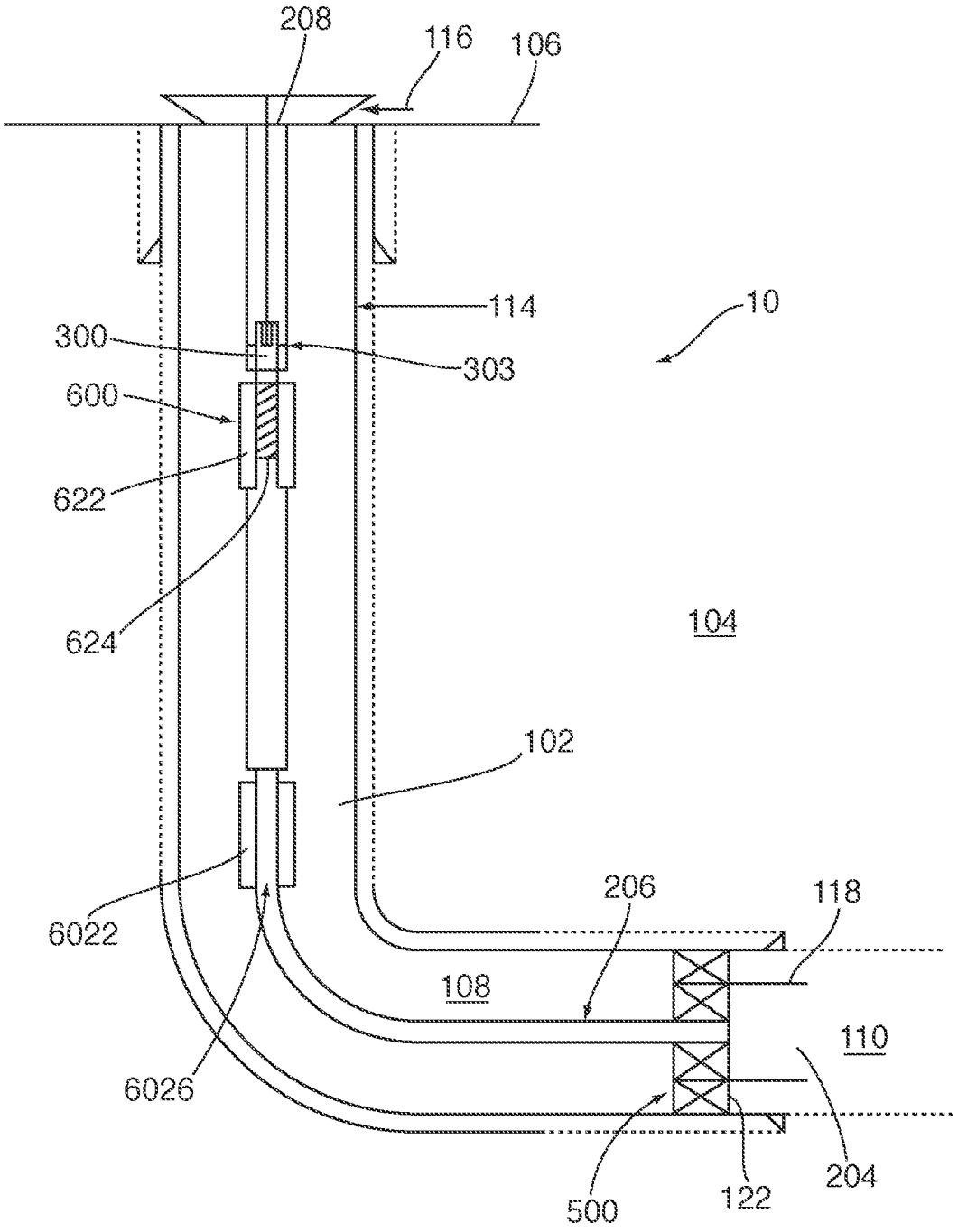
FIG. 10 is a schematic illustration of another embodiment of a system of the present disclosure having two insert-receiving parts, with the uphole insert-receiving part having received insertion of a flow diverter-effecting insert to define a first flow diverter, and with a pump landed above the first diverter.

In this respect, and referring to FIG. 10, the assembly 12 includes the second insert-receiving part 6022. The second insert-receiving part 6022 is integrated into the production string 202, such as, for example, by threaded coupling. The second insert-receiving part 6022 is configured to receive the flow diverter-effecting insert 624 (see FIG. 11). The flow diverter-effecting insert 624 is co-operatively configured with the insert-receiving part 6022 such that the second flow diverter 6000 is defined while the flow diverter-effecting insert 624 is disposed within the passageway 6026 of the second insert-receiving part 6022 in a second flow diverter-defining position. The flow diverter-effecting insert 624 is disposed in a flow diverter-defining position when the flow diverter-effecting insert 624, while disposed within the passageway 6026 of the second insert-receiving part 6022, is disposed such that the second flow diverter 6000 is established. In some embodiments, for example, the flow diverter-effecting insert 624 is releasably coupled to the second insert-receiving part 6022 with a lock mandrel 802, similar to the releasable coupling of the flow diverter-effecting insert 624 to insert-receiving part 622, as described above.

The second flow diverter 6000 is configured for:

(i) receiving and conducting a reservoir fluid flow;

(ii) discharging the received reservoir fluid flow into the wellbore 102 such that gaseous material is separated from the discharged reservoir fluid flow within the wellbore 102, in response to at least buoyancy forces, such that a gas-depleted reservoir fluid flow is obtained; and (iii) receiving and conducting the gas-depleted reservoir fluid flow for supplying to a pump 300.

The second insert-receiving part 6022 defines a second reservoir fluid receiver 6002 and a second gas-depleted reservoir fluid discharge communicator 6012. The second passageway 6026 extends between the second reservoir fluid receiver 6002 and the second gas-depleted reservoir fluid discharge communicator 6012.

The second insert-receiving part 6022 also defines a second reservoir fluid discharge communicator 6004 and a gas-depleted reservoir receiver 6008. The reservoir fluid discharge communicator 6004 is disposed in fluid communication with the passageway 6026, and the gas-deplete reservoir receiver 6008 is also disposed in fluid communication with the passageway 6026.

The second reservoir fluid receiver 6002 (such as, for example, in the form of one or more ports) is configured for receiving the reservoir fluid (such as, for example, in the form of a reservoir fluid flow) from the downhole wellbore space 610 via the production string inlet 204.

The second reservoir fluid discharge communicator 6004 (such as, for example, in the form of one or more ports) is fluidly coupled to the second reservoir fluid receiver 6002. The reservoir fluid discharge communicator 6004 is configured for discharging reservoir fluid (such as, for example, in the form of a flow), that is received by the reservoir fluid receiver 602 and conducted to the reservoir fluid discharge communicator 604, into an uphole wellbore space 108 of the wellbore 102. In some embodiments, for example, the reservoir fluid discharge communicator 604 is disposed at an opposite end of the flow diverter 6000 relative to the reservoir fluid receiver 602.

The second gas-depleted reservoir fluid receiver 6008 (such as, for example, in the form of one or more ports) is configured for receiving a gas-depleted reservoir fluid (such as, for example, in the form of a flow). The gas-depleted reservoir fluid is obtained after separation of gaseous material from the reservoir fluid (for example, a reservoir fluid flow), that has been discharged from the reservoir fluid discharge communicator 6004 into the uphole wellbore space 108, in response to at least buoyancy forces. In this respect, the gas-depleted reservoir fluid receiver 6008 and the reservoir fluid discharge communicator 6004 are co-operatively configured such that the gas-depleted reservoir fluid receiver 6008 is disposed for receiving a gas-depleted reservoir fluid, after gaseous material has been separated from the received reservoir fluid flow that has been discharged from the reservoir fluid discharge communicator 6004 into the uphole wellbore space 108, in response to at least buoyancy forces. In some embodiments, for example, the reservoir fluid discharge communicator 6004 is disposed at an opposite end of the second flow diverter 6000 relative to the gas-depleted reservoir fluid receiver 6008.

The second gas-depleted reservoir fluid discharge communicator 6012 is configured for discharging gas-depleted reservoir fluid (such as, for example, in the form of a flow), that is received by the gas-depleted reservoir fluid receiver 6008 and conducted to the gas-depleted reservoir fluid discharge communicator 6012. In some embodiments, for example, the gas-depleted reservoir fluid discharge communicator 6012 is disposed at an opposite end of the second flow diverter 6000 relative to the gas-depleted reservoir fluid receiver 6008. The discharging of the gas-depleted reservoir fluid, from the gas-depleted reservoir fluid discharge communicator 6012, is for supplying to the suction 302 of the pump 300.

The co-operative disposition of the second insert-receiving part 6022 relative to the sealed interface 500 is such that the sealed interface 500 prevents, or substantially prevents, gas-depleted reservoir fluid, that has been separated from reservoir fluid flow that has been discharged into the uphole wellbore space 108 from the reservoir fluid discharge communicator 6004, from being conducted from the uphole wellbore space 108 to the downhole wellbore space 110, thereby preventing, or substantially preventing, bypassing of the gas-depleted reservoir fluid receiver 6008 by the gas-depleted reservoir fluid flow that has been separated from the reservoir fluid within the uphole wellbore space 108.

Other exemplary embodiments of the flow diverter 6000 include ones that are the same, or substantially the same, as embodiments of the flow diverter 600 that are described above.

In some embodiments, for example, the insert-receiving part 6022 and the flow diverter-effecting insert 624 are co-operatively configured such that reservoir fluid flow, that is received by the reservoir fluid receiver 6002, is conducted to the reservoir fluid discharge communicator 6004 for discharging, via the reservoir fluid discharge communicator 6004, into the wellbore 102, such that gaseous material is separated from the discharged reservoir fluid flow within the wellbore 102 in response to at least buoyancy forces, such that a gas-depleted reservoir fluid flow is obtained, received by the gas-depleted reservoir fluid receiver 6008, and conducted to the gas-depleted reservoir fluid discharge communicator 6012, for supplying, via the gas-depleted reservoir fluid discharge communicator 6012, to the pump 300;

while the flow diverter-effecting insert 624 is disposed within the passageway 6026 of the insert-receiving part 6022, and, optionally, in some embodiments, for example, while the gas-depleted reservoir fluid receiver 6008 is disposed below the reservoir fluid discharge communicator 6004 (in which case, the receiving of the obtained gas-depleted reservoir fluid flow by the gas-depleted reservoir fluid receiver 6008 is effected by conduction of the obtained gas-depleted reservoir fluid flow to the gas-depleted reservoir fluid receiver 6008 in a downhole direction).

In some embodiments, for example, the insert-receiving part 6022 and the flow diverter-effecting insert 624 are co-operatively configured such that reservoir fluid flow, that is received by the reservoir fluid receiver 6002, is conducted to the reservoir fluid discharge communicator 6004 for discharging, via the reservoir fluid discharge communicator 6004, into the uphole wellbore space 108 of the wellbore 102, such that gaseous material is separated from the discharged reservoir fluid flow within the uphole wellbore space 108 of the wellbore 102 in response to at least buoyancy forces, such that a gas-depleted reservoir fluid flow is obtained, received by the gas-depleted reservoir fluid receiver 6008, and conducted to the gas-depleted reservoir fluid discharge communicator 6012, for discharging via the gas-depleted reservoir fluid discharge communicator 6012;

while: (i) the flow diverter-effecting insert 624 is disposed within the passageway 6026 of the insert-receiving part 6022 and, optionally, in some embodiments, for example, while the gas-depleted reservoir fluid receiver 6008 is disposed below the reservoir fluid discharge communicator 6004 (in which case, the receiving of the obtained gas-depleted reservoir fluid flow by the gas-depleted reservoir fluid receiver 6008 is effected by conduction of the obtained gas-depleted reservoir fluid flow to the gas-depleted reservoir fluid receiver 6008 in a downhole direction); (ii) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (iii) displacement of the reservoir fluid from the subterranean formation is effectible by the pump 300 such that the reservoir fluid flow is received by the inlet 204 from the downhole wellbore space 110 and conducted to the reservoir fluid receiver 602.

In some embodiments, for example, the insert-receiving part 6022 and the flow diverter-effecting insert 624 are further co-operatively configured such that:

bypassing of the reservoir fluid discharge communicator 6004, by the reservoir fluid flow being received by the reservoir fluid receiver 6002, is at least impeded (such as, for example, prevented or substantially prevented) by the flow diverter-effecting insert 624 that is disposed within the passageway 6026, such that the received reservoir fluid flow is conducted to the reservoir fluid discharge communicator 6004 and discharged into the wellbore 102 such that gaseous material is separated from the discharged reservoir fluid flow within the wellbore 102 in response to at least buoyancy forces, such that a gas-depleted reservoir fluid flow is obtained and conducted to the gas-depleted reservoir fluid receiver 6008 such that a gas-depleted reservoir fluid flow is received by the gas-depleted reservoir fluid receiver 6008; and bypassing of the gas-depleted reservoir fluid discharge communicator 6012, by the gas-depleted reservoir fluid flow being received by the gas-depleted reservoir fluid receiver 6008, is at least impeded (such as, for example, prevented or substantially prevented) by the flow diverter-effecting insert 624 that is disposed within the passageway 6026, such that gas-depleted reservoir fluid flow is conducted to the gas-depleted reservoir fluid discharge communicator 6012 for discharging of the gas-depleted reservoir fluid flow via the gas-depleted reservoir fluid communicator 6012;

while the flow diverter-effecting insert 624 is disposed within the passageway 6026 of the insert-receiving part 6022, and, optionally, in some embodiments, for example, while the gas-depleted reservoir fluid receiver 6008 is disposed below the reservoir fluid discharge communicator 6004 (in which case, the receiving of the obtained gas-depleted reservoir fluid flow by the gas-depleted reservoir fluid receiver 6008 is effected by conduction of the obtained gas-depleted reservoir fluid flow to the gas-depleted reservoir fluid receiver 6008 in a downhole direction).

In some embodiments, for example, the insert-receiving part 6022 and the flow diverter-effecting insert 624 are further co-operatively configured such that:

bypassing of the reservoir fluid discharge communicator 6004, by the reservoir fluid flow being received by the reservoir fluid receiver 6002, is at least impeded (such as, for example, prevented or substantially prevented) by the flow diverter-effecting insert 624 that is disposed within the passageway 6026, such that the received reservoir fluid flow is conducted to the reservoir fluid discharge communicator 6004 and discharged into the uphole wellbore space 108 of the wellbore 102 such that gaseous material is separated from the discharged reservoir fluid flow within the uphole wellbore space 108 in response to at least buoyancy forces, such that a gas-depleted reservoir fluid flow is obtained and conducted to the gas-depleted reservoir fluid receiver 6008 such that a gas-depleted reservoir fluid flow is received by the gas-depleted reservoir fluid receiver 6008; and bypassing of the gas-depleted reservoir fluid discharge communicator 6012, by the gas-depleted reservoir fluid flow being received by the gas-depleted reservoir fluid receiver 6008, is at least impeded (such as, for example, prevented or substantially prevented) by the flow diverter-effecting insert 624 that is disposed within the passageway 6026, such that gas-depleted reservoir fluid flow is conducted to the gas-depleted reservoir fluid discharge communicator 6012 for discharging of the gas-depleted reservoir fluid via the gas-depleted reservoir fluid communicator 6012;

while: (i) the flow diverter-effecting insert 624 is disposed within the passageway 6026 of the insert-receiving part 6022 and, optionally, in some embodiments, for example, while the gas-depleted reservoir fluid receiver 6008 is disposed below the reservoir fluid discharge communicator 6004 (in which case, the receiving of the obtained gas-depleted reservoir fluid flow by the gas-depleted reservoir fluid receiver 6008 is effected by conduction of the obtained gas-depleted reservoir fluid flow to the gas-depleted reservoir fluid receiver 6008 in a downhole direction); (ii) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (iii) displacement of the reservoir fluid from the subterranean formation is effectible by the pump 300 such that the reservoir fluid flow is received by the inlet 204 from the downhole wellbore space 110 and conducted to the reservoir fluid receiver 6002.

In some of these embodiments, for example, the flow diverter-effecting insert 624 is further configured for disposition relative to the passageway 6026 such that a passageway sealed interface 6028 is established. In this respect, the insert-receiving part 6022 and the flow diverter-effecting insert 624 are further co-operatively configured such that:

a passageway sealed interface 6028 is established while the flow diverter-effecting insert 624 is disposed within the passageway 6026 of the insert-receiving part 6022 (and, optionally, in some embodiments, for example, while the gas-depleted reservoir fluid receiver 6008 is disposed below the reservoir fluid discharge communicator 6004, in which case, the receiving of the obtained gas-depleted reservoir fluid flow by the gas-depleted reservoir fluid receiver 6008 is effected by conduction of the obtained gas-depleted reservoir fluid flow to the gas-depleted reservoir fluid receiver 6008 in a downhole direction), with effect that:

fluid communication between the passageway 6026 and the reservoir fluid discharge communicator 6004 is established via a passageway portion 6030 that is disposed downhole relative to the passageway sealed interface 6028, such that fluid communication is established between the reservoir fluid receiver 6002 and the reservoir fluid discharge communicator 6004;

bypassing of the reservoir fluid discharge communicator 6004, by reservoir fluid flow, that is received by the reservoir fluid receiver 6002, is prevented, or substantially prevented, by the passageway sealed interface 6028, such that the received reservoir fluid flow is conducted, via the passageway portion 6030 disposed downhole relative to the passageway sealed interface 6028, to the reservoir fluid discharge communicator 604, such that the received reservoir fluid flow is discharged into the wellbore 102 and gaseous material is separated from the received reservoir fluid flow within the wellbore 102 in response to at least buoyancy forces, such that a gas-depleted reservoir fluid flow is obtained and conducted to the gas-depleted reservoir fluid receiver 6008 such that the gas-depleted reservoir fluid flow is received by the gas-depleted reservoir fluid receiver 6008;

the fluid communication between the passageway 6026 and the gas-depleted reservoir fluid receiver 608 is established via a passageway portion 6032 that is disposed uphole relative to the passageway sealed interface 6028, such that fluid communication is established between the gas-depleted reservoir fluid receiver 6008 and the gas-depleted reservoir fluid discharge communicator 6012;

and bypassing of the gas-depleted reservoir fluid discharge communicator 6012, by the gas-depleted reservoir fluid flow, that is received by the gas-depleted reservoir fluid receiver 6008, is prevented, or substantially prevented, by the passageway sealed interface 6028, such that the received gas-depleted reservoir fluid flow is conducted, via the passageway portion 6032 disposed uphole relative to the passageway sealed interface 6028, from the gas-depleted reservoir fluid receiver 608 to the gas-depleted reservoir fluid discharge communicator 6012 such that the gas-depleted reservoir fluid flow is discharged from the gas-depleted reservoir fluid discharge communicator 6012.

In some embodiments, for example, the insert-receiving part 6022 and the flow diverter-effecting insert 624 are further co-operatively configured such that:

a passageway sealed interface 6028 is established while the flow diverter-effecting insert 624 is disposed within the passageway 6026 of the insert-receiving part 6022 (and, optionally, in some embodiments, for example, while the gas-depleted reservoir fluid receiver 6008 is disposed below the reservoir fluid discharge communicator 6004, in which case, the receiving of the obtained gas-depleted reservoir fluid flow by the gas-depleted reservoir fluid receiver 6008 is effected by conduction of the obtained gas-depleted reservoir fluid flow to the gas-depleted reservoir fluid receiver 6008 in a downhole direction), with effect that:

fluid communication between the passageway 6026 and the reservoir fluid discharge communicator 6004 is established via a passageway portion 6030 that is disposed downhole relative to the passageway sealed interface 6028, such that fluid communication is established between the reservoir fluid receiver 6002 and the reservoir fluid discharge communicator 6004;

bypassing of the reservoir fluid discharge communicator 6004, by reservoir fluid flow, that is received by the reservoir fluid receiver 6002, is prevented, or substantially prevented, by the passageway sealed interface 6028, such that the received reservoir fluid flow is conducted, via the passageway portion 6030 disposed downhole relative to the passageway sealed interface 6028, to the reservoir fluid discharge communicator 6004, such that the received reservoir fluid flow is discharged into the uphole wellbore space 108 of the wellbore 102 and gaseous material is separated from the received reservoir fluid flow within the uphole wellbore space 108 of the wellbore 102 in response to at least buoyancy forces, such that a gas-depleted reservoir fluid flow is obtained and conducted to the gas-depleted reservoir fluid receiver 6008 such that the gas-depleted reservoir fluid flow is received by the gas-depleted reservoir fluid receiver 6008;

the fluid communication between the passageway 6026 and the gas-depleted reservoir fluid receiver 6008 is established via a passageway portion 6032 that is disposed uphole relative to the passageway sealed interface 6028, such that fluid communication is established between the gas-depleted reservoir fluid receiver 6008 and the gas-depleted reservoir fluid discharge communicator 6012;

and bypassing of the gas-depleted reservoir fluid discharge communicator 6012, by the gas-depleted reservoir fluid flow, that is received by the gas-depleted reservoir fluid receiver 6008, is prevented, or substantially prevented, by the passageway sealed interface 6028, such that the received gas-depleted reservoir fluid flow is conducted, via the passageway portion 6032 disposed uphole relative to the passageway sealed interface 6028, from the gas-depleted reservoir fluid receiver 608 to the gas-depleted reservoir fluid discharge communicator 6012 such that the gas-depleted reservoir fluid flow is discharged from the gas-depleted reservoir fluid discharge communicator 6012;

while: (i) the assembly 12 is disposed within the wellbore 102 and oriented such that the production string inlet 204 is disposed downhole relative to (such as, for example, vertically below) the production string outlet 208 for receiving reservoir fluid flow from the downhole wellbore space 110, and the wellbore sealed interface 500 is defined by interaction between the wellbore sealed interface effector 400 and a wellbore feature; and (ii) displacement of the reservoir fluid from the subterranean formation is effectible by the pump 300 such that the reservoir fluid flow is received by the inlet 204 from the downhole wellbore space 110 and conducted to the reservoir fluid receiver 602.

In some embodiments, for example, the passageway sealed interface 6028 is effected by sealing engagement, or substantially sealing engagement, of the flow diverter-effecting insert 624 with the insert-receiving part 6022. In some embodiments, for example, the sealing engagement, or substantially sealing engagement, of the flow diverter-effecting insert 624 with the passageway 6026 is effected by a sealing member 6028A that is coupled to the flow diverter-effecting insert 624.

In some embodiments, for example, the flow diverter-effecting insert 624 and the insert-receiving part 6022 are further co-operatively configured such that:

the ports 6245 are disposed for receiving the gas-depleted reservoir fluid flow from corresponding gas-depleted reservoir fluid conductor branches 6010(*a*)-(*f*) that extend from the gas-depleted reservoir fluid receiver 6008;

the gas-depleted reservoir fluid flow, that is received by the ports 6245, is conducted, via the fluid passage 6244 to the port 6243, for discharging, via the port 6243, into the passageway portion 6032 disposed uphole relative to the passageway sealed interface 6028, for discharging via the gas-depleted reservoir fluid discharge communicator 6012;

the sealing member 628A:

(i) prevents, or substantially prevents, bypassing of the ports 6245 by the gas-depleted reservoir fluid flow being conducted by the gas-depleted reservoir fluid conductor branches 6010(*a*)-(*f*); and (ii) prevents, or substantially prevents, bypassing of the reservoir fluid conductor branches 6003(*a*)-(*f*) by reservoir fluid flow that is received by the reservoir fluid receiver 6002, such that the received reservoir fluid flow is conducted, via: (a) the passageway portion 6030 disposed downhole relative to the passageway sealed interface 6028, and (b) the branches 6003(*a*)-(*f*), to the reservoir fluid discharge communicator 6004, while the flow diverter-effecting insert 624 is disposed within the passageway 6026 of the insert-receiving part 6022, such as while the flow diverter-effecting insert 624 is disposed in the flow diverter-defining position.

In some embodiments, for example, the second flow diverter 6000 is provided downhole relative to the pump 300, when disposed in the second position, so as to, amongst other things, mitigate gas-lock conditions during operation of the pump 300.

To this end, prior to the re-deployment of the pump 300, the flow diverter-effecting insert 624 is re-deployed (see FIG. 11) within the production string 202 via slickline into releasable coupling with the second insert-receiving part 6022 (such as, for example, in the manner the releasable coupling of the insert 624 is effected with the first insert-receiving part 6022, as above-described) such that the flow diverter-effecting insert 624 becomes positioned within the second passageway 6026 of the second insert-receiving part 6022, that is disposed within the production string 202 at a position that is downhole relative to the insert-receiving part 622, such that the second flow diverter 6000 is established, as described above. In this respect, the re-deployment of the pump 300, through the insert-receiving part 622, and to a second position disposed vertically below the position of the insert-receiving part 622 (see FIG. 12), is such that the second position is disposed uphole relative to the second flow diverter 6000 for receiving the gas-depleted reservoir fluid from the gas-depleted reservoir fluid discharge communicator 6012.

Figure 15A:
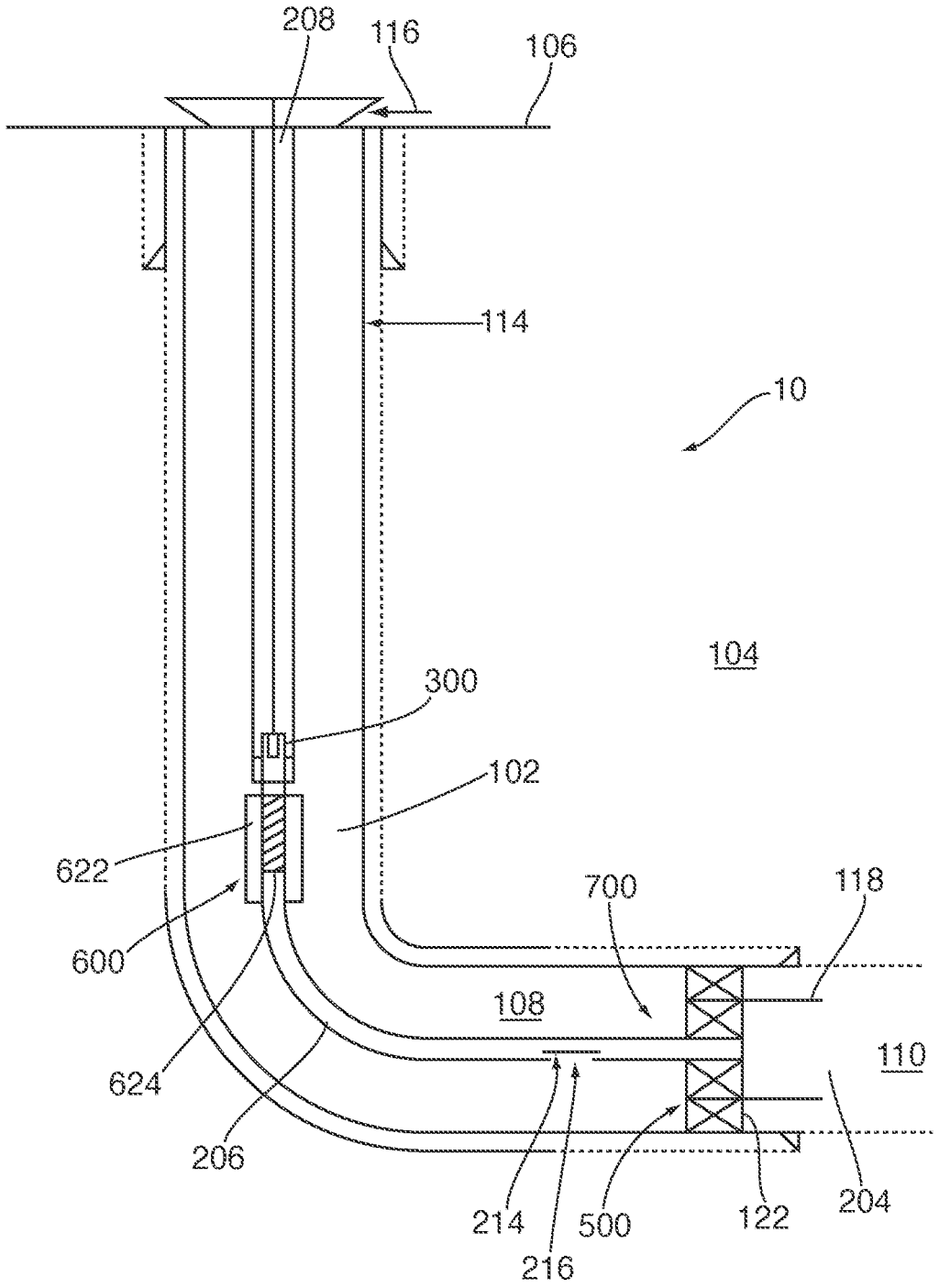
FIG. 15A is a schematic illustration of an embodiment of a system of the present disclosure with provision for removing solid debris that has collected within the sump.

In some embodiments, for example, the collected solid debris within the sump 700 is periodically removed. In this respect, and referring to FIG. 15A, in some embodiments, for example, a displaceable fluid barrier member 214 (e.g. sliding sleeve) is integrated within the downhole production string portion 206. The fluid barrier member 214 is displaceable between open and closed positions. In the open position, fluid communication is established through a port 216, between the sump 700 and the downhole production string portion 206, such that fluid flow through this fluid passage fluidizes the collected solids within the sump 700, and such that the collected solids are transported to the surface 106, as is explained below. In the closed position, the fluid barrier 214 prevents, or substantially prevents, fluid communication through the port 216, between the sump 700 and the downhole production string portion 206.

Figure 15B:
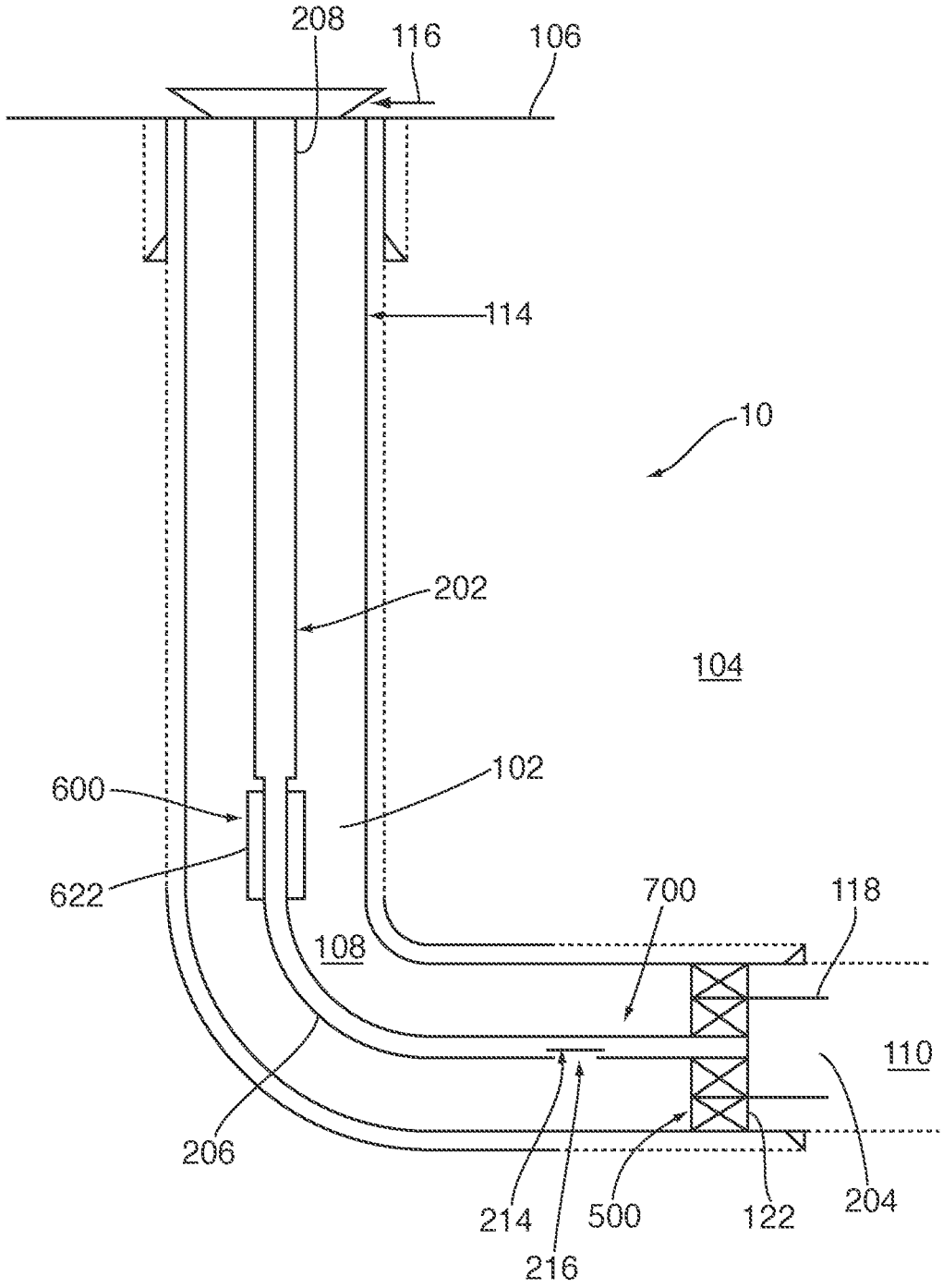
FIG. 15B is a schematic illustration of the system in FIG. 15A, after the pump and the flow diverter-effecting insert having been removed from the wellbore.

Referring to FIG. 15B, in some embodiments, for example, prior to effecting removal of the collected solids within the sump 700, the pump 300 is removed from the wellbore 102, and after the removal of the pump 300, the flow diverter-effecting insert 624 is removed from the wellbore. As a result, occlusion of the passageway of the insert-receiving part 622, by the flow diverter-effecting insert 624, is at least partially removed (such as, for example, fully removed), and such that the insert-receiving part 622 becomes disposed in a non-occluded condition.

Figure 15C:
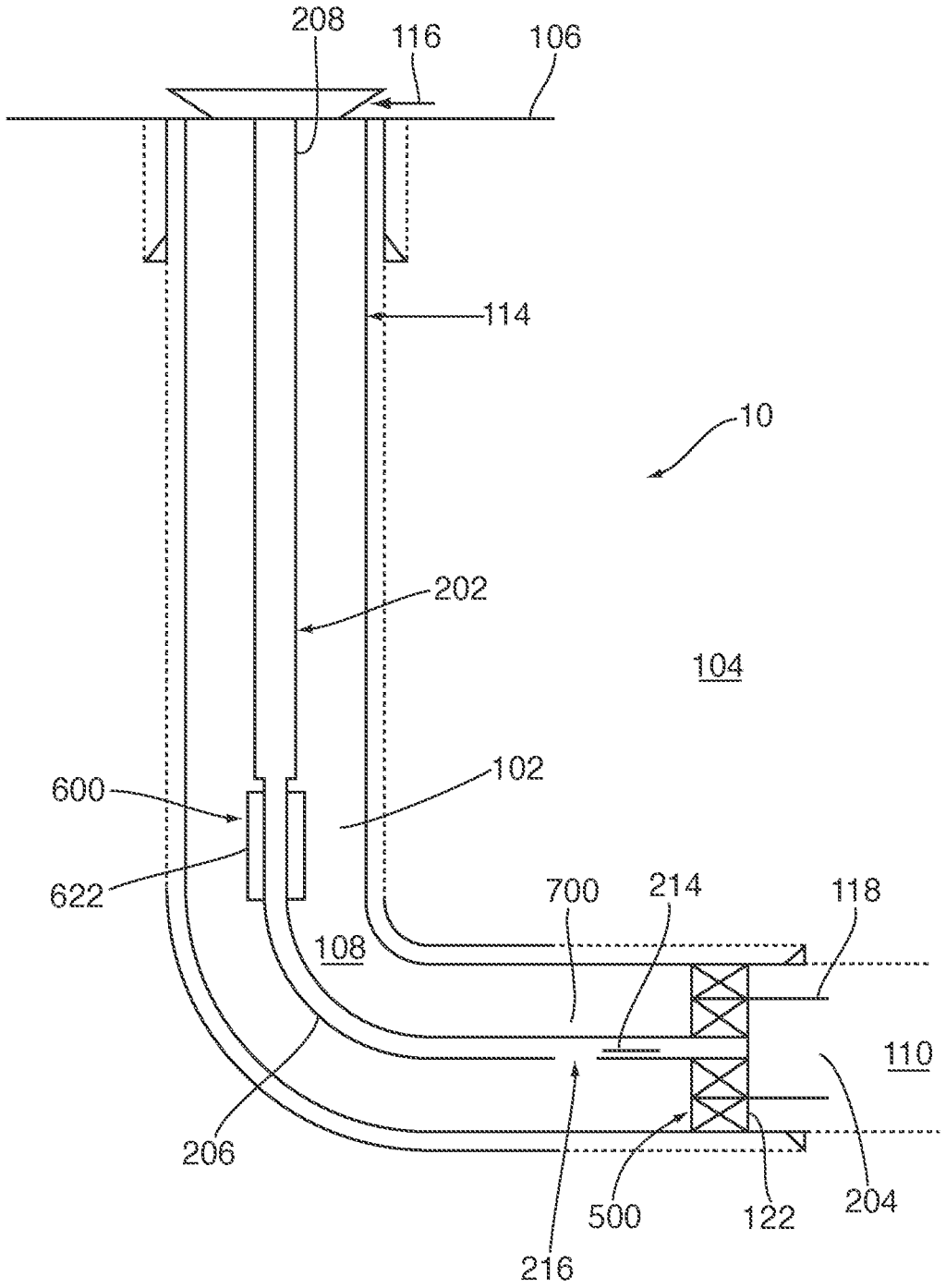
FIG. 15C is a schematic illustration of the system in FIG. 15A, with the pump and the flow diverter-effecting insert having been removed from the wellbore, and after the fluid barrier member having been displaced to the open position.

To effect the removal of the collected solid debris from the sump 700, the fluid barrier member 214 is disposed in the open position. During production, the fluid barrier member 214 is disposed in the closed position. As such, in order to effect the removal of the solid debris from the sump 700, the fluid barrier is displaced from the closed position to the open position. In this respect, and referring to FIG. 15C, in some embodiments, after the production is suspended, and prior to effecting removal of the collected solid debris within the sump 700, the fluid barrier member 214 is displaced from the closed position to the open position. In some embodiments, for example, prior to the displacement of the fluid barrier member 214 from the closed position to the open position, both of the pump 300 and the flow diverter-effecting insert 624 are displaced such that a shifting tool is deployable within the production string 202 such that the shifting tool becomes disposed for effecting the displacement of the fluid barrier member 214 from the closed position to the open position. In some embodiments, for example, the displacement of both of the pump 300 and the flow diverter-effecting insert 624 includes the removal of both of the pump 300 and the flow diverter-effecting insert 624 from the wellbore 102. After the deployment of the shifting tool, the shifting tool is actuated such that the displacement of the fluid barrier 214 from the closed position to the open position is effected.

Figure 15D:
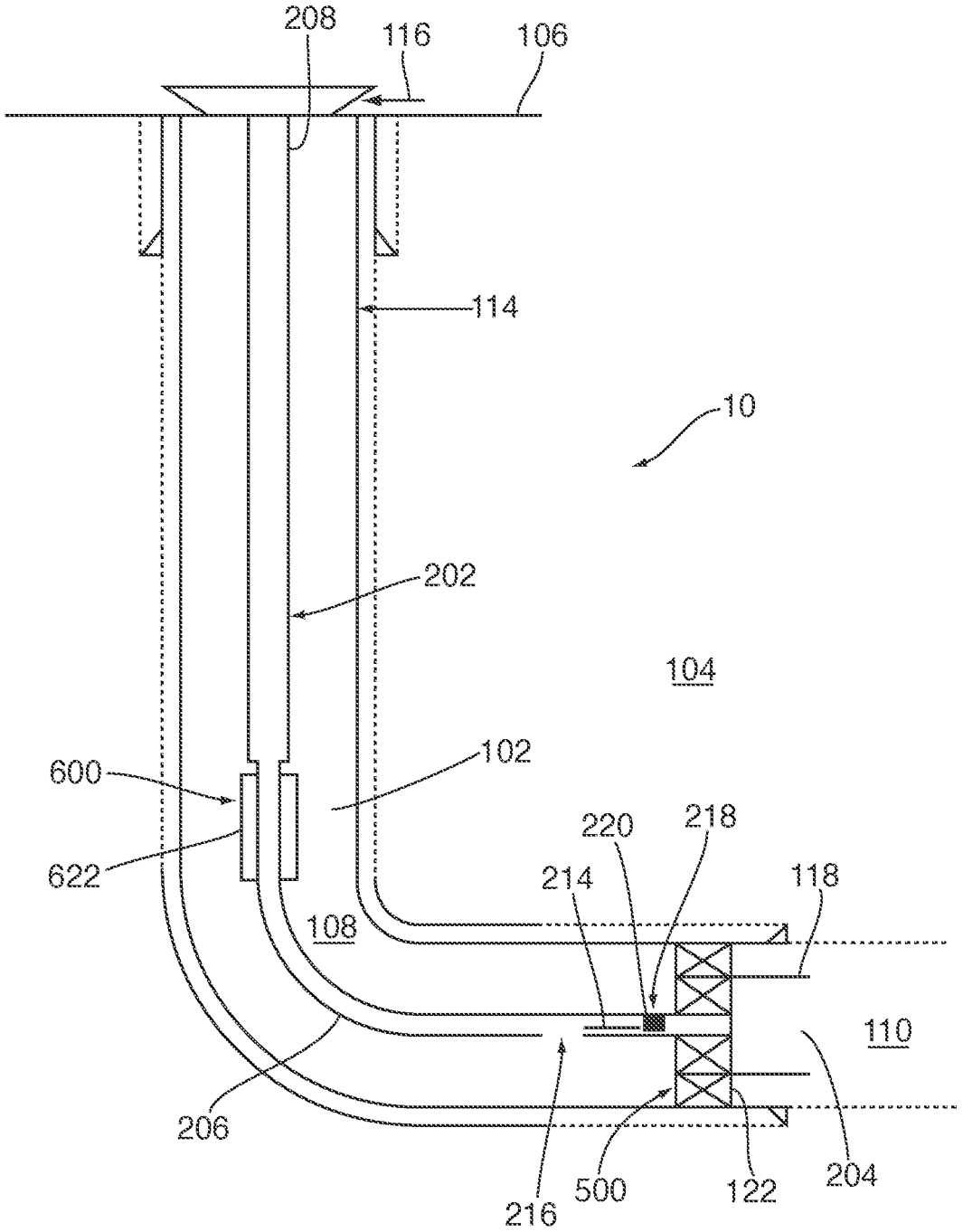
FIG. 15D is a schematic illustration of the system in FIG. 15A, with the pump and the flow diverter-effecting insert having been removed from the wellbore, and the fluid barrier member having been displaced to the open position, and after a plug having been landed within the production string for effecting fluid isolation prior to removal of the solid debris.

Referring to FIG. 15D, a sealed interface 218 is established within the downhole production string portion 206 with effect that fluid communication between the uphole wellbore space 108 and the downhole wellbore space 110, via the downhole production string portion 206, is prevented or substantially prevented, while the sump 700 is disposed in fluid communication with the downhole production string portion 206. In some embodiments, for example, the sealed interface 218 is established by the deployment of a plug 220 within the downhole production string portion 206 such that the plug 220 lands downhole relative to the port 214. In some embodiments, for example, the plug 200 is a dissolvable plug such that fluid communication can be re-established by dissolution of the plug 200 within wellbore fluids, via the downhole production string portion 206, between the uphole wellbore space 108 and the downhole wellbore space 110.

After both of: (i) the fluid communication between the sump 700 and the downhole production string portion 206 has been effected, and (ii) the sealed interface 218 has been established, liquid material is injected into the wellbore to effect fluidization of the solid debris, and transport of the fluidized solid debris to the surface 106.

Figure 15E:
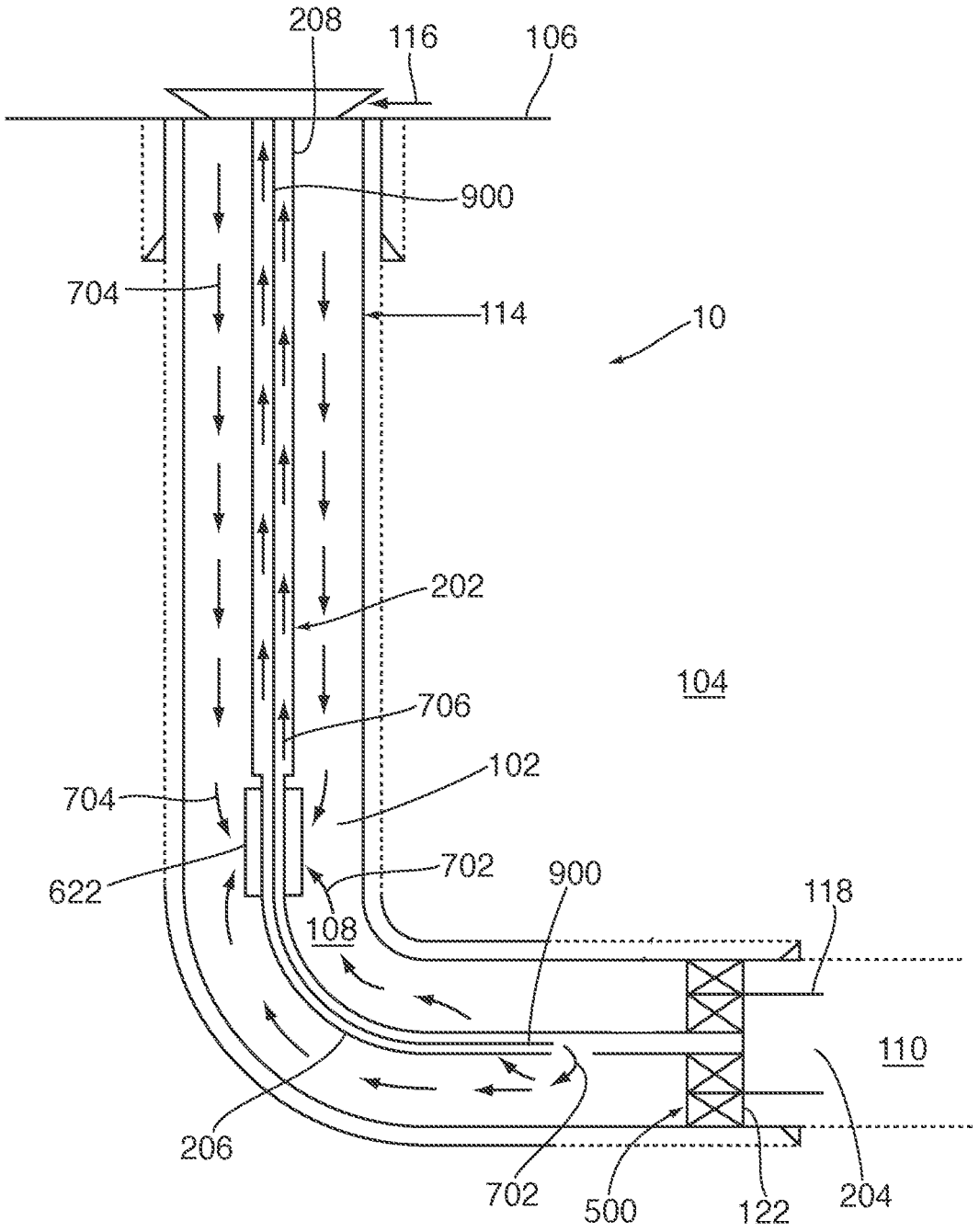
FIG. 15E is a schematic illustration of the system in FIG. 15A, illustrating a first mode of removing solid debris from the sump.

In this respect, in some embodiments, for example, a first liquid material is injected via a coiled tubing 900 that is deployed within the production string 202. In some embodiments, for example, the coiled tubing 900 includes the shifting tool such that the shifting tool is deployed within the production string 202 via the coiled tubing. Referring to FIG. 15E, the first liquid material is injected, via the coiled tubing 900, through the port 216 and into the sump 700, such that fluidization of the collected solid debris is effected within the sump 700, such that a slurry, including the fluidized collected solid debris, is obtained and conducted uphole through the intermediate fluid passage 112 (as illustrated by flowpath 702). Co-operatively, a second liquid material is injected downhole from the surface and through the intermediate fluid passage 112 (as illustrated by flowpath 704), with effect that the second liquid material combines with the slurry and is conducted into a space within the production string 202 between the coiled tubing 900 and the production string 202 (such as, for example, an annular space within the production string 202 and external to the coiled tubing), via one or both of the reservoir fluid discharge communicator 604 and the gas-depleted reservoir fluid receiver 608, and uphole through the space to the surface (see flowpath 706), thereby effecting removal of the collected solid debris from the wellbore 102.

Figure 15F:
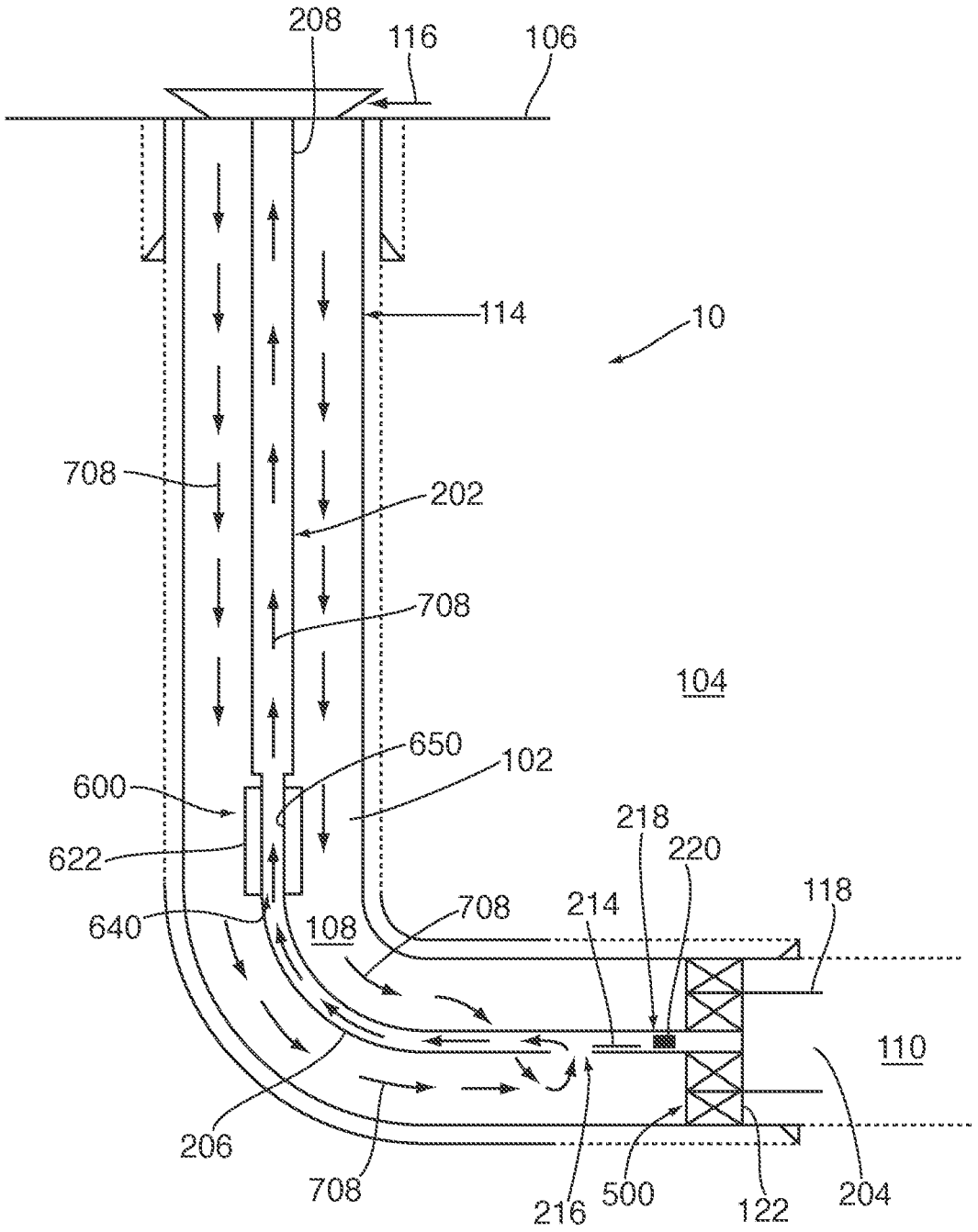
FIG. 15F is a schematic illustration of the system in FIG. 15A, illustrating a second mode of removing solid debris from the sump.

Referring to FIG. 15F, in some embodiments, for example, the liquid material is injected, for effecting fluidization of the solid debris, and transport of the fluidized solid debris to the surface 106, from the surface 106 to the sump 700, via the intermediate fluid passage 112, such that fluidization of the collected solid debris is effected within the sump 700, such that a slurry, including the fluidized collected solid debris, is obtained and conducted through the port 216 and uphole through the production string 202 (see flowpath 708).

Figure 15G:
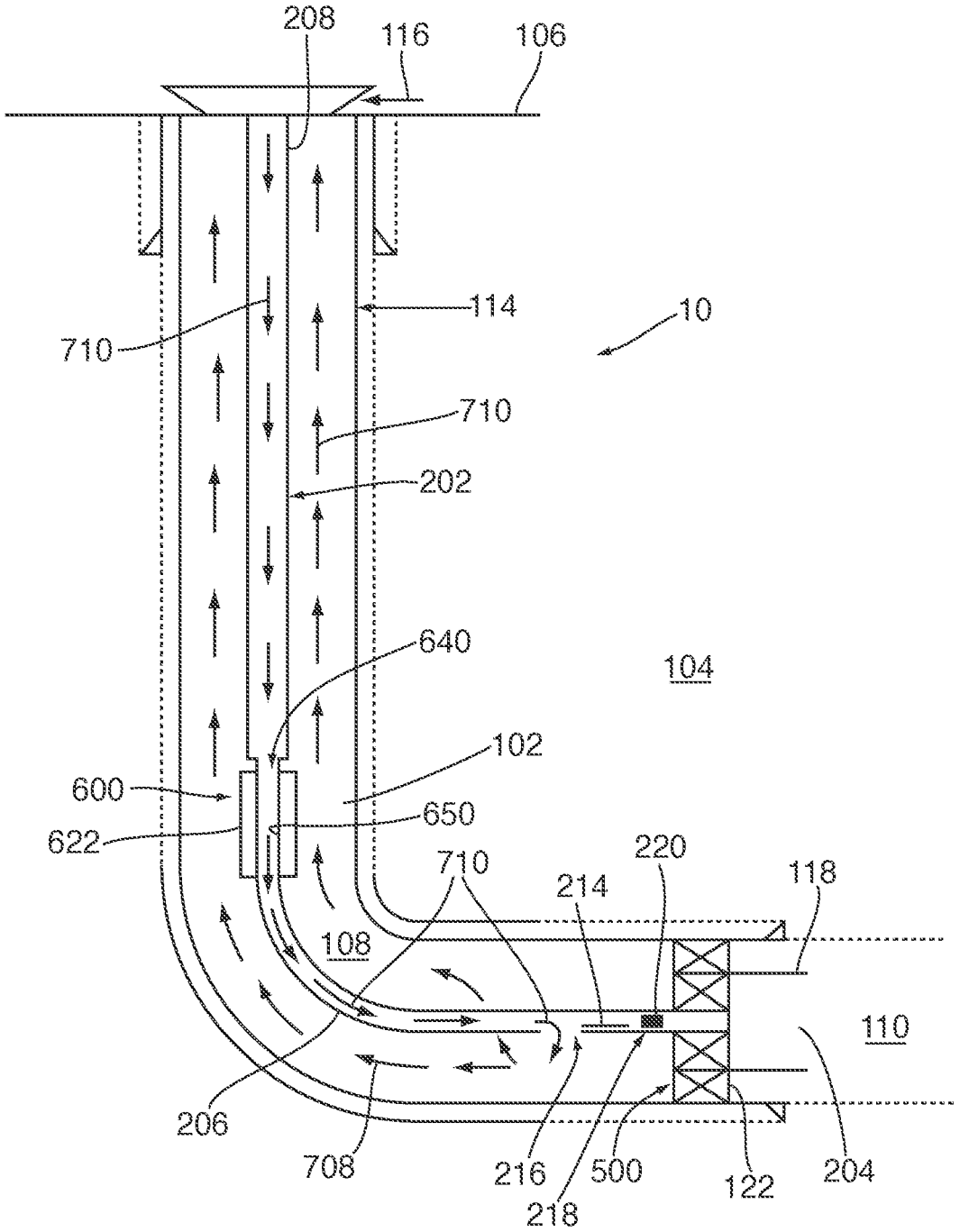
FIG. 15G is a schematic illustration of the system in FIG. 15A, illustrating a third mode of removing solid debris from the sump.

Referring to FIG. 15G, alternatively, in some embodiments, for example, the liquid material is injected, for effecting fluidization of the solid debris, and transport of the fluidized solid debris to the surface 106, from the surface 106 to the sump 700, via the production string 202 and through the port 116, such that fluidization of the collected solid debris is effected within the sump 700, such that a slurry, including the fluidized collected solid debris, is obtained and conducted uphole through the intermediate fluid passage 112 to the surface 106 (see flowpath 710).

In some operational implementations, for effecting the solids removal, the liquid material is injected via the intermediate fluid passage 112 for a first time interval, and then such liquid material injection is suspended. After the suspension of the liquid material injection through the intermediate fluid passage 112, liquid material is then injected via the production string for a second interval. By first injecting through the intermediate fluid passage 112, fluidization of the collected solid material is enhanced.

In either one of these two sets of embodiments, prior to the injecting of the liquid material, a passageway sealed interface 640 is established for preventing, or substantially preventing, independently, each one of: (i) fluid communication, between the passageway 626 and the intermediate fluid passage 112, via the reservoir fluid discharge communicator 604, and (ii) fluid communication, between the passageway 626 and the intermediate fluid passage 112, via the gas-depleted reservoir fluid receiver 608. In this respect, in some embodiments, for example, the passageway sealed interface 640 is established, for preventing, or substantially preventing, independently, each one of: (i) fluid communication, via the gas-depleted reservoir fluid-conducting conductor 610, between the passageway 626 and the gas-depleted reservoir fluid receiver 608; and (ii) fluid communication, via the reservoir fluid conductor 603, between the passageway 626 and the reservoir fluid discharge communicator 604.

In some embodiments, for example, the establishment of the passageway sealed interface 640 is effected by deploying a flow through-effecting insert 650 into the passageway 626. In some embodiments, for example, the flow through-effecting insert 650 is deployed within the production string 202 and the deployment is such that the flow through-effecting insert 650 becomes releasably coupled to the insert-receiving part 622, with effect that the flow through-effecting insert 650 is disposed relative to the insert-receiving part 622 such that: (i) the passageway sealed interface 640 is established, and (ii) the passageway 626 is sufficiently unobstructed such that conduction of material, from the reservoir fluid receiver 602 to the gas-depleted reservoir fluid discharge communicator 610, via the passageway 626, is effectible. In some embodiments, for example, the flow through-effecting insert 650 is run downhole with the lock mandrel 802 with a running tool and is set within the production string 202 by coupling the lock mandrel 802 to a corresponding nipple within the production string 202. As alluded to above, in some embodiments, for example, the conductible material includes liquid material (in the case of the embodiment illustrated in FIG. 15G), and in some embodiments, for example, the conductible material includes a slurry material (in the case of the embodiment illustrated in FIG. 15F).

Figure 16A:
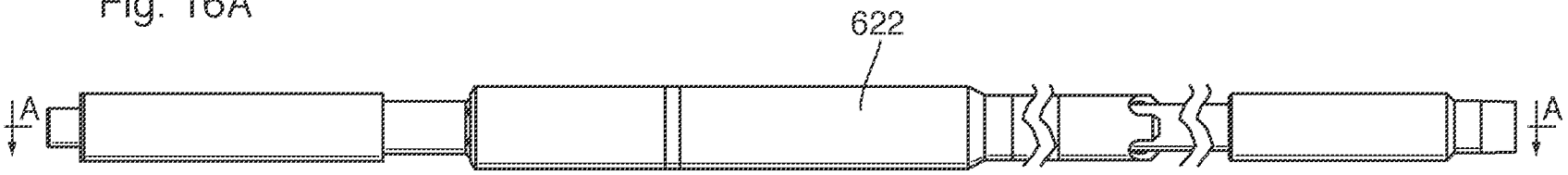
FIG. 16A is a side view of the exterior of the insert-receiving part having a flow through-effecting part disposed within the passageway of the insert-receiving part.
Figure 16B:
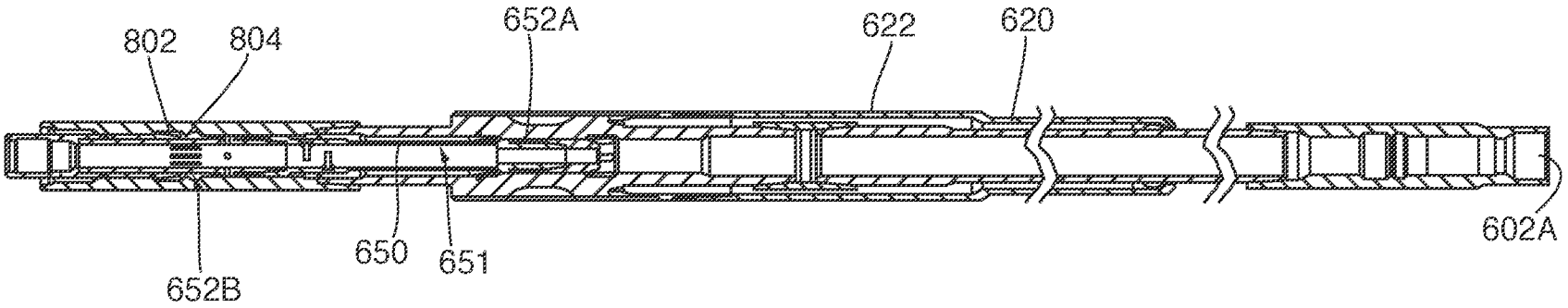
FIG. 16B is a sectional elevation view of the assembly illustrated in FIG. 16A, taken along lines A-A

Referring to FIGS. 16A and 16B, in some embodiments, for example, the flow through-effecting insert 650 is in the form of a sleeve, that defines a fluid passage 651, and includes sealing members 652A, 652B. The flow through-effecting insert 650 and the insert-receiving part 622 are co-operatively configured such that the sealing members 652A, 652B are disposed for preventing, or substantially preventing, independently, each one of: (i) fluid communication, via the gas-depleted reservoir fluid-conducting conductor 610, between the passageway 626 and the gas-depleted reservoir fluid receiver 608; and (ii) fluid communication, via the reservoir fluid conductor 603, between the passageway 626 and the reservoir fluid discharge communicator 604. Sealing member 652A prevents, or substantially prevents, material flow received by the inlet 602A from bypassing the fluid passage 651 (such as, for example, by being conducted into the intermediate fluid passage 112 of the wellbore 102 via the fluid conductor 603 of the insert-receiving part 622). Sealing member 652B prevents, or substantially prevents, material flow from bypassing the uphole production string portion 210 (such as, for example, by being conducted into the intermediate fluid passage 112 of the wellbore 102 via the fluid conductor 610 of the insert-receiving part 622)

In some embodiments, for example, after pumping out of the solid debris, the fluid barrier 214 is displaced from the open position to the closed position with a shifting tool. In some embodiments, for example, the flow through-effecting insert 650 is uncoupled and removed from the wellbore, the flow diverter-effecting insert 624 is redeployed into the flow diverter-defining position, and the pump is redeployed, and production can be resumed.

In some embodiments, for example, the passageway sealed interface 640 is established by the interaction between the flow through-effecting insert 650 and the insert-receiving part 622 while production is effected through the production string 202 during "natural flow", and the flow through-effecting insert 650 is changed out and replaced by the flow diverter-effecting insert 624 for effecting establishment of the flow diverter 600 after the producing of the reservoir by natural flow has been occurring for a time duration sufficient to have depleted the hydrocarbon material within the reservoir such that reservoir pressure has decreased such that the rate of production has sufficiently decreased (e.g. below a commercially desirable rate) so as to require artificial lift to effect the production of the hydrocarbon material from the reservoir.

Figure 17A:
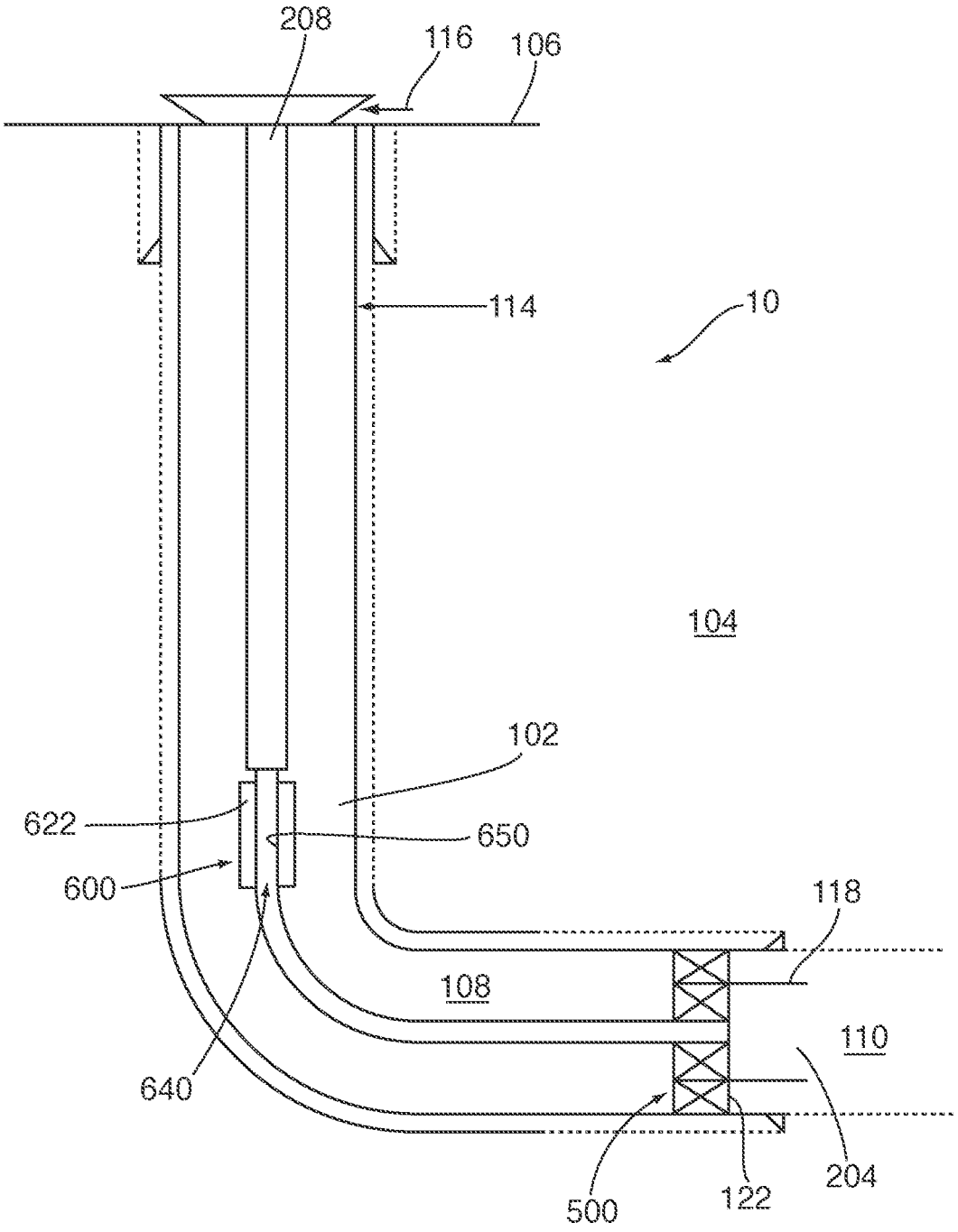
FIG. 17A is a schematic illustration of an embodiment of a system used for production during "natural flow"
Figure 17B:
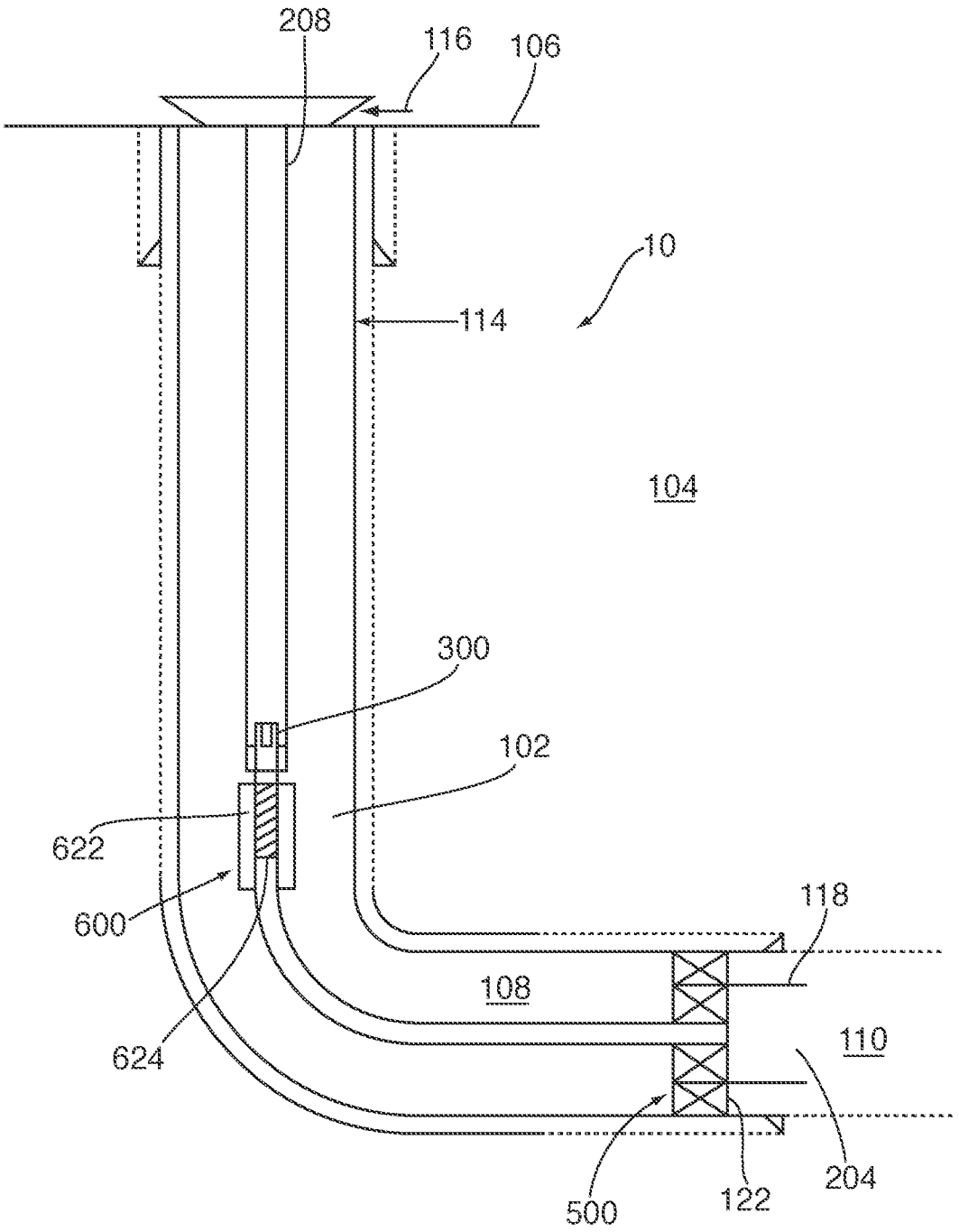
FIG. 17B is a schematic illustration of the system illustrated in FIG. 17A, with the system having been changed over for production via artificial lift.
Figure 18A:
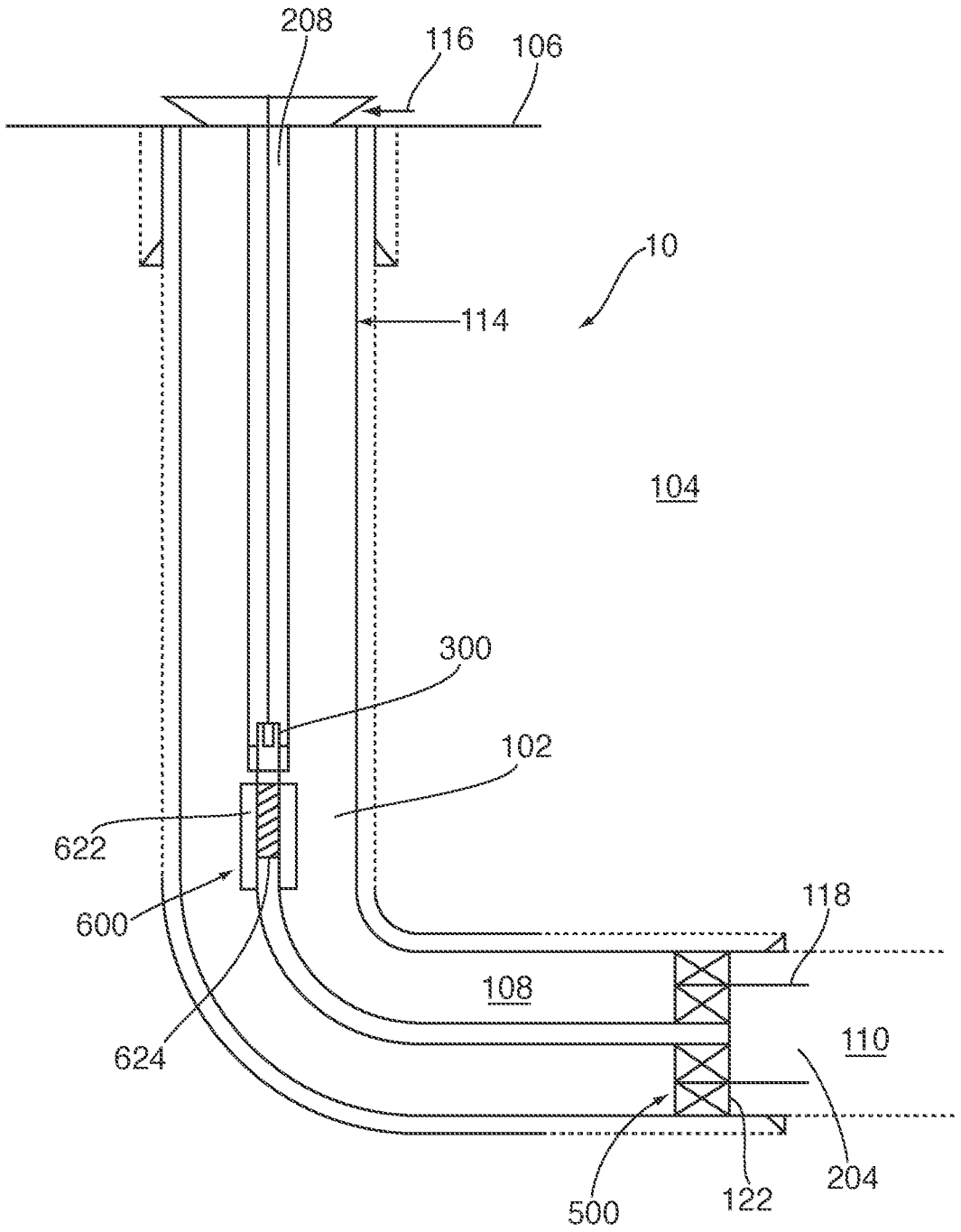
FIG. 18A is a schematic illustration of an embodiment of a system used for production of reservoir fluid from a subterranean formation.
Figure 18B:
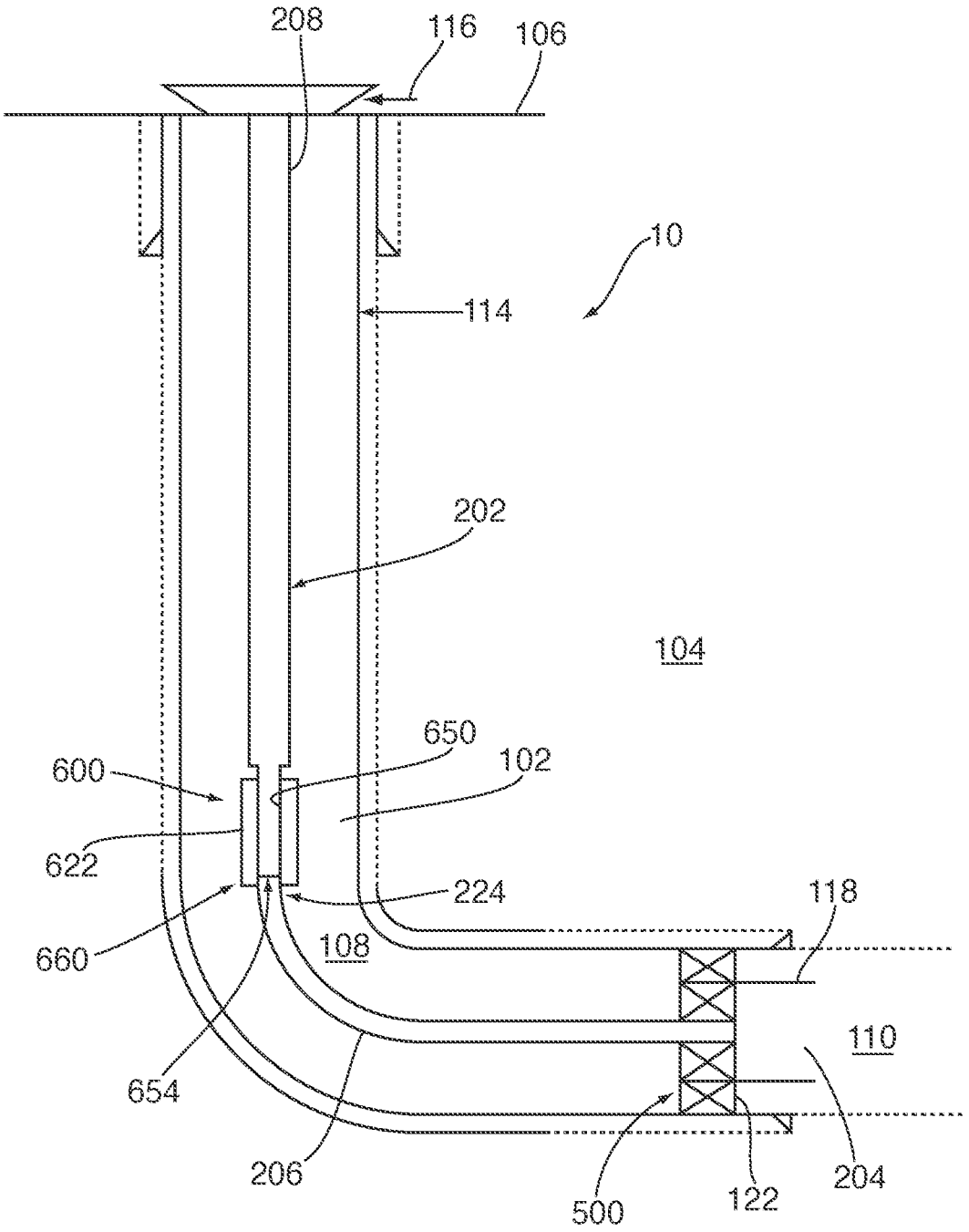
FIG. 18B is a schematic illustration of the system illustrated in FIG. 18A, after having a plug deployed for mitigating the effects of a frac hit.

In this respect, and referring to FIGS. 17A and 17B, in some embodiments, for example, a process for producing reservoir fluids from a reservoir disposed within a subterranean formation, is provided and includes, over a first time interval, producing hydrocarbon material from the reservoir via the production string 202 in response to a pressure differential between the reservoir (from which the reservoir fluid is being produced) and the surface 106. In some embodiments, for example, the producing is effected solely by pressure drive effected by the pressure differential between the reservoir (from which the reservoir fluid is being produced) and the surface 106, and pump 300 is not used.

As described above, the insert-receiving part 622 includes the passageway 626, and the passageway extends from the reservoir fluid receiver 602 to the gas-depleted reservoir fluid discharge communicator 612. The insert-receiving part 622 also includes the reservoir fluid conductor 603 extending from the passageway portion 630, of the passageway 626, to the reservoir fluid discharge communicator 604. The insert-receiving part 622 also includes the gas-depleted reservoir fluid conductor 610 extending from the passageway portion 632, of the passageway 626, to the gas-depleted reservoir fluid discharge communicator 612.

Referring to FIG. 17A, the flow through-effecting insert 650 is disposed within the passageway 626. In some embodiments, for example, the flow through-effecting insert 650 is releasably coupled to the insert-receiving part 622 with the lock mandrel 802, such as, for example, in a manner similar to the releasable coupling of the flow diverter-effecting insert 622 to the insert-receiving part 622 with the lock mandrel 802. In this respect, the flow through-effecting insert 650 is disposed relative to the insert-receiving part 622 such that: (i) the passageway sealed interface 640 is established, and (ii) the passageway 626 is sufficiently unobstructed such that conduction of reservoir fluid, from the reservoir fluid receiver 602 to the gas-depleted reservoir fluid discharge communicator 610, via the passageway 626, is effectible. In this respect, the passageway sealed interface 640 is for preventing, or substantially preventing, independently, each one of: (i) fluid communication, via the gas-depleted reservoir fluid-conducting conductor 610, between the passageway 626 and the gas-depleted reservoir fluid receiver 608; and (ii) fluid communication, via the reservoir fluid conductor 603, between the passageway 626 and the reservoir fluid discharge communicator 604.

After the first time interval, the producing is suspended. In some embodiments, for example, the suspending is effected in response to detection of a reservoir pressure (from which the reservoir fluid is being produced) that is below a predetermined low reservoir pressure. In such cases, the reservoir pressure is insufficient to drive production of reservoir fluid from the reservoir at a sufficient rate, and artificial lift is required to assist with effecting production of the reservoir fluid. In some embodiments, for example, the suspending is effected in response to detection of a rate of production of the reservoir fluid that is below a predetermined low production rate. In this respect, and referring to FIG. 17B, after the suspending of the producing, the flow through-effecting insert 650 is uncoupled and displaced relative to the insert-receiving part 624 such that passageway sealed interface 640 is defeated, and such that: (i) the passageway portion 630 (and, therefore, the passageway 626) becomes disposed in fluid communication with the reservoir fluid discharge communicator 604 via the reservoir fluid conductor 603, and (ii) the passageway portion 632 (and, therefore, the passageway 626) becomes disposed in fluid communication with the gas-depleted reservoir fluid discharge communicator 612 via the gas-depleted reservoir fluid conductor 610. In some embodiments, for example, the flow through-effecting insert 650 is removed from the production string 202. After the displacing of the flow through-effecting insert 650, the flow diverter-effecting insert 624 is deployed to the flow-diverter defining position such that the passageway sealed interface 628 is established and the flow diverter 600 is established. In some embodiments, for example, the flow diverter-effecting insert 624 is run downhole with the lock mandrel 802 with a running tool and is set within the production string 202 by coupling the lock mandrel 802 to a corresponding nipple within the production string 202. The pump 300 is then deployed within the production string 202 to a position that is uphole from the flow diverter 600, and production is then effected over a second time interval via the pump 300.

In some embodiments, for example, there is further provided a plug 660 configured for becoming releasably coupled to the coupler 804 that is used for releasably coupling the flow diverter-effecting insert 224, and also, in some embodiments, for example, for releasable coupling the flow through-effecting insert 650. In this respect, in some embodiments, for example, the coupler 804 includes the XN-nipple that is threaded to the insert-receiving part 624. In this respect, in some embodiments, for example, the plug 660 is deployed downhole with a locking mandrel 802, and the locking mandrel 802 effects the coupling of the plug 660 to the coupler 804. In some embodiments, for example, the plug 660 includes a check valve 654 configured for preventing, or substantially preventing, flow in an uphole direction while the plug is installed within the wellbore 102. In some embodiments, for example, the plug includes the flow through-effecting insert 650, to which is coupled (e.g. threaded) a check valve 654. In some embodiments, for example, it is desirable to deploy a plug to mitigate a frac hit from an offset wellbore. In this respect, in some embodiments, for example, reservoir fluid is produced from a producing wellbore with the pump 300 from a reservoir disposed within the subterranean formation. The producing includes, via the flow diverter 600, receiving reservoir fluid flow from the downhole wellbore space 110, conducting the received reservoir fluid flow uphole, discharging the received reservoir fluid flow into the uphole wellbore space 108 such that, while the discharged reservoir fluid flow is disposed within the uphole wellbore space 108, gaseous material is separated from the discharged reservoir fluid flow in response to at least buoyancy forces, such that a gas-depleted reservoir fluid flow is obtained; receiving and conducting the gas-depleted reservoir fluid flow, discharging the conducted gas-depleted reservoir fluid flow, and pressurizing the gas-depleted reservoir fluid flow with the pump 300. The flow diverter 600 includes the insert-receiving part 622 and the flow diverter-effecting insert 624, the insert-receiving part 622 includes the passageway 626, and the flow diverter-effecting insert 624 is disposed within the passageway 626. In anticipation of a frac hit, the producing is suspended, the pump 300 and the insert 624 are removed from the wellbore 102. In this respect, after the pump 300 is removed the producing wellbore, the flow diverter-effecting insert 624 is uncoupled from the coupler 804 and displaced such that the coupler 804 is disposed for coupling to the plug 660. After the displacement, the plug 660 is run downhole with the lock mandrel 802 with a running tool and is set within the production string 202 by coupling the lock mandrel 802 to the coupler 804 within the production string 202. The plug prevents, or substantially preventing, ingress of solid material, such as proppant, that originates from a frac hit, into the wellbore portion uphole of the deployed plug, thereby limiting such ingress into the wellbore 102, such as while the offset wellbore is fracced. In some embodiments, for example, the offset wellbore is disposed less than one (1) mile from the producing wellbore. In some embodiments, for example, the offset wellbore is disposed less than 0.5 miles from the producing wellbore.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

What is claimed is:

1. A process for producing reservoir fluids from a reservoir disposed within a subterranean formation, comprising:

producing gas-depleted reservoir fluid from the reservoir via a production string disposed within a wellbore, wherein the producing comprises:

via a flow diverter;

receiving reservoir fluid flow from a downhole wellbore space, conducting the received reservoir fluid flow uphole, discharging the received reservoir fluid flow external of the flow diverter and into an uphole wellbore space such that, while the discharged reservoir fluid flow is disposed within the uphole wellbore space external of the flow diverter, gaseous material is separated from the discharged reservoir fluid flow in response to at least buoyancy forces, such that a gas-depleted reservoir fluid flow is obtained, receiving and conducting the gas-depleted reservoir fluid flow, wherein the receiving and the conducting of the gas-depleted reservoir fluid flow is separate from the receiving of the reservoir fluid flow from the downhole wellbore space, and discharging the conducted gas-depleted reservoir fluid flow;

wherein:

the flow diverter comprises an insert-receiving part and a flow diverter-effecting insert, the insert-receiving part comprises a passageway; and the flow diverter-effecting insert is disposed within the passageway to effect occlusion of the passageway;

conducting the discharged gas-depleted reservoir fluid to a pump;

pressurizing the gas-depleted reservoir fluid with the pump such that the gas-depleted reservoir fluid is conducted to the surface; and displacing the flow diverter-effecting insert, relative to the insert-receiving part, such that the occlusion of the passageway of the insert-receiving part, by the flow diverter-effecting insert, is at least partially removed, and such that the insert-receiving part becomes disposed in a non-occluded condition.

2. The process as claimed in claim 1, further comprising:

after the displacing of the flow diverter-effecting insert, performing a wellbore operation downhole of the insert-receiving part, wherein the performing a wellbore operation comprises passing material through the passageway of the insert-receiving part.

3. The process as claimed in claim 2, further comprising prior to the displacing, suspending the producing.

4. The process as claimed in claim 3, wherein the flow diverter-effecting insert is releasably coupled to the insert-receiving part, and the process further comprises prior to the displacing of the flow diverter-effecting insert, uncoupling the flow diverter-effecting insert relative to the fluid-conducing part.

5. A process for producing reservoir fluids from a reservoir disposed within a subterranean formation, comprising:

over a first time interval, via a production string disposed within a wellbore, producing reservoir fluids from the reservoir with a pump disposed at a first position within the production string; and after the first time interval, suspending the producing, and while the production string remains disposed within the wellbore:

redeploying the pump within the production string such that the pump becomes disposed at a second position that is disposed below the first position; and over a second time interval, and via the production string, producing reservoir fluids from the reservoir with the pump;

wherein, during the first time interval, the producing includes, via a flow diverter: receiving reservoir fluid flow from a downhole wellbore space, conducting the received reservoir fluid flow uphole, discharging the received reservoir fluid flow external of the flow diverter and into an uphole wellbore space such that, while the discharged reservoir fluid flow is disposed within the uphole wellbore space external of the flow diverter, gaseous material is separated from the discharged reservoir fluid flow in response to at least buoyancy forces, such that a gas-depleted reservoir fluid flow is obtained;

receiving and conducting the gas-depleted reservoir fluid flow, wherein the receiving and the conducting of the gas-depleted reservoir fluid flow is separate from the receiving of the reservoir fluid from the downhole wellbore space, and discharging the conducted gas-depleted reservoir fluid flow.

6. The process as claimed in claim 5, wherein:

the flow diverter comprises an insert-receiving part and a flow diverter-effecting insert, the insert-receiving part comprises a passageway;

the flow diverter-effecting insert is disposed within the passageway; and the process further comprises:

prior to the re-deployment of the pump, displacing the flow diverter-effecting insert relative to the insert-receiving part such that occlusion of the passageway of the insert-receiving part, by the flow diverter-effecting insert, is at least partially removed, and such that the insert-receiving part becomes disposed in a non-occluded condition, such that the pump is re-deployable to the second position, through the passageway, after the first insert-receiving part becomes disposed in the non-occluded condition.

7. The process as claimed in claim 6, wherein:

the insert-receiving part, relative to which the flow diverter-effecting insert is displaced such that that occlusion of the passageway of the insert-receiving part, by the flow diverter-effecting insert, is at least partially removed, and such that the insert-receiving part becomes disposed in a non-occluded condition and the pump is re-deployable to the second position, through the passageway, defines a first insert-receiving part;

the flow diverter, defined by at least the disposition of the flow diverter-effecting insert within the passageway of the first insert-receiving part, is a first flow diverter; and the process further comprises:

after the at least partial removal of the occlusion by the displacement of the flow diverter-effecting insert relative to the first insert-receiving part, and prior to the re-deployment of the second pump, re-deploying the flow diverter-effecting insert within the production string such that the flow diverter-effecting insert becomes disposed within the passageway of a second insert-receiving part, that is disposed within the production string at a position that is downhole relative to the first insert-receiving part, such that a second flow diverter is established, wherein the second flow diverter is configured for receiving reservoir fluid flow from a downhole wellbore space, conducting the received reservoir fluid flow uphole, discharging the received reservoir fluid flow into an uphole wellbore space such that, while the discharged reservoir fluid flow is disposed within the uphole wellbore space, gaseous material is separated from the discharged reservoir fluid flow in response to at least buoyancy forces, such that a gas-depleted reservoir fluid flow is obtained, receiving and conducting the gas-depleted reservoir fluid flow, and discharging the conducted gas-depleted reservoir fluid flow.

8. The process as claimed in claim 7, wherein the re-deployment of the pump is such that the pump becomes disposed for receiving gas-depleted reservoir fluid from the second flow diverter.

9. A method of creating a flow diverter comprising:

providing an insert-receiving part comprising a passageway; and inserting a flow diverter-effecting insert within the passageway such that the flow diverter is formed by the insert-receiving part and the flow diverter-effecting insert, and the flow diverter is configured for:

receiving reservoir fluid flow from a downhole wellbore space, conducting the received reservoir fluid flow uphole, discharging the received reservoir fluid flow external of the flow diverter and into an uphole wellbore space such that, while the discharged reservoir fluid flow is disposed within the uphole wellbore space external of the flow diverter, gaseous material is separated from the discharged reservoir fluid flow in response to at least buoyancy forces, such that a gas-depleted reservoir fluid flow is obtained, receiving and conducting the gas-depleted reservoir fluid flow, wherein the receiving and the conducting of the gas-depleted reservoir fluid flow is separate from the receiving of the reservoir fluid flow from the downhole wellbore space, and discharging the conducted gas-depleted reservoir fluid flow.

10. The method as claimed in claim 9, wherein inserting the flow diverter-effecting insert within the passage is to effect occlusion of the passageway such that the flow diverter is obtained.

* * * * *